US009830891B2

(12) United States Patent
Finkle

(10) Patent No.: US 9,830,891 B2
(45) Date of Patent: Nov. 28, 2017

(54) STRINGED INSTRUMENT SYSTEM

(71) Applicant: Modern Vintage Technology, LLC, Randolph, MA (US)

(72) Inventor: Scott Finkle, Randolph, MA (US)

(73) Assignee: Modern Vintage Technology, LLC, Randolph, MA (US)

( * ) Notice: Subject to any disclaimer, the term of this patent is extended or adjusted under 35 U.S.C. 154(b) by 0 days.

(21) Appl. No.: 14/936,210

(22) Filed: Nov. 9, 2015

(65) Prior Publication Data

US 2016/0063971 A1 Mar. 3, 2016

Related U.S. Application Data

(62) Division of application No. 13/552,411, filed on Jul. 18, 2012, now Pat. No. 9,183,815.

(51) Int. Cl.

| | |
|---|---|
| ***G10D 3/00*** | (2006.01) |
| ***G10D 3/14*** | (2006.01) |
| ***G10D 3/12*** | (2006.01) |
| ***G10D 3/04*** | (2006.01) |

(52) U.S. Cl.

CPC ..... *G10D 3/146* (2013.01); *G10D 3/00* (2013.01); *G10D 3/04* (2013.01); *G10D 3/12* (2013.01)

(58) Field of Classification Search

CPC ..... G10D 3/146; G10D 3/14; G10D 3/04

See application file for complete search history.

(56) References Cited

U.S. PATENT DOCUMENTS

2004/0255752 A1* 12/2004 Geier ..... G10D 3/146 84/313

* cited by examiner

*Primary Examiner* — Kimberly Lockett

(74) *Attorney, Agent, or Firm* — Bay State IP, LLC

(57) ABSTRACT

A tremolo device for static retention of a plurality of musical instrument strings in a stringed instrument. The tremolo device has a body with an upper surface, a neck portion, and a plurality of strings anchored at a first end of the neck and extending over at least a portion and secured to the tremolo device at the other end of the neck portion and the body and possesses an inertia block mechanism with substantially solid construction disposed to receive and securely retain a plurality of raw instrument strings without removal of a ball end from each string. The inertia block has an upper portion, a lower portion, and a plurality of internal, longitudinally displaced, cylindrically shaped, string retaining chambers designed to pass through an entirety of the block mechanism. The string retaining chambers have an upper and lower portion corresponding with the upper and lower portions of the block.

10 Claims, 55 Drawing Sheets

STRINGED INSTRUMENT SYSTEM

CROSS-REFERENCE TO RELATED APPLICATION

This application is a divisional application of U.S. application Ser. No. 13/552,411 filed on Jul. 18, 2012, which is a continuation-in-part application of U.S. application Ser. No. 13/423,928 filed on Mar. 19, 2012, and this application also claims the benefit of and takes priority from U.S. App. No. 61/508,756 filed on Jul. 18, 2011, the contents of which are hereby incorporated by reference.

FIELD OF THE INVENTION

The present invention relates generally to string instruments, mainly guitars, including improvements to guitar parts and particularly to tremolos for retaining strings.

BACKGROUND OF THE INVENTION

Floyd Rose® retainer systems and similar units regularly require the cutting of the ball end of each of the individual strings and manually clamping the strings to the saddle in order to tune the instrument. In the original Fender® "vintage tremolo" designs and other similar designs, the strings do not enter through the inertia block. These designs also comprise a double locking system without fine tuning mechanisms. In other contemporaneous designs, the ball ends are free to move within the tremolo assembly.

The Floyd Rose® II designs are single locking where the ball end of the string is strung through the bridge plate but is not locked in place, allowing the ball end to move freely within the inertia block or the bridge plate while the tremolo arm was depressed.

These designs were later redesign to include a double locking system. Examples of double locking systems include the Ibanez® Edge, LoPro Edge, EdgePro, EdgePro-II, Edge-III, and EdgeZero. The Ibanez® Zero Resistance is a version of the Ibanez® Edge utilizing a ball-bearing mechanism, instead of a knife-edge, as the fulcrum point and comprises a stop-bar to create consistency in tuning. Other such systems include the Floyd Rose® 7-String, Floyd Rose® Pro, and the Floyd Rose® Speedloader Tremolo.

A variety of tremolo models, such as the Floyd Rose® Speedloader and Steinberger®, required string with two or double ball ends, specifically made for the systems. These strings are manufactured precisely for a given length and use mounted fine tuners to adjust string pitches and tuning.

The Yamaha® Finger Clamp, a variation of the Floyd Rose® system, comprises built-in levers for tuning the instrument. The Fender® Deluxe Locking Tremolo, a double locking system, utilizes locking tuners, a modified Fender® 2-point synchronized tremolo with locking bridge saddles and a special low-friction LSR® Roller Nut, allowing the strings to slide during tremolo use. In this system the second locking point is at the tuning machines instead of the nut.

An apparatus exists that clamps onto a Floyd Rose® to accurately set the intonation of an instrument, alleviating the need to manually adjusting the strings.

The Steinberger® Transposing Tremolo System affords use of the tremolo while maintaining consistent tuning throughout the range of the tremolo. In addition to tuning stability, the system affords the user with instant alternate tunings by manually adjusting the mechanism on the bridge.

SUMMARY OF THE INVENTION

It is an object of the instant system is to lock the all portions of a stringed instrument from tremolo to tuner. The strings of an instrument in place in order that the strings may not move with within the block of the tremolo system while still providing a device that is adaptable to various bridges on the market without permanently modifying the instrument.

It is a further object of the invention to eliminate excess string friction and binding within the inertia block while the tremolo is in use. The invention may comprise, in one embodiment, a tremolo system which allows for the attachment of strings in a musical instrument, exclusive of any alteration or diminution to the raw strings and without altering the design of the musical instrument. The present invention vitiates any ill effect on the oscillation capacity of the stock of strings without compromising the integrity of the string or the cores of the strings, regardless if the strings exhibit a wound or unwound design.

DETAILED DESCRIPTION OF THE DRAWINGS

Figure 1:
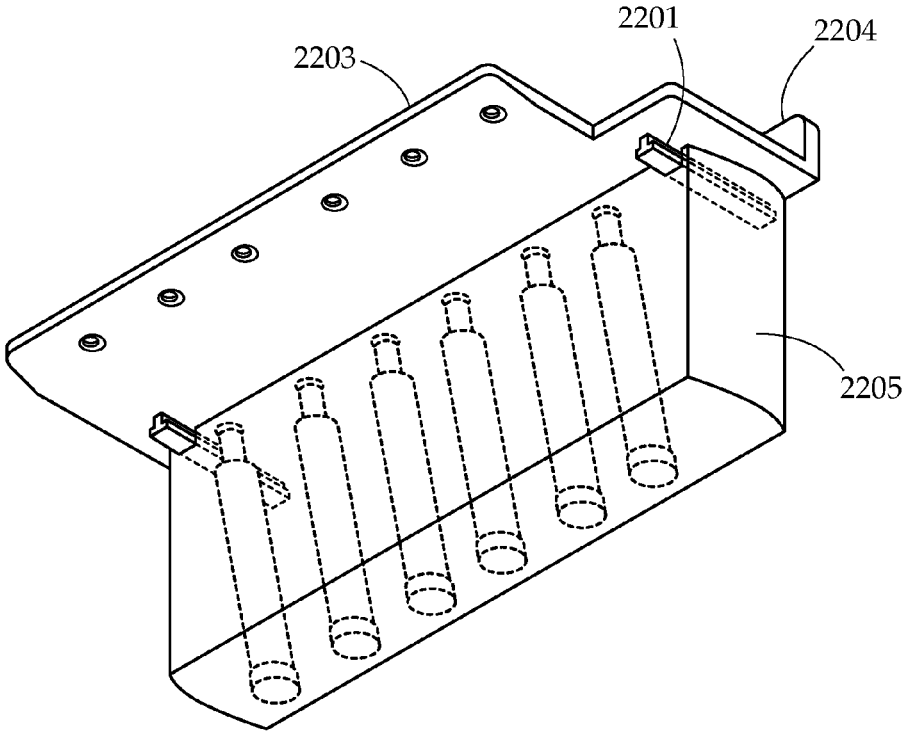
FIG. 1—Illustrates a vintage style tremolo plate assembly with integrated steel rails that interlock the bridge plate with the inertia block system.
Figure 2:
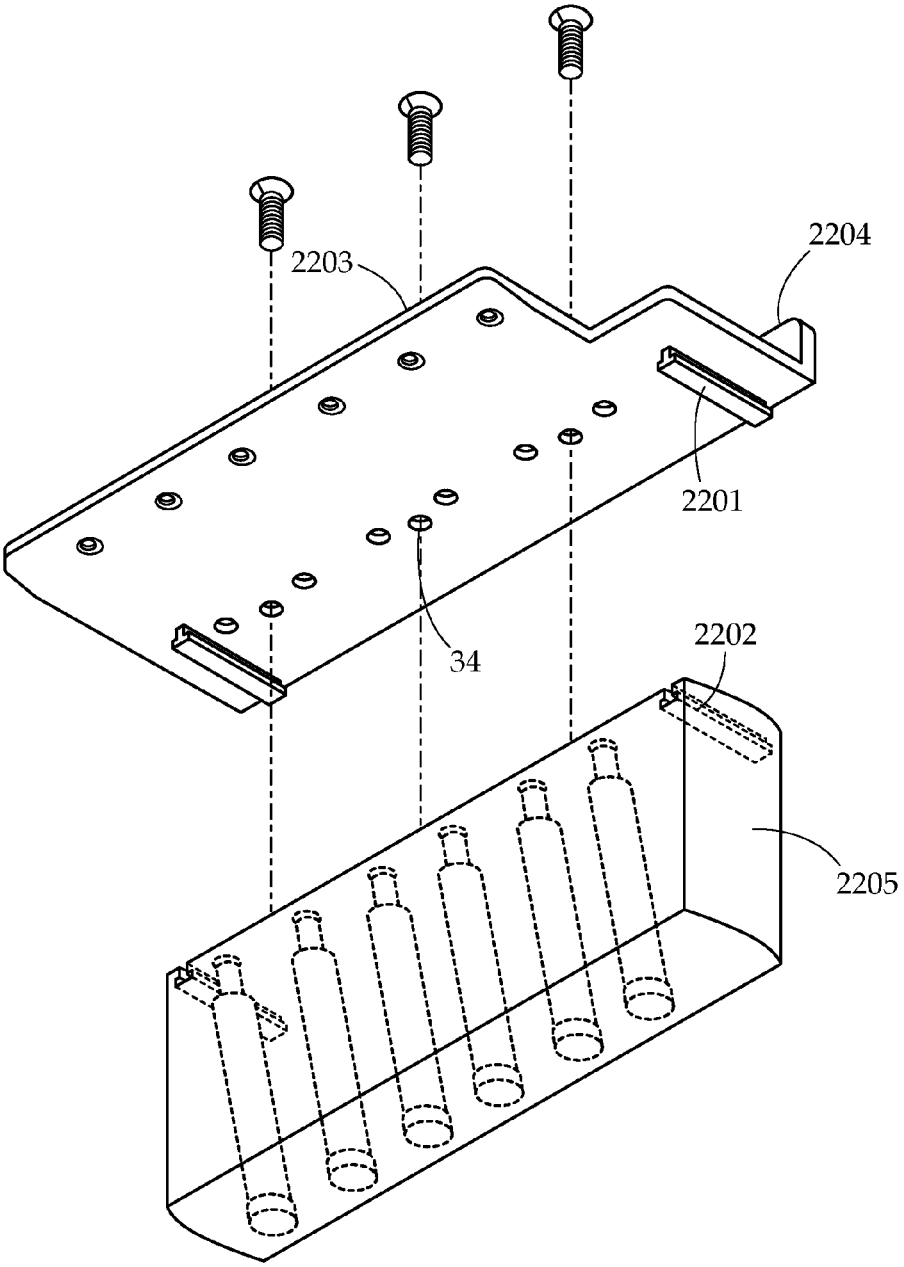
FIG. 2—Illustrates a vintage style tremolo plate with integrated steel rails that interlock the bridge plate with the inertia block system.

In one embodiment, illustrated in FIG. 1 is a vintage style tremolo plate assembly 2203 with integrated steel rails 2201 that interlock the bridge plate 2204 with the inertia block system 2205. The inertia block 2205 has a receiving end to mechanically connect the steel rails 2201 to the inertia block 2205. The string chambers are angled and threaded in this depiction. FIG. 2 illustrates a vintage style tremolo plate 2203 with integrated steel rails 2201 that interlock the bridge plate 2204 with the inertia block system 2205. The inertia block has a receiving end 2202 to mechanically connect the steel rails 2201 to the inertia block 2205. The string chambers are angled and threaded in this depiction.

Figure 6:
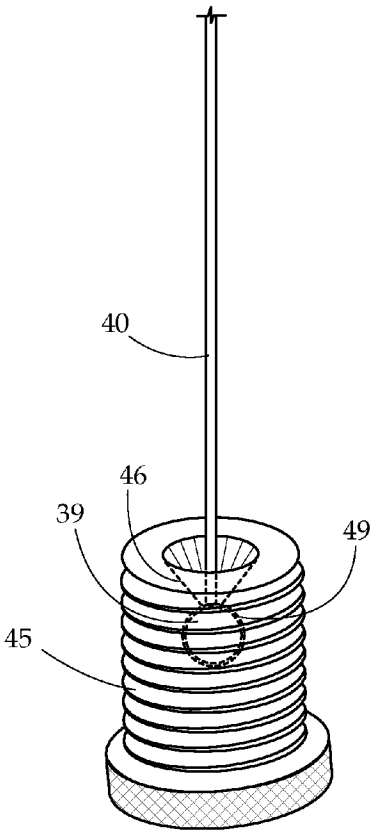
FIG. 6—Illustrates a threaded locking conical musical string with a knurled ended fastener system.
Figure 5:
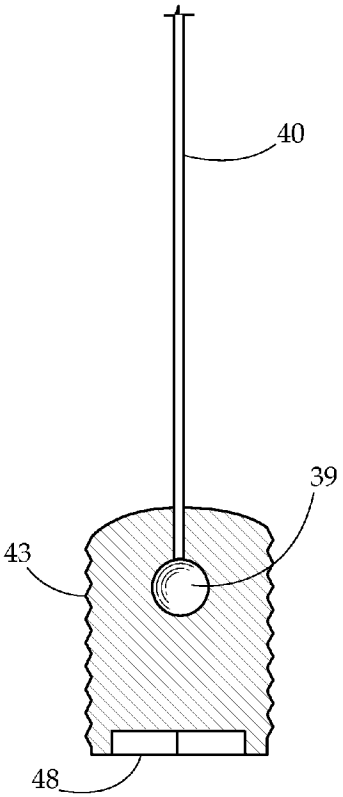
FIG. 5—Illustrates an inner perspective of the threaded locking string fastener system depicted in FIG. 4.
Figure 4:
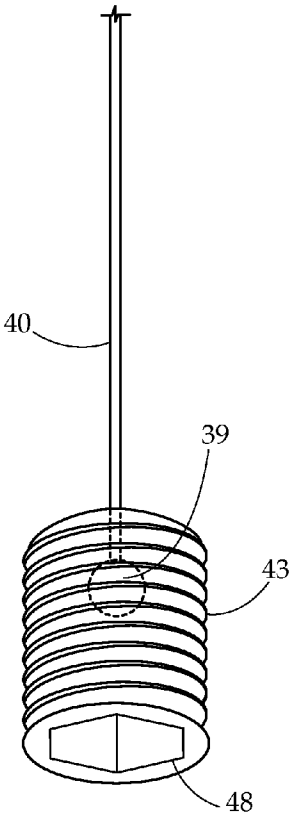
FIG. 4—Illustrates a threaded locking string-end with an integrated hexagon fastener system to mechanically secure the musical string to stringed musical instruments.
Figure 3:
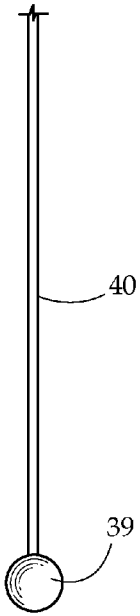
FIG. 3—Illustrates a spherical string-end design.

A spherical string-end design is shown in FIG. 3. This spherical string-end design 39 is used to allow the musical string 40 to rotate within a string chamber of a musical instrument. This end 39 can be made out of steel, brass, or other composite material. This end 39 can be made out of magnetic material to secure to an inertia block, tailpieces, tuners or other stringed musical instruments. The spherical string-end allows the string 40 to rotate various degrees and on several axes in relation to the ball end 39 of the musical string that is integrated into the instant string-end design. The string-end can be mounted on one plane and the string can be rotated on another plane without creating stressors upon the musical string. In order to mechanically secure the musical string 40 to stringed musical instruments, FIG. 4 depicts a threaded locking string-end 43 with an integrated hexagon fastener system 48. The locking end 43 ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems 43 can be made out of steel, brass, titanium, composite material or combination thereof. An inner perspective of the threaded locking string fastener system depicted in FIG. 4 is shown by FIG. 5. The locking end 43 ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof. FIG. 6 illustrates a threaded locking musical string with a knurled ended fastener system 45. This musical string has an integrated conical design 46 on the threaded end of this faster system. The conical string-end 49 allows the string to rotate various degrees and on several axes in relation to the ball end of the musical string that is integrated into the instant string-end design.

The string-end can be mounted on one plane and the string can be rotated on another plane without creating stressors upon the musical string. The locking end ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 7:
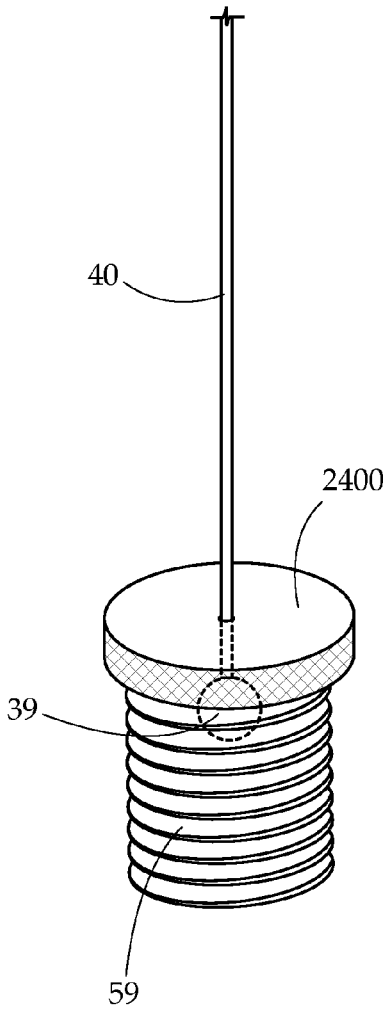
FIG. 7—Illustrates a threaded locking string-end exiting from a knurled string-ended fastener system to mechanically secure the string to stringed musical instruments.
Figure 8:
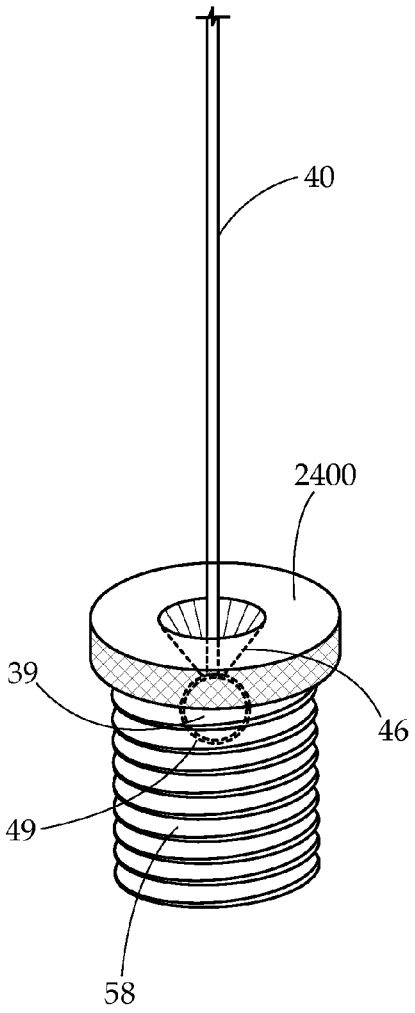
FIG. 8—Illustrates a threaded conical locking musical string exiting from a knurled string-ended fastener system to mechanically secure the string to a stringed musical instrument.

A threaded locking string-end 2400 is shown in FIG. 7 as exiting from a knurled string-ended fastener system 45, to mechanically secure the string 40 to stringed musical instruments. The locking end ensures that there is strong mechanical contact with the musical instrument to prevent unwanted movement of the musical string. This mechanically locking string design enhances sustainability, tonality, and transfer of string vibrations throughout the instrument. The string-end exits the knurled end area therefore allowing the user to secure the string-end into a musical instrument. This allows the string-end to be fastened to the instrument's tuning machines. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems 2400 can be made out of steel, brass, titanium, composite material or combination thereof. In addition to a mere threaded string as shown in FIG. 7, FIG. 8 illustrates a threaded rotating locking musical string 49 exiting from a knurled string-ended fastener system 45, to mechanically secure the string to a stringed musical instrument. This musical string can have a conical design 46 on the knurled end of this string design 45. The conical string-end allows the string to rotate various degrees and on several axes in relation to the ball end of the musical string that is integrated into the instant string-end design. The string-end can be mounted on one plane and the string can be rotated on another plane without creating stressors upon the musical string. The locking end 2400 ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user.

Figure 9:
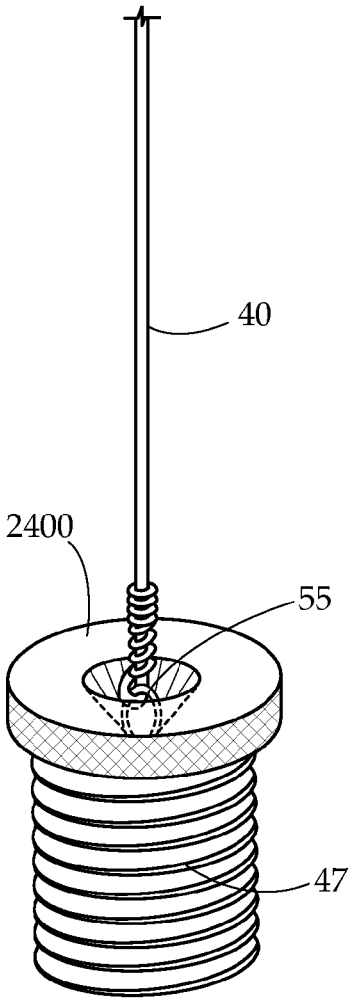
FIG. 9—Illustrates a threaded locking conical musical string exiting from a knurled string-ended fastener system to mechanically secure the string to a stringed musical instrument.
Figure 10:
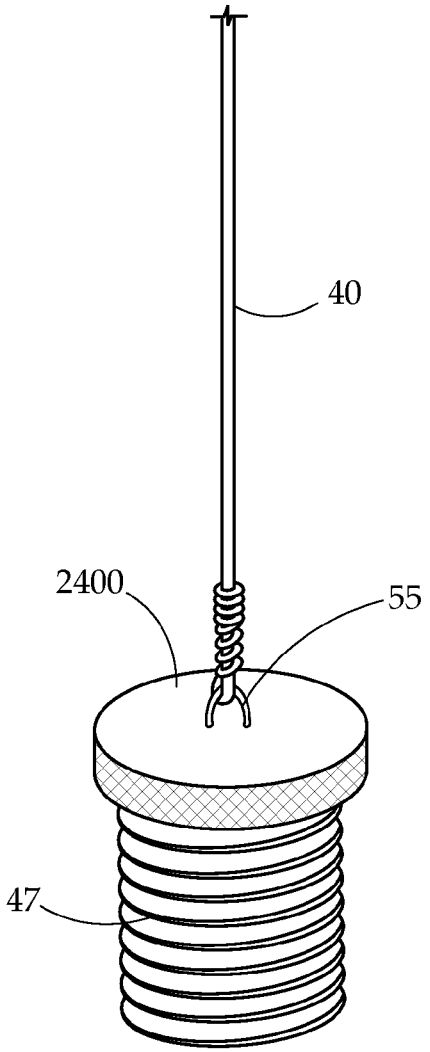
FIG. 10—Illustrates a threaded locking string-end exiting from a knurled string-ended fastener system to mechanically secure the string to stringed musical instruments.

The locking string can be used as a deterrent to prevent young children from being injured from an ejecting string-end. The locking string-ended systems can be made out of steel, brass, titanium, composite material or combination thereof. FIG. 9 is a threaded locking musical string exiting from a knurled string-ended fastener system 45 to mechanically secure the string to a stringed musical instrument. This musical string 40 has a conical design on the knurled end 45 of this string design. The musical string 40 is attached to the loop 55 contained within this conical area, which is then looped and secured around this locking fastener system 2400. The conical string-end allows the string to rotate various degrees and on several axes in relation to the ball end of the musical string that is integrated into the instant string-end design. The string-end can be mounted on one plane and the string can be rotated on another plane without creating stressors upon the musical string. The locking end ensures that there is a strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof. FIG. 10 also illustrates a threaded locking string-end exiting from a knurled string-ended fastener system 45 to mechanically secure the string to stringed musical instruments. The musical string 40 is attached to the loop 55 contained within the flat surface of this knurled area, which is then looped and secured around this locking fastener system 2400.

The locking end ensures that there is a strong mechanical contact with the musical instrument to prevent unwanted movement of the musical string. This mechanically locking string design enhances sustainability, tonality, and transfer of string vibrations throughout the instrument. The string-end exits the knurled end area therefore allowing the user to secure the string-end into a musical instrument. Thus, allowing the string-end to be fastened to the instrument's tuning machines. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 11:
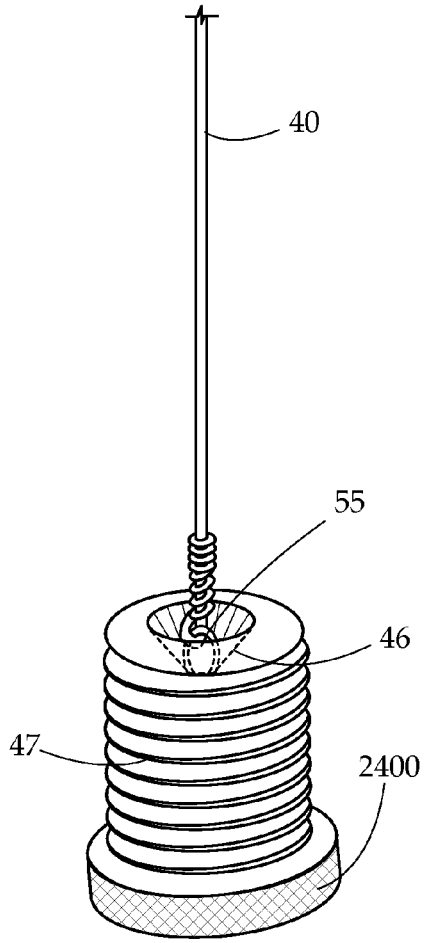
FIG. 11—Illustrates a threaded locking musical string exiting from the bottom of locking string-ended fastener system to mechanically secure the string to a stringed musical instrument.

The bottom of a locking string-ended fastener system 2400 with a threaded locking musical string exiting from it is pictured in FIG. 11. This musical string has a conical design 46 on the lower threaded area of this fastener system 47. The musical string 40 is attached to the loop 55 contained within this conical area, which is then looped and secured around this locking fastener system 2400. The conical string-end allows the string to rotate various degrees and on several axes in relation to the ball end of the musical string that is integrated into the instant string-end design. The string-end can be mounted on one plane and the string can be rotated on another plane without creating stressors upon the musical string. The locking end ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 12:
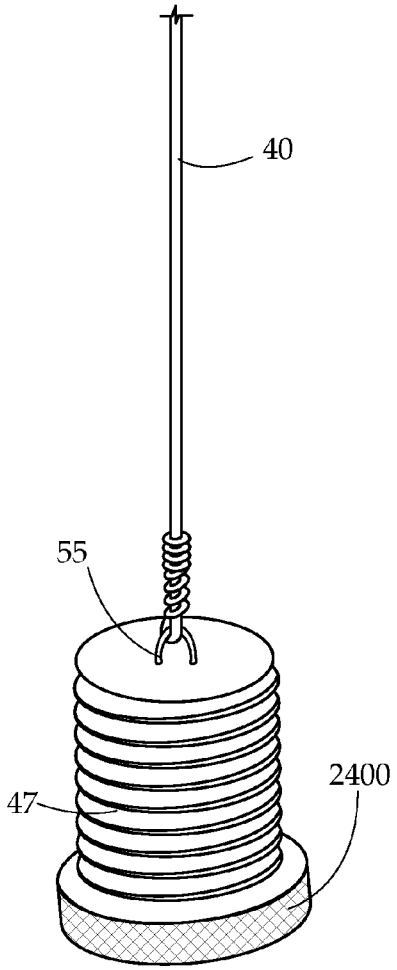
FIG. 12—Illustrates a threaded locking string-end exiting from the bottom of a locking string-ended fastener system to mechanically secure the string to stringed musical instruments.

FIG. 12 also illustrates a threaded locking string-end exiting from the bottom of a locking string-ended fastener system 2400 in order to mechanically secure the string to stringed musical instruments. The musical string 40 is attached to the loop 55 contained within the flat bottom surface of the threaded area, which is then looped and secured around this locking fastener system. The locking end ensures that there is strong mechanical contact with the musical instrument to prevent unwanted movement of the musical string. This mechanically locking string design enhances sustainability, tonality, and transfer of string vibrations throughout the instrument. The string-end exits the knurled end area therefore allowing the user to secure the string-end into a musical instrument. Thus, allowing the string-end to be fastened to the instrument's tuning machines. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 13:
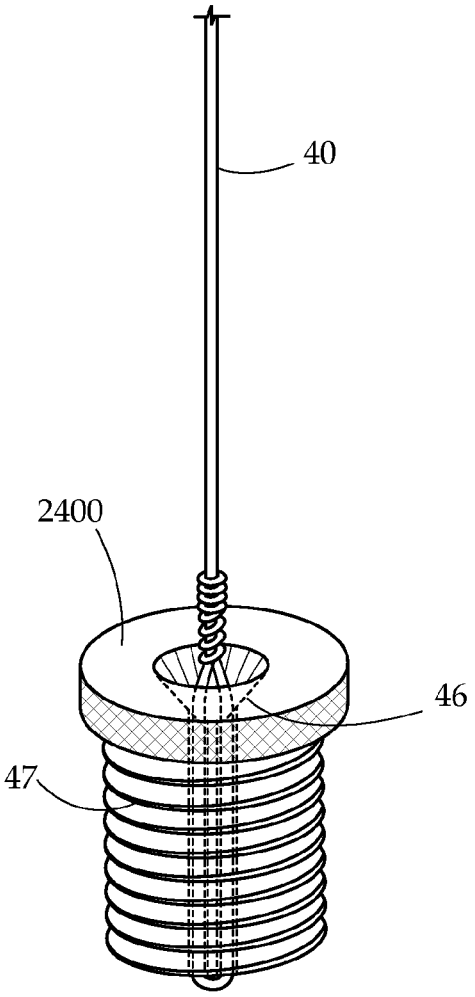
FIG. 13—Illustrates a threaded locking musical string exiting from a knurled string-ended fastener system to mechanically secure the string to a stringed musical instrument. The musical string is looped through the two vertical holes that go through this fastener assembly.

As FIG. 13 depicts, a threaded locking musical string is exiting from a knurled string-ended fastener 45, which has two vertical holes. This musical string has a conical design 46 on the knurled end of this string design. The musical string 40 is looped through the two vertical holes that go through this fastener assembly. The two sections of the musical string are mechanically tied and locked together within conical section of this fastener system. The conical string-end provides strain relief from the string at various degrees and axes. The string-end can be mounted on one plane and the string can be rotated on another plane without creating stressors upon the musical string. The locking end ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user.

Figure 14:
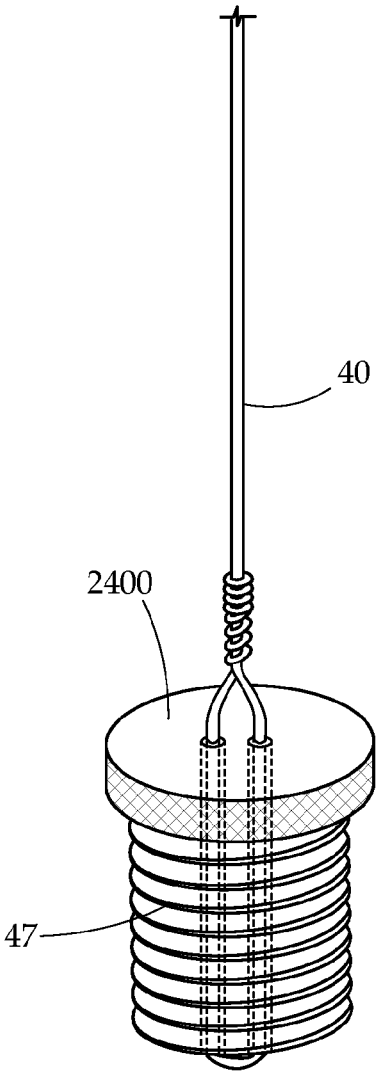
FIG. 14—Illustrates a threaded locking string-end exiting from a knurled string-ended fastener system to mechanically secure the string to stringed musical instruments. The musical string is looped through the two vertical holes that go through this fastener assembly.
Figure 15:
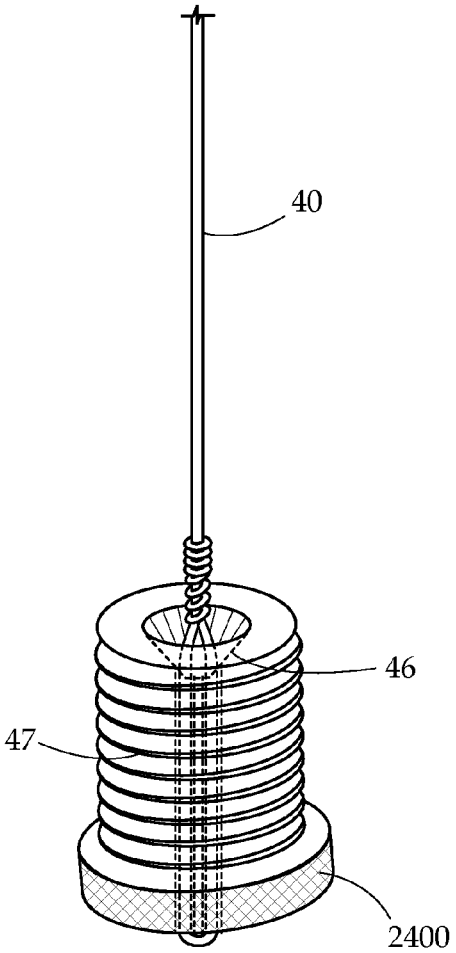
FIG. 15—Illustrates a threaded locking musical string exiting from the bottom of locking string-ended fastener system to mechanically secure the string to a stringed musical instrument.

The locking string can be used as a deterrent to prevent young children from being injured from an ejecting string-end. The locking string-ended systems can be made out of steel, brass, titanium, composite material or combination thereof. A threaded locking string-end exiting from a knurled string-ended fastener system to mechanically secure the string to stringed musical instruments is also explained by FIG. 14. The musical string is looped through the two vertical holes that go through this fastener assembly. The two sections of the musical string are mechanically tied and locked together on the knurled end of this fastener system. The locking end ensures that there is strong mechanical contact with the musical instrument to prevent unwanted movement of the musical string. This mechanically locking string design enhances sustainability, tonality, and transfer of string vibrations throughout the instrument. The string-end exits the knurled end area therefore allowing the user to secure the string-end into a musical instrument, thereby allowing the string-end to be fastened to the instrument's tuning machines. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof. Again in FIG. 15, a threaded locking musical string exiting from the bottom of locking string-ended fastener system is shown. This musical string has a conical design on the lower threaded area of this fastener system. The musical string is looped through the two vertical holes that go through this fastener assembly. The two sections of the musical string are mechanically tied and locked together within conical section of this fastener system.

The conical string-end provides strain relief from the string at various degrees and axes. The string-end can be mounted on one plane and the string can be rotated on another plane without creating stressors upon the musical string. The locking end ensures that there is strong mechanical contact with the musical instrument to prevent unwanted movement of the musical string. This mechanically locking string design enhances sustainability, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 16:
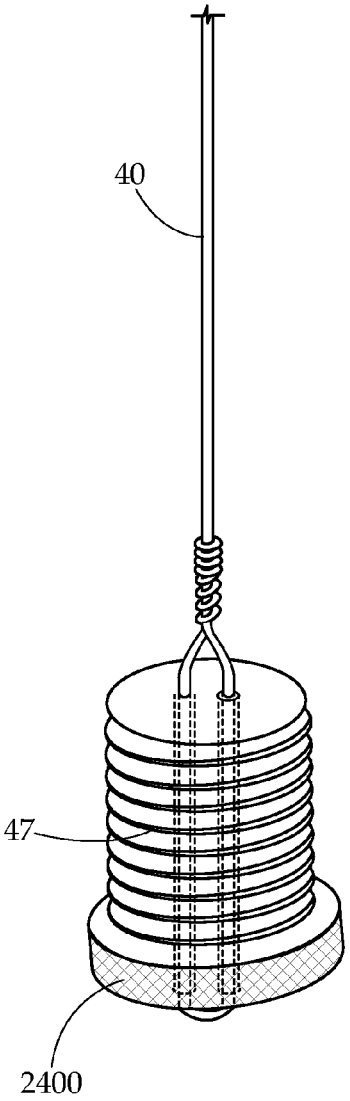
FIG. 16—Illustrates a threaded locking string-end exiting from the bottom of a bottom of locking string-ended fastener system to mechanically secure the string to stringed musical instruments. The musical string is looped through the two vertical holes that go through this fastener assembly.

FIG. 16 is the last depiction of a threaded locking string-end exiting from a bottom locking string-ended fastener system. The musical string is looped through the two vertical holes that go through this fastener assembly. The two sections of the musical string are mechanically tied and locked together on the knurled end of this fastener system. The locking end ensures that there is strong mechanical contact with the musical instrument to prevent unwanted movement of the musical string. This mechanically locking string design enhances sustainability, tonality, and transfer of string vibrations throughout the instrument. The string-end exits the knurled end area therefore allowing the user to secure the string-end into a musical instrument. Thus, allowing the string-end to be fastened to the instrument's tuning machines. The locking string also prevents the string from ejecting from the instrument upon accidental breakage and therefore preventing damage to the instrument and/or a serious injury to the user. The locking string can be used as a deterrent to prevent young children from being injured from an ejecting string-end. The locking string-ended systems can be made out of steel, brass, titanium, composite material or combination thereof.

Figure 18:
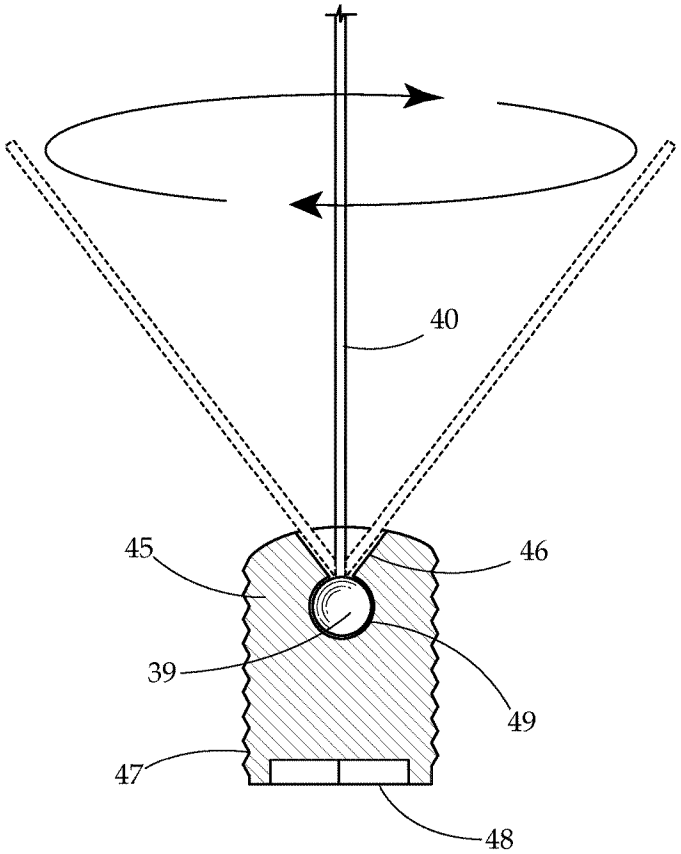
FIG. 18—Illustrates a cutaway version of FIG. 17. This depicts the integrated rotating string cavity, its ball end, and a cutaway of the hex head configuration.
Figure 17:
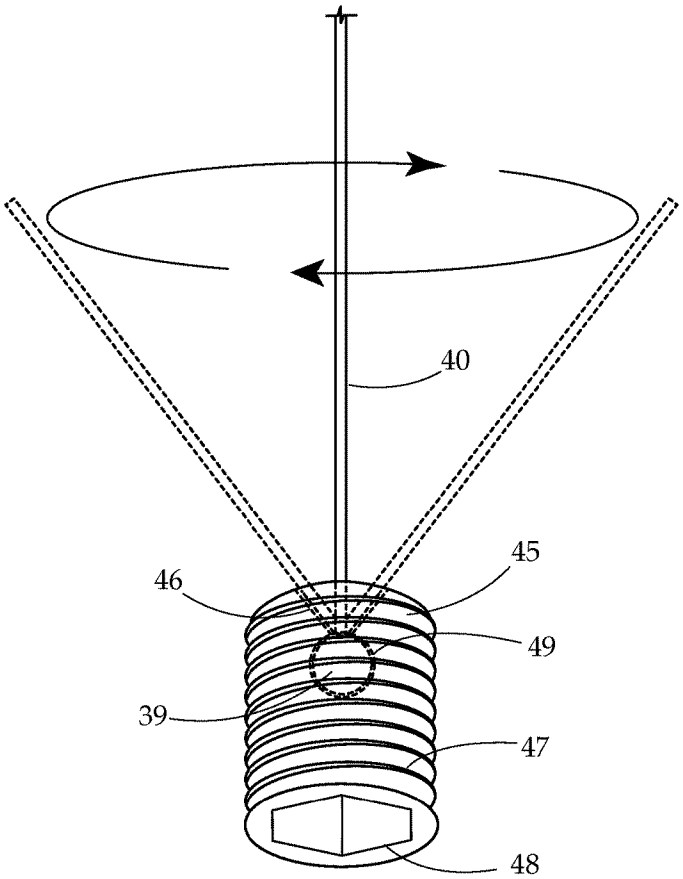
FIG. 17—Illustrates a side profile of a rotating threaded locking string depicting the range of angles and axes that are available in this string-end design.

A side profile is imaged in FIG. 17, of a rotating threaded locking string 40 depicting the range of angles and axes that are available in this string-end design. In this figure, the rotating or swivel locking string-end has an integrated rotating string chamber and cavity, as well as an integrated hex-head locking string configuration 48. The locking string-ended systems can be made out of steel, brass, titanium, composite material or combination thereof. FIG. 18 illustrates a cutaway version of FIG. 17. This depicts the integrated rotating string cavity, its ball end 39, and a cutaway of the hex-head configuration 48.

Figure 19:
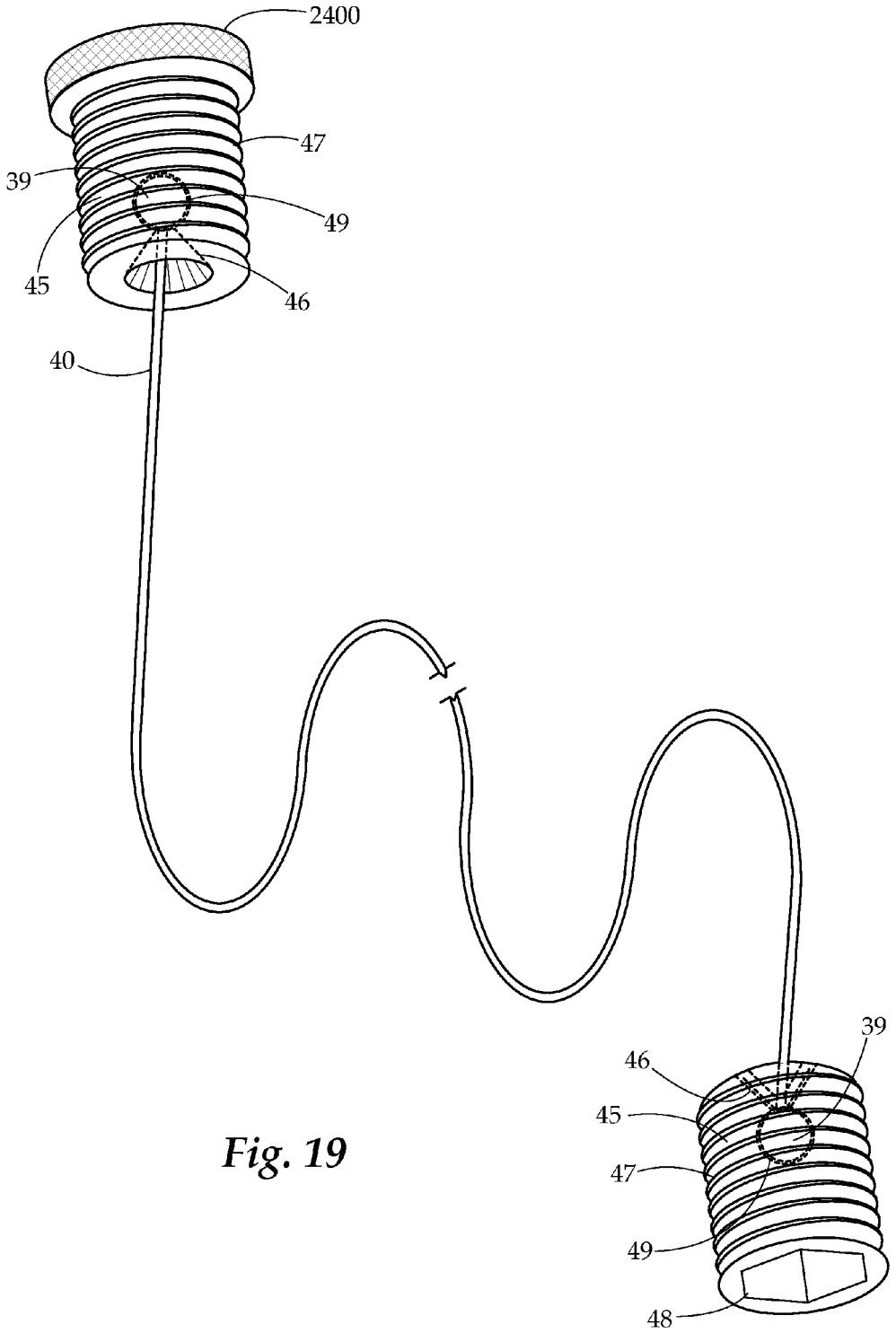
FIG. 19—Illustrates a double string-ended locking string-ended system with both a rotating knurled locking string in conjunction with rotating hex headed locking string designs.
Figure 20:
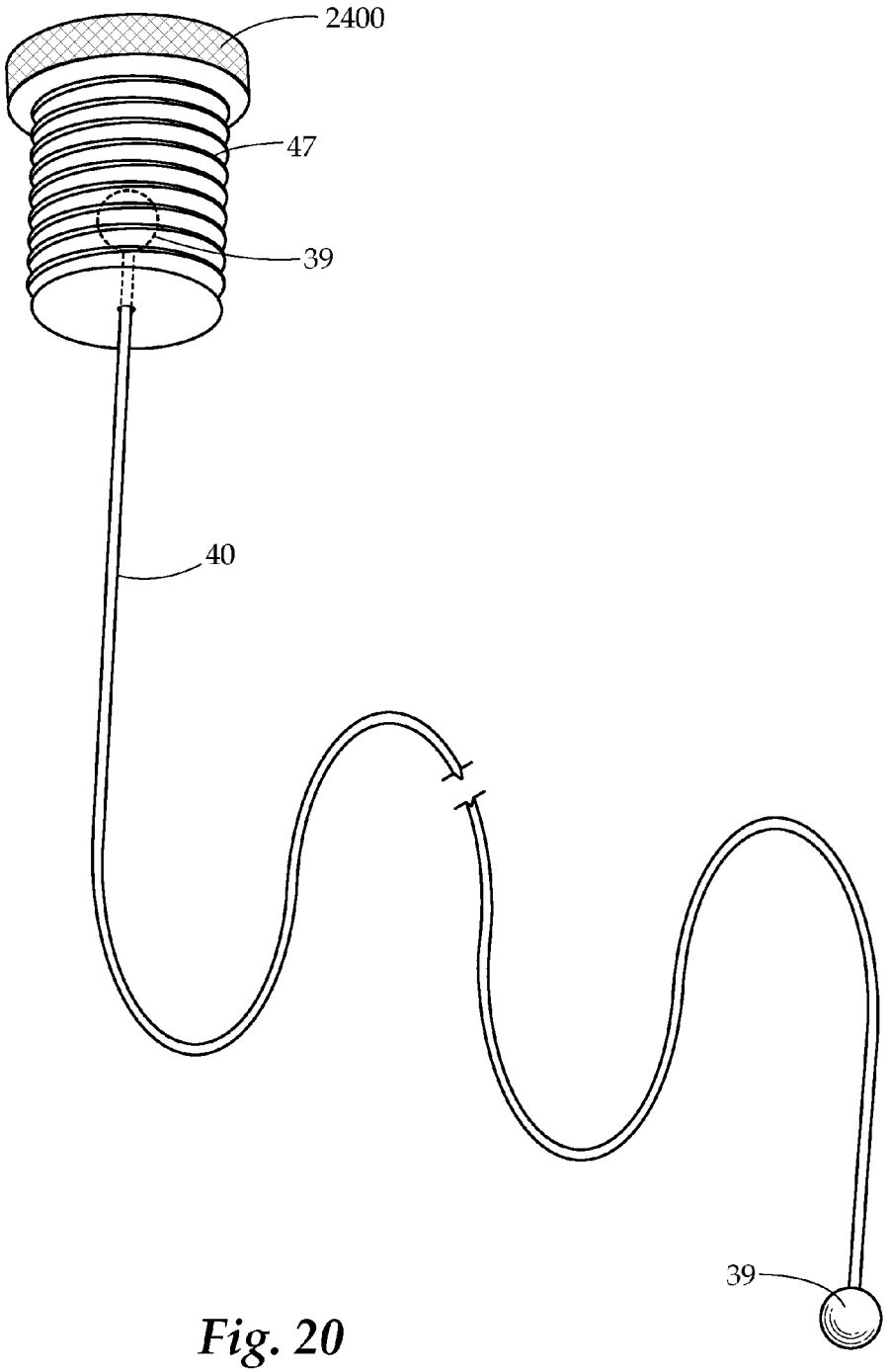
FIG. 20—Illustrates a double string-ended locking system with a knurled ended, non-rotating string design in conjunction with a spherical ended string design.
Figure 21:
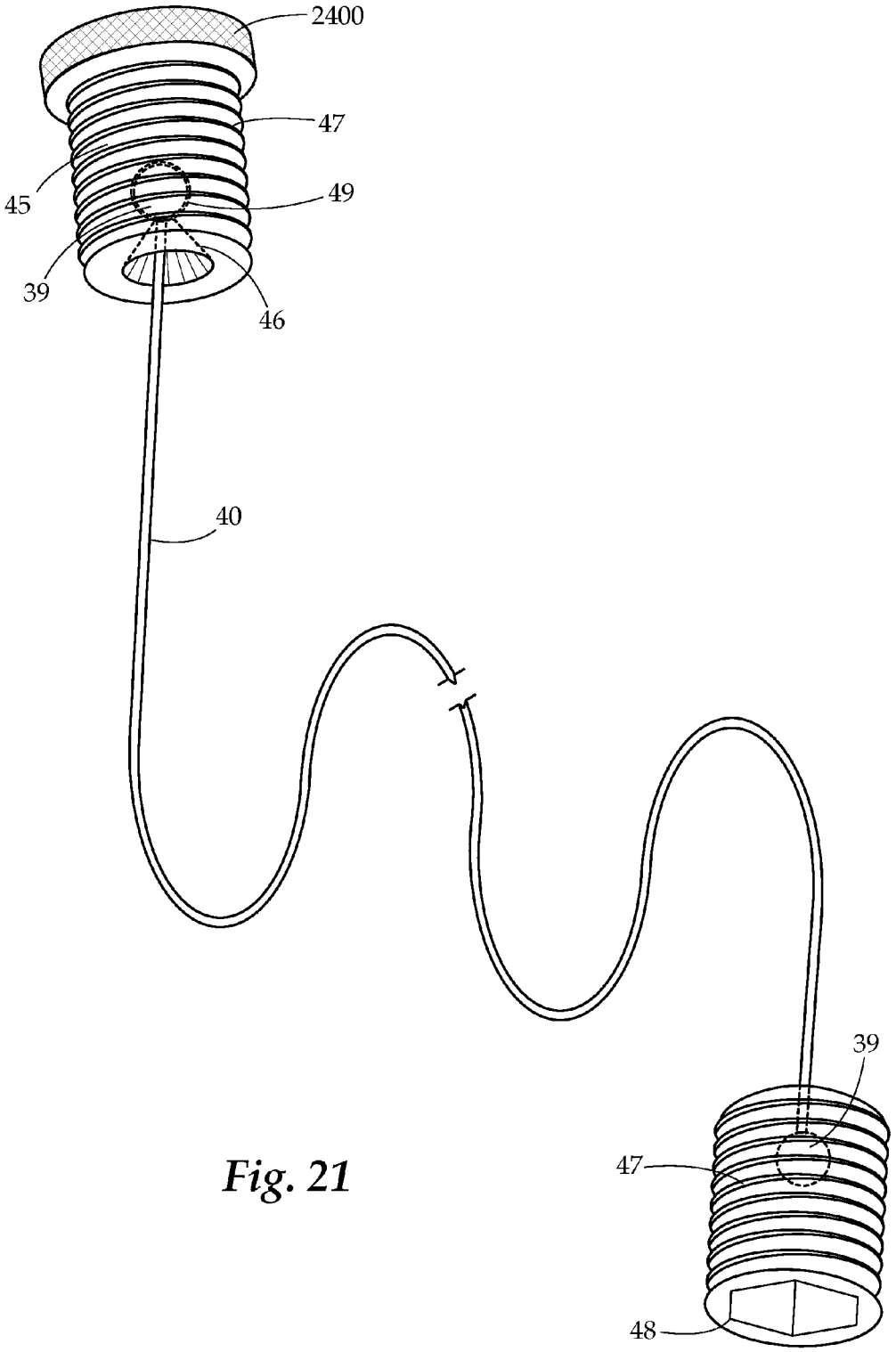
FIG. 21—Illustrates a double string-ended locking string-ended system with both a rotating knurled locking string in conjunction with non-rotating hex headed locking string designs.

A double string-ended locking system with both a rotating knurled locking string and a rotating hex-headed locking string is shown by FIG. 19. FIG. 20 on the other hand shows a non-rotating string design of a double string-ended locking system with a knurled ended 45 string and a spherical ended 39 string. Whereas, a rotating knurled locking system and a non-rotating hex-headed locking string is depicted in FIG. 21.

Figure 22:
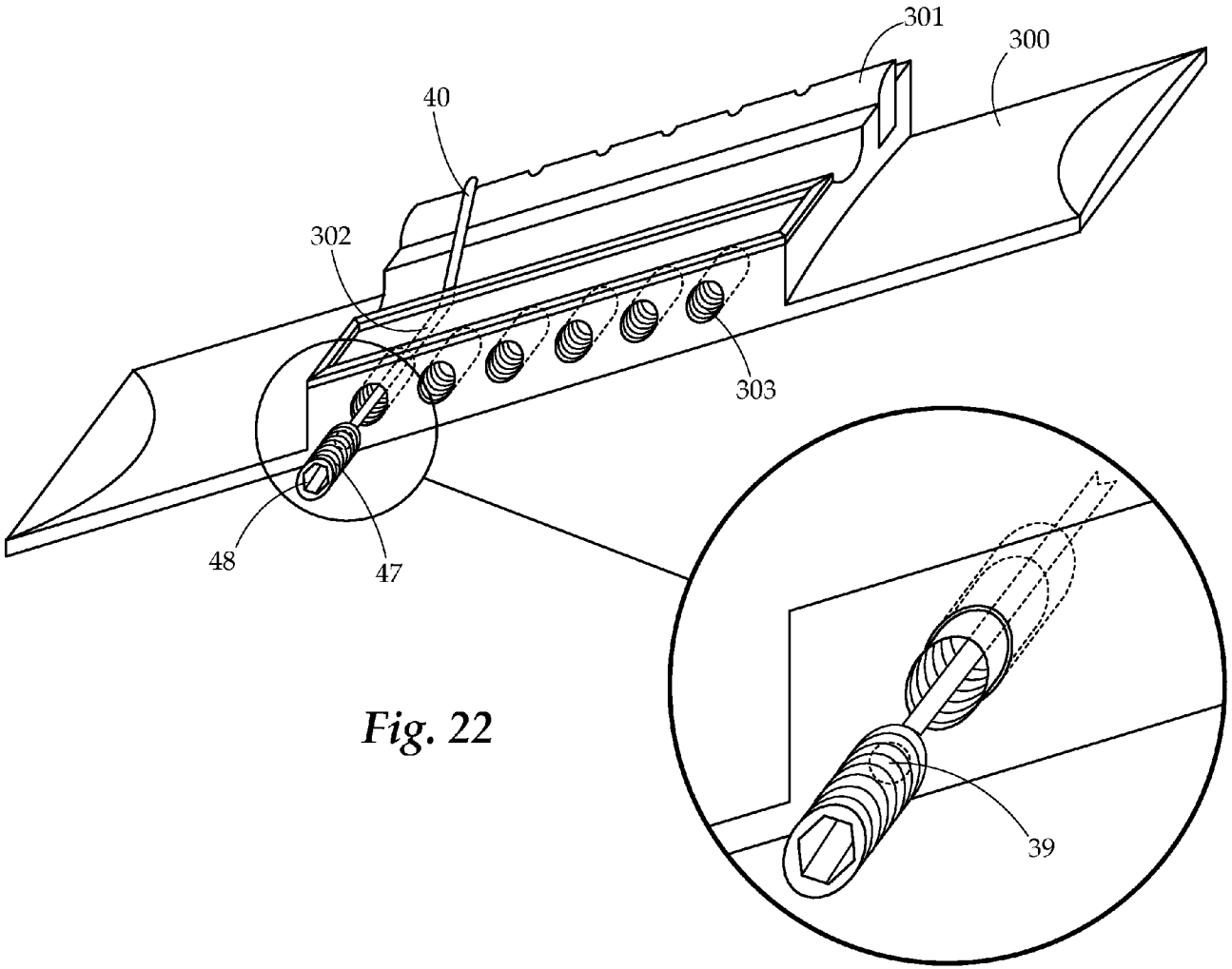
FIG. 22—Illustrates a classical or steel string acoustic guitar bridge.
Figure 23:
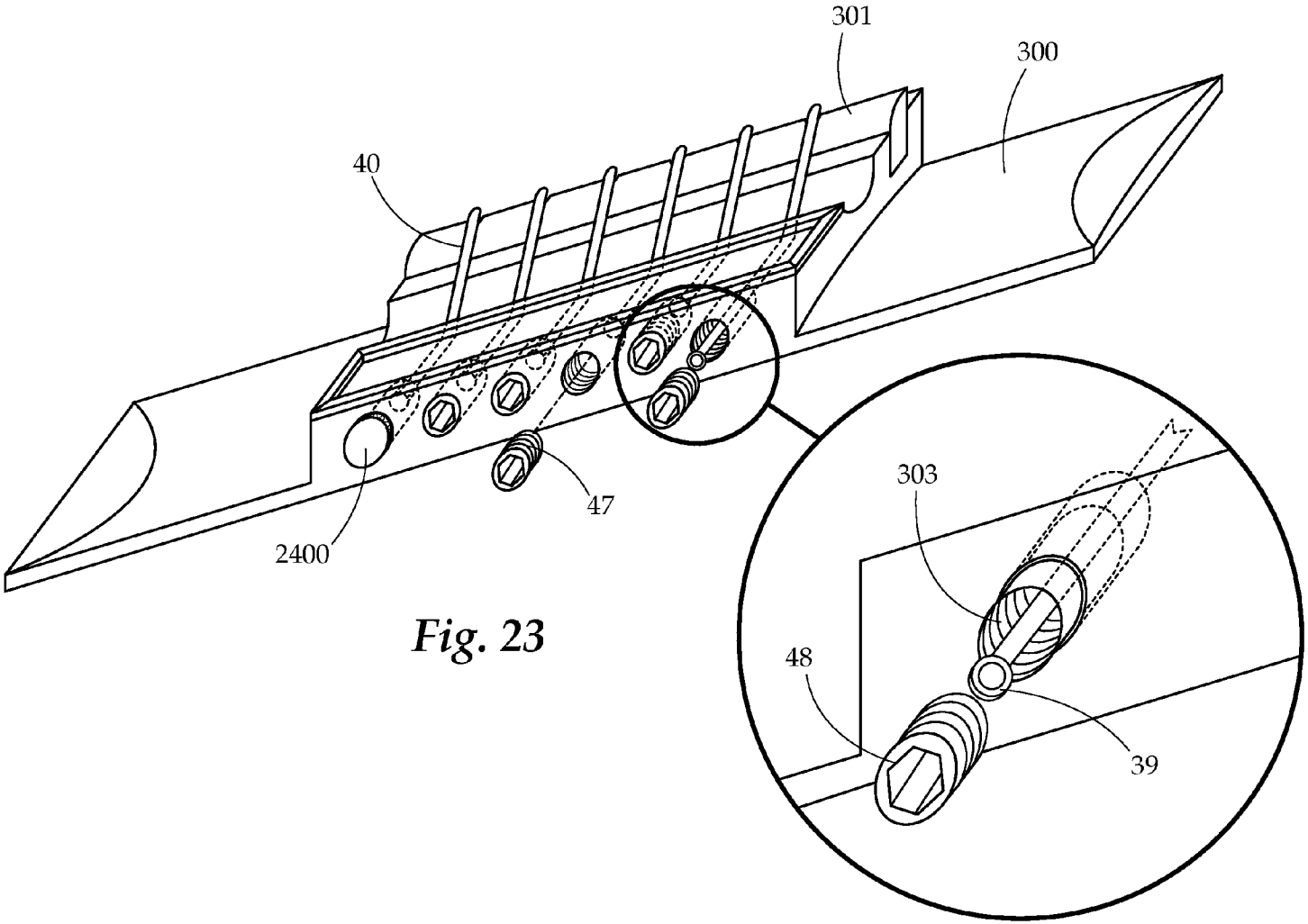
FIG. 23—Illustrates a classical or steel string acoustic guitar bridge. Both a threaded locking mechanism and a knurled ended locking string are shown.

FIG. 22 illustrates a classical or steel string acoustic guitar bridge 300. The bridge can be made out of wood, steel, titanium, composite material or combination thereof. The string chambers 303 are threaded to receive a threaded insert 47. The insert is then screwed into the bridge 300. The threaded locking string 40 is then screwed into the string chamber 303 and is mechanically secured via Allen wrench. The string 40 exits at the bottom of the threaded area of the string-end 302. Likewise in FIG. 23, a classical or steel string acoustic guitar bridge. The bridge can be made out of wood, steel, titanium, composite material or combination thereof. The string chambers are threaded to receive a threaded insert. The insert is then screwed into the bridge. Further, a threaded locking mechanism or pin secures a conventional ball ended string 39 into a threaded chamber 303. The locking mechanism or pin is mechanically secured via an Allen wrench. The string exits at the bottom of the threaded area of the string-end. Alternate version illustrated: a knurled ended locking string that can be secured into the guitar bridge by hand, therefore a wrench is not required. The string exits at the bottom of the threaded area of the string-end.

Figure 24:
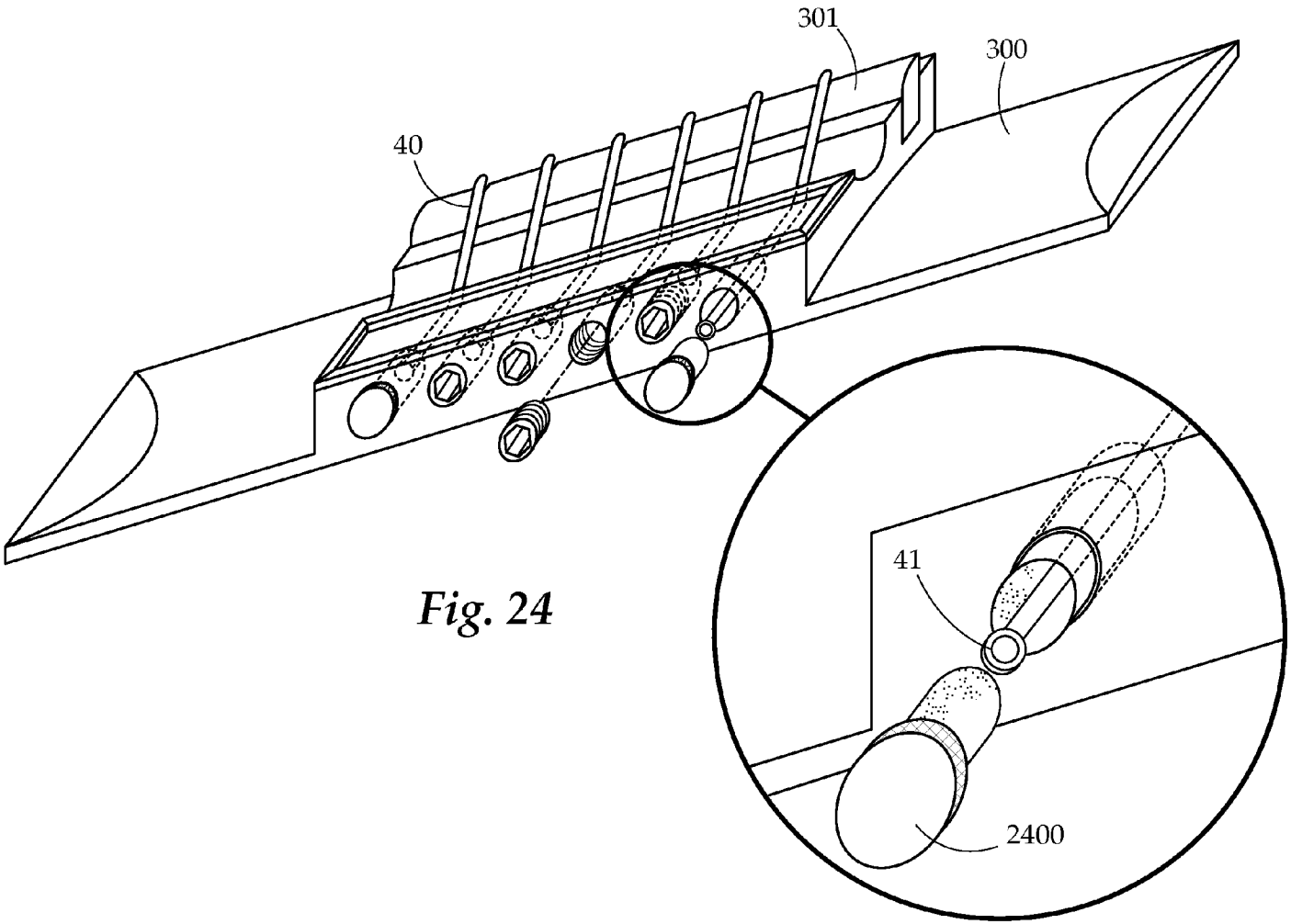
FIG. 24—Illustrates a classical or steel string acoustic guitar bridge. Both a magnetic knurled locking mechanism and a hex-headed locking string are shown.

FIG. 24 again is showing a classical or steel string acoustic guitar bridge. The bridge can be made out of wood, steel, titanium, composite material or combination thereof. The bridge's string chambers are threaded to receive a threaded insert. The insert is then screwed into the bridge insert or chamber. Further illustrated a magnetic knurled locking mechanism 2400 or pin is shown locking a conventional ball end of a string 41. The metal insert of the string is non-threaded and affixed to the guitar bridge chamber. The string exits at the bottom of the treaded area of the string-end. The string is then inserted into the bridge followed by the magnetic knurled locking mechanism or pin. In alternate version illustrated is hex-headed 48 threaded locking string being secured into the threaded bridge insert or chamber. The string exits at the bottom of the threaded area of the string-end. In alternate version illustrated is a knurled-headed threaded locking string secured into the threaded bridge insert or chamber. The string exits at the bottom of the threaded area of the string-end.

Figure 26:
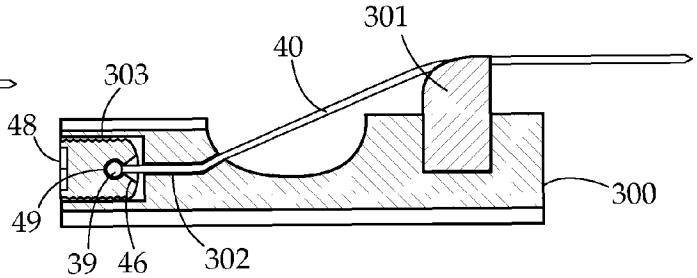
FIG. 26—Illustrated is the FIG. 25, a cutaway version of a classical or steel string acoustic guitar assembly with all the components.
Figure 25:
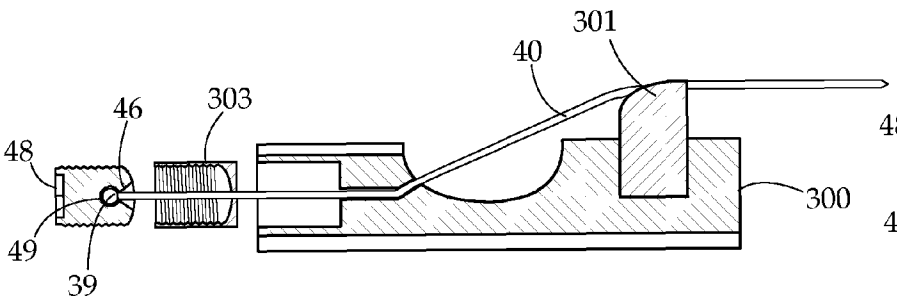
FIG. 25—Illustrated is a cutaway version of a classical or steel string acoustic guitar with a rotating hex-headed locking string and a threaded metal insert or string chamber.
Figure 28:
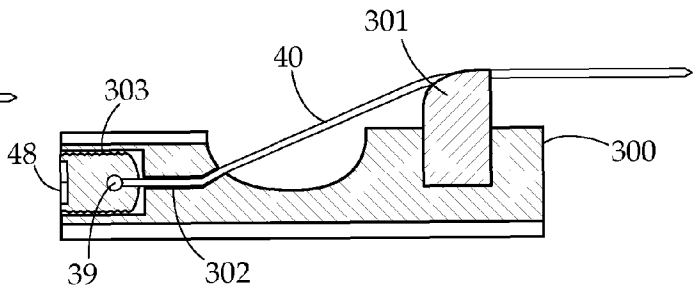
FIG. 28—Illustrated is the FIG. 27, a cutaway version of a classical or steel string acoustic guitar assembly with all the components assembled.
Figure 27:
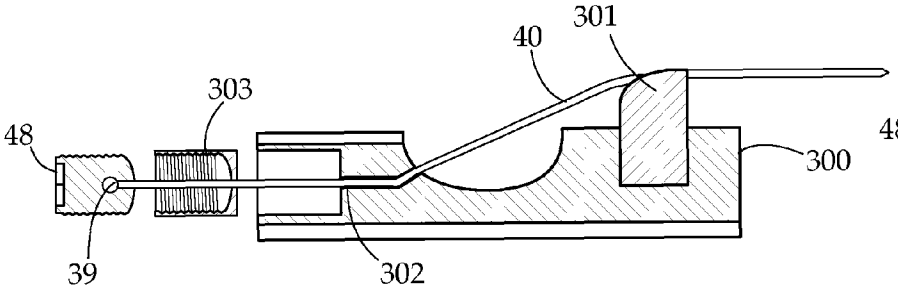
FIG. 27—Illustrated is a cutaway version of a classical or steel string acoustic guitar with a non-rotating hex-headed locking string and a threaded metal insert or string chamber.
Figure 29:
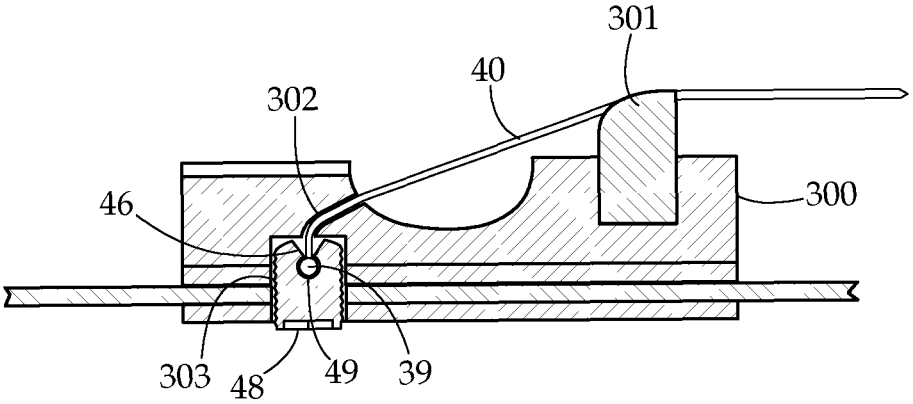
FIG. 29—Illustrated is the FIG. 30, a cutaway version of a classical or steel string acoustic guitar assembly with all the components.
Figure 30:
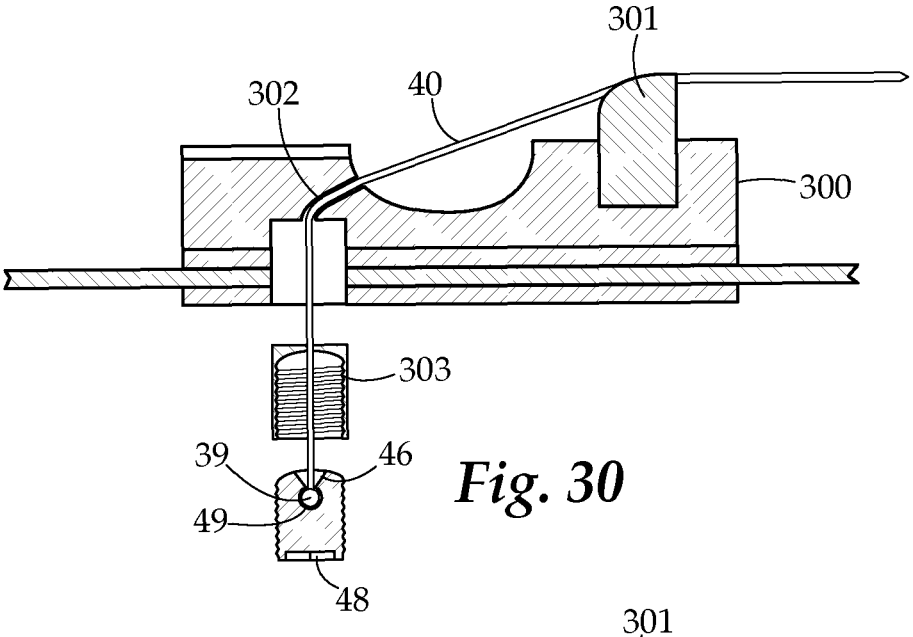
FIG. 30—Illustrated is a cutaway version of a classical or steel string acoustic guitar with a rotating hex-headed locking string and a threaded metal insert or string chamber.

A cutaway version of a classical or steel string acoustic guitar bridge 300 is presented in FIG. 25. The threaded chamber 303 is at the rear edge of the bridge system. Illustrated is a rotating hex-headed 48 locking string and a threaded metal insert or string chamber. The string 40 exits at the bottom of the treaded area 302 of the string-end. The string goes through the rear of the bridge and over the bridge saddle 301. FIG. 26 shows the FIG. 25 assembly with all of the components assembled. Similar to FIG. 25, FIG. 27 is a cutaway version of a classical or steel string acoustic guitar. The threaded chamber is at the rear edge of the bridge system. Illustrated is a non-rotating hex-headed locking string and a threaded metal insert or string chamber. The string exits at the bottom of the threaded area of the string-end. The string goes through the rear of the bridge and over the bridge saddle. FIG. 28 shows the FIG. 27 assembly with all of the components assembled. The same is true for FIG. 29 which shows FIG. 30's assembly with all of the components assembled. FIG. 30 illustrates a cutaway version of a classical or steel string acoustic guitar. The threaded chamber is at the bottom of the bridge system. Illustrated is a rotating hex-headed locking string and a threaded metal insert or string chamber. The string exits at the bottom of the threaded area of the string-end. The string goes through the guitar's top or sound board, through the bridge and over the bridge saddle.

Figure 31:
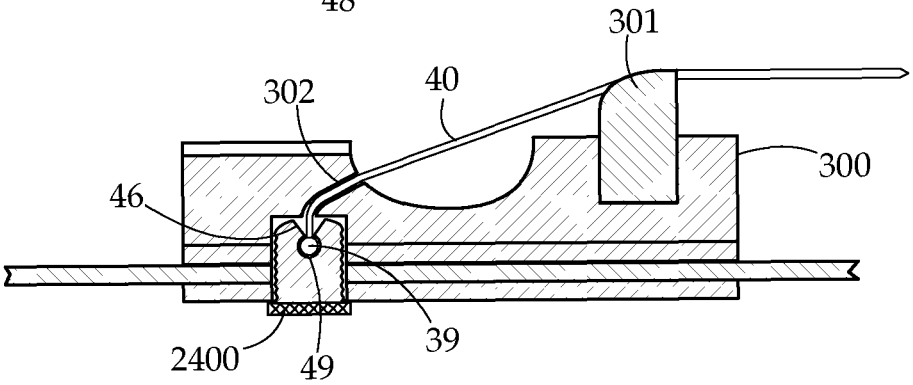
FIG. 31—Illustrated is a cutaway version of a classical or steel string acoustic guitar with a rotating, knurled locking string and a threaded metal insert or string chamber.

A knurled locking string is shown in a cutaway version of a classical or steel string acoustic guitar for FIG. 31. The threaded chamber is at the bottom of the bridge system. Illustrated is a rotating, knurled locking string and a threaded metal insert or string chamber. The string exits at the bottom of the threaded area of the string-end. The string goes through the guitar's top or sound board, through the bridge and over the bridge saddle.

Figure 32:
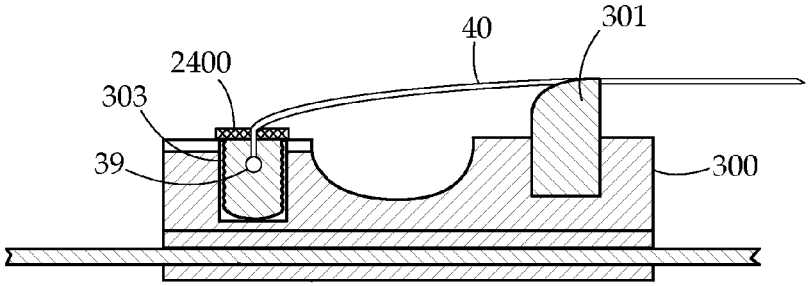
FIG. 32—Illustrated is a cutaway version of a classical or steel string acoustic guitar with a rotating locking string and a threaded metal insert or string chamber.
Figure 33:
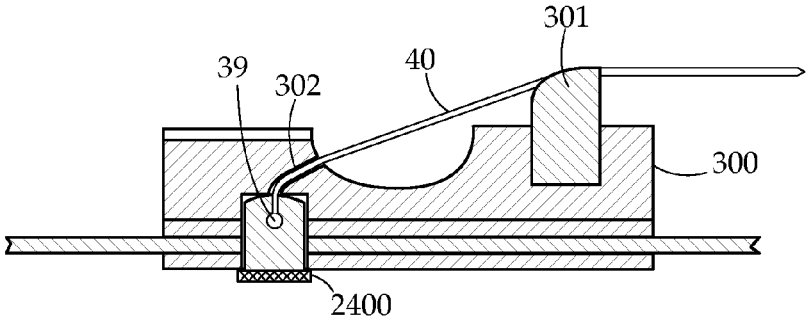
FIG. 33—Illustrated is a cutaway version of a classical or steel string acoustic guitar with a rotating, knurled locking magnetic string and a smooth magnetic metal insert or string chamber.
Figure 34:
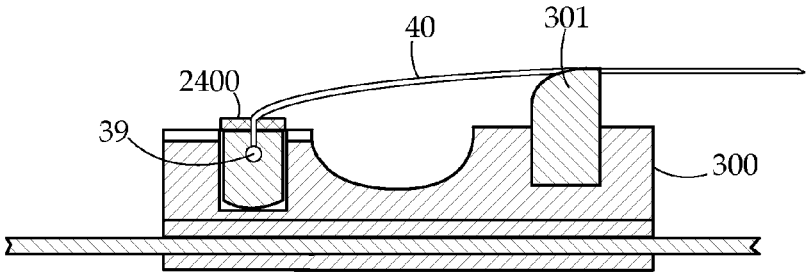
FIG. 34—Illustrated is a cutaway version of a classical or steel string acoustic guitar with a non-rotating locking string and a threaded metal insert or string chamber.
Figure 35:
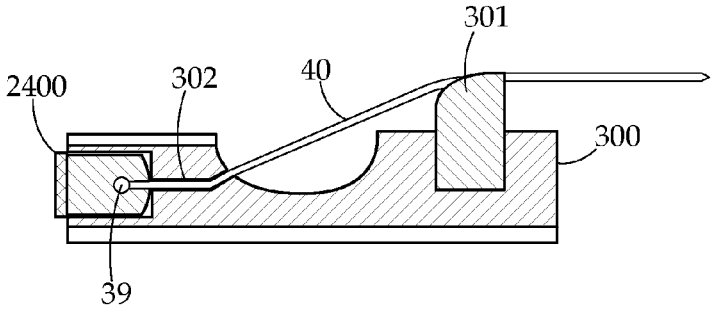
FIG. 35—Illustrated is a cutaway version of a classical or steel string acoustic guitar with a magnetic knurl ended locking string and a magnetic metal insert or string chamber.

FIG. 32 has a rotating locking string illustrated in a cutaway version of a classical or steel string acoustic guitar. The threaded chamber is at the top of the bridge system. Demonstrated is a rotating locking string and a threaded metal insert or string chamber. The string exits at the knurled string-end and over and over the bridge saddle. Whereas in FIG. 33 illustrates a cutaway version of a classical or steel string acoustic guitar with a magnetic string. The threaded chamber is at the bottom of the bridge system. Illustrated is a rotating, knurled locking magnetic string and a smooth magnetic metal insert or string chamber. The string exits at the bottom of the magnetic area of the string-end. The string goes through the guitar's top or sound board, through the bridge and over the bridge saddle. Then in FIG. 34 a non-rotating string is shown in this same cutaway version of a classical or steel string acoustic guitar. The threaded chamber is at the top of the bridge system. Illustrated is a non-rotating locking string and a threaded metal insert or string chamber. The string exits at the knurled string-end and over and over the bridge saddle. Similar to FIG. 33, FIG. 35 is of a cutaway version of a classical or steel string acoustic guitar. The threaded chamber is at the rear edge of the bridge system. Illustrated is a magnetic knurl ended locking string and a magnetic metal insert or string chamber. The string exits at the bottom of the magnetic area of the string-end. The string goes through the rear of the bridge and over the bridge saddle.

Figure 36:
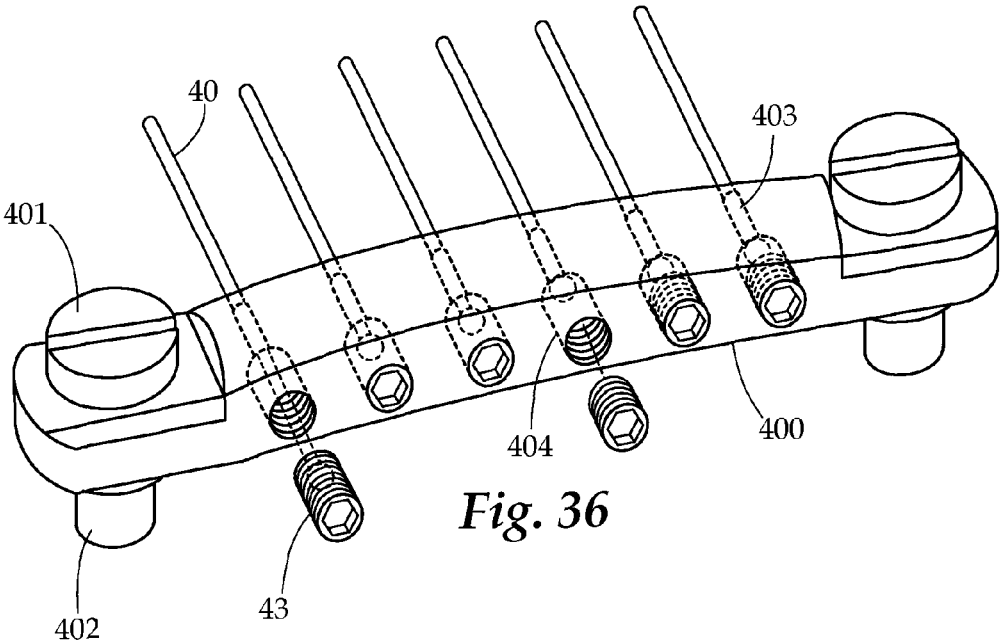
FIG. 36—Illustrated is Stop Tailpiece for Gibson® style musical stringed instruments. Both a conventional ball ended string and a hex-headed locking threaded string are shown.

A Stop Tailpiece for Gibson® style musical stringed instruments is displayed in FIG. 36. The metal bridge 400 is comprised of (2) specially designed Stop Tailpiece threaded post 402 and threaded inserts that are designed to receive the tailpiece system. The threaded bridge posts have a smaller cylindrical area within the post to be able to receive the stop tailpiece bridge system. The (2) "U" shaped ends are pressure fitted to the stop tailpiece 402 by string tension. The top of the tailpiece 401 is convex in shape. One illustration shows a conventional ball ended string inside the string chamber 404. A hex-head threaded metal fastener 43 is secured into the tailpiece's threaded metal string chamber 403 with an Allen wrench. The string is then mechanically secured to the bridge system. An alternative illustration shows a hex-headed locking threaded string being secured into the stop tailpiece's threaded string chamber. An Allen wrench is required to secure this string-end to the tailpiece.

Figure 37:
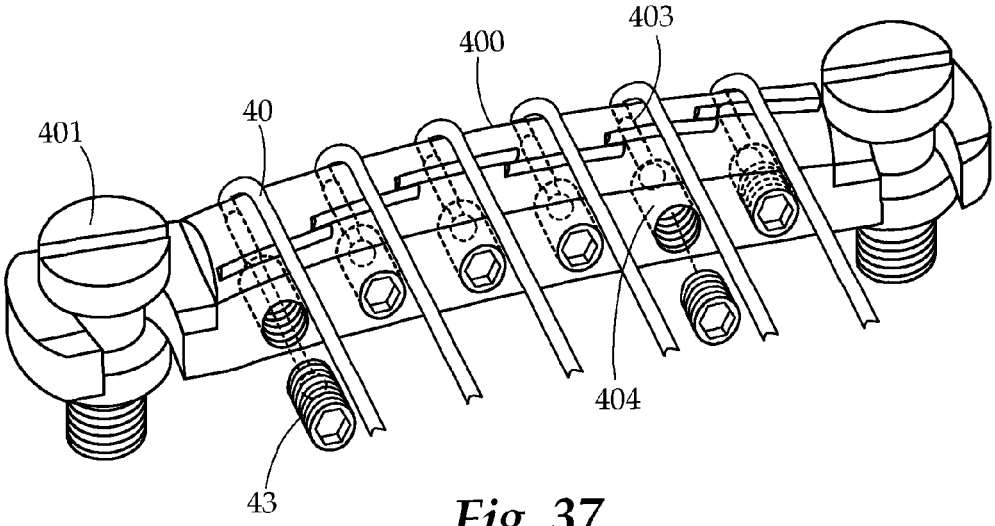
FIG. 37—Illustrated is Gibson® style Wrap-A-Round bridge system. Both a conventional ball ended string and a hex-headed locking threaded string are shown.

In FIG. 37 it is a Gibson® style Wrap A Round bridge system with (6) integrated saddles to compensate for string intonation that is being shown. The metal bridge 400 is comprised of (2) specially designed Stop Tailpiece threaded posts and threaded inserts that are designed to receive the tailpiece system. The threaded bridge posts have a smaller cylindrical area within the post in order to be able to receive the stop tailpiece bridge system. The (2) "U" shaped ends are pressure fitted to the stop tailpiece by string tension. The top of the tailpiece 401 is convex in shape. The saddles are integrated onto the top of the bridge system. The string 40 enters the chambers 404 and wraps around the bridge 400, onto the saddles and is then affixed to tuning machines. One illustration shows a conventional ball ended string inside the string chamber. A hex-head designed threaded metal fastener is secured into the tailpiece's threaded metal string chamber with an Allen wrench. The string is then mechanically secured to the bridge system.

Figure 38:
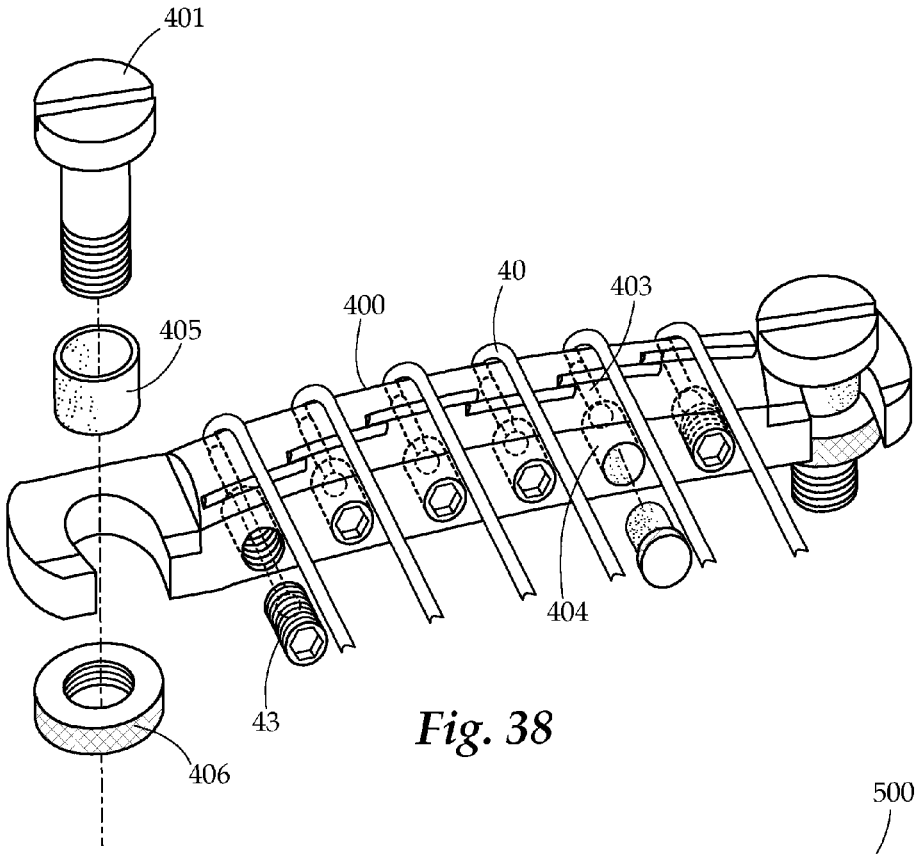
FIG. 38—Illustrated is Gibson® style Wrap-A-Round Bridge and Tailpiece System. Both a conventional ball ended string and a hex-headed locking threaded string are shown.

In an alternative illustration shows a hex-headed locking threaded string being secured into the stop tailpiece's threaded string chamber. An Allen wrench is required to secure this string-end to the tailpiece As in FIG. 37, FIG. 38 reveals Gibson® style Wrap-A-Round Bridge and Tailpiece System with (6) integrated saddles to compensate for string intonation. The metal bridge 400 is comprised of (2) specially designed Stop Tailpiece threaded posts with magnetic inserts 405 and threaded inserts that are designed to receive the tailpiece system. The threaded bridge posts have a smaller cylindrical area within the post in order to be able to receive the stop tailpiece bridge system. The magnetic inserts are placed onto the smaller cylindrical area. A knurled nut 406 is screwed onto the lower part of the threaded post which secures the magnetic posts to the bridge system. The Wrap-A-Round Bridge and Tailpiece System utilizes the magnetic inserts to magnetically secure the (2) "U" shaped ends of the tailpiece. The top of the tailpiece 401 is convex in shape. The saddles are integrated onto the top of the bridge system. The string enters the chambers and wraps around the bridge, onto the saddles and then is affixed to tuning machines.

Figure 39:
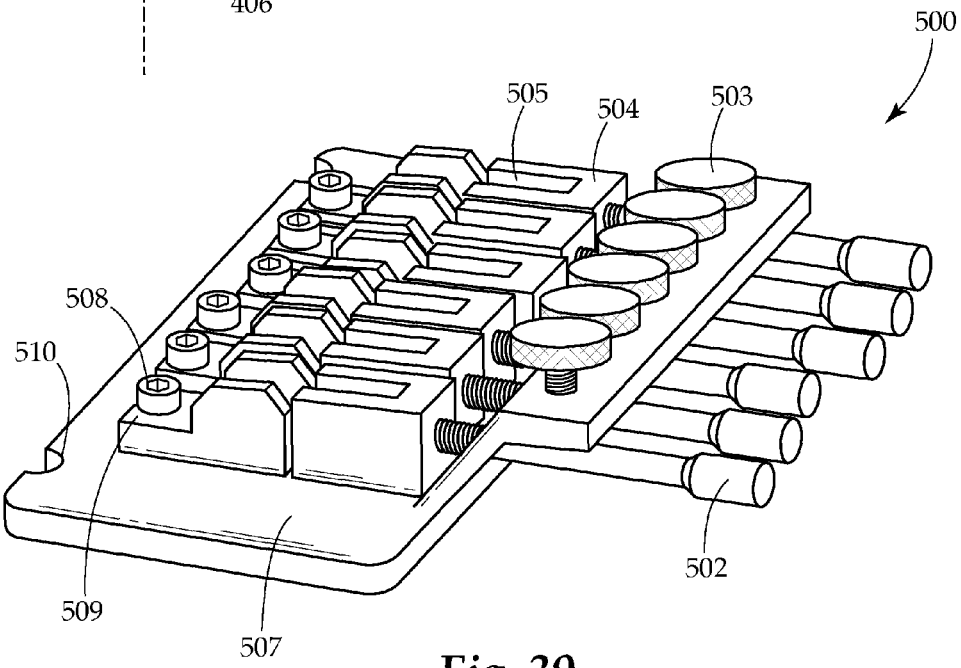
FIG. 39—Illustrated is the profile of the Floyd Rose® style locking tremolo system.

In one illustration shows a conventional ball ended string inside the string chamber. A magnetic knurled designed ended locking string is then placed into the tailpiece's elongated non-threaded metal string chamber. The string is then magnetically locked into the combination bridge and tailpiece system. Mechanically locking the string is not required. An alternative illustration shows a hex-headed locking threaded string being secured into the stop tailpiece's threaded string chamber. An Allen wrench is required to secure this string-end to the tailpiece The profile of the Floyd Rose® style locking tremolo system 500 is shown by FIG. 39. This system was modified to use (6) elongated string chambers 504 with integrated cylindrical shaped ends 502 that are threaded to receive a locking threaded fastener or pin, as well as the locking musical string-end system 503 located on the guitar bridge 507. The cylindrical string chambers can be threaded to receive the threaded locking fastener, locking pin, or locking threaded string. The cylindrical chambers can be designed to be non-threaded, thereby allowing a magnetic locking string to secure the musical string within the chamber. The musical string enters the cylindrical string chamber then travels down the elongated string chamber 505 and over the bridge saddle 509. The string is then affixed to tuning machines 510, and later secured by the Floyd Rose® style locking nut system 508.

Figure 40:
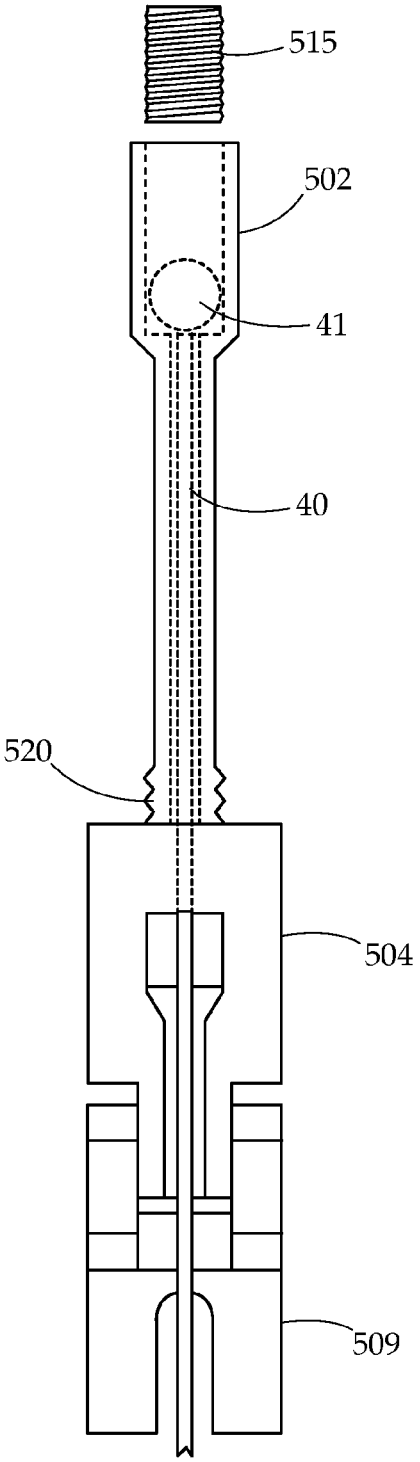
FIG. 40—Illustrated is the profile of an elongated string chamber with an integrated cylindrical end that is threaded to receive a threaded locking fastener or pin which secures the musical string within the threaded chamber.
Figure 41:
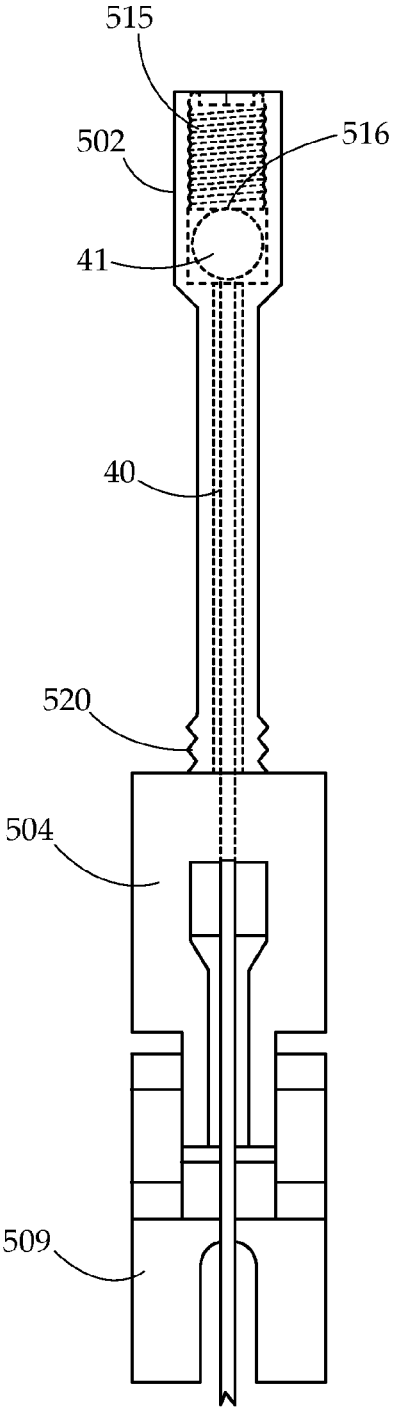
FIG. 41—Same as 40. In this profile the ball end of the musical string is locked inside of the cylindrical chamber by the threaded locking fastener or pin.
Figure 42:
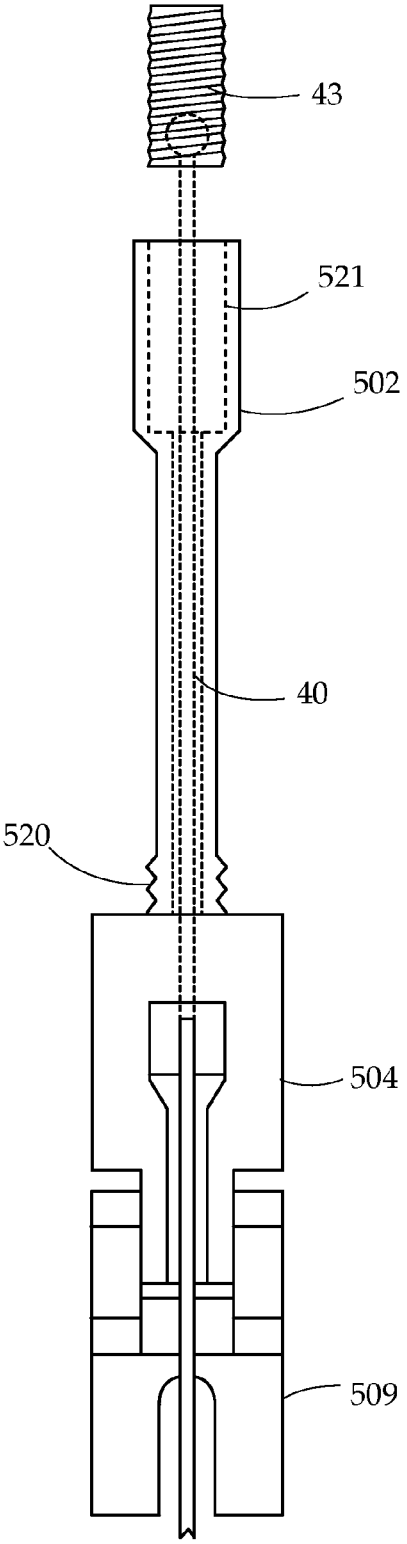
FIG. 42—Illustrated is the profile of an elongated string chamber with integrated cylindrical end that is threaded to receive the threaded hex-head style locking musical string system.
Figure 43:
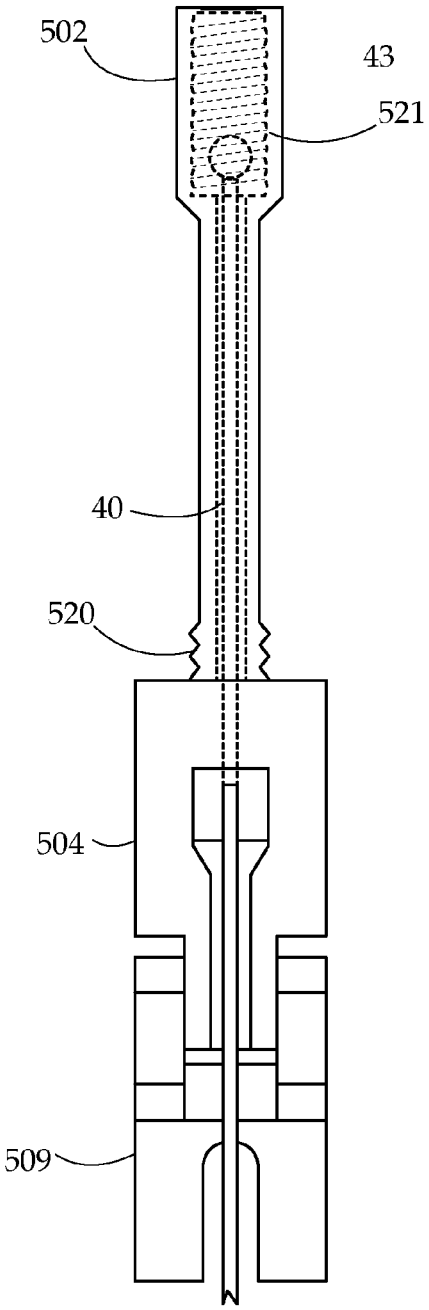
FIG. 43—Same as 42. In this profile the hex-head style locking musical string system is locked inside of the cylindrical string chamber.

FIG. 40 illustrates the profile of an elongated string chamber with integrated cylindrical end that is threaded to receive a threaded locking fastener or pin to secure the musical string within the threaded chamber. Once the conventional ball end of the musical string enters the chamber, a threaded locking device or pin is threaded into the chamber. An Allen wrench is used to secure to mechanically lock the musical string. As in FIG. 40, FIG. 41 is a profile of an elongated string chamber 504, but in this profile the ball end of the musical string 41 is locked inside of the cylindrical chamber 502 by the threaded locking fastener or pin 516. Likewise FIG. 42 illustrates the profile of an elongated string chamber with integrated cylindrical end, but it is threaded 521 to receive the threaded hex-head style locking musical string system 43. The threaded musical string 40 enters the chamber and it is secured by an Allen wrench, which mechanically locks the musical string. As in FIG. 42, FIG. 43 is a profile of an elongated string chamber, but in this profile the hex-head style locking musical string system 43 is locked inside of the cylindrical string chamber 502.

Figure 44:
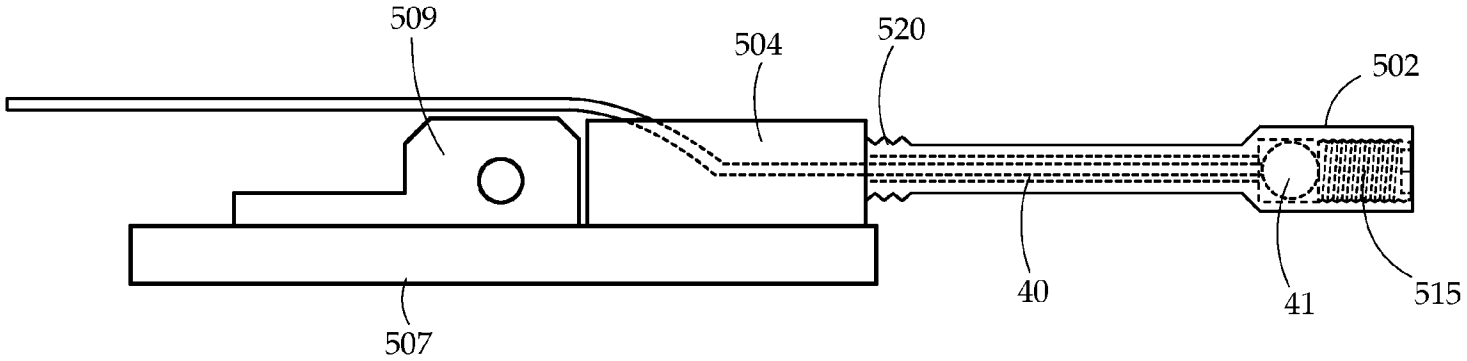
FIG. 44—Illustrated is a side view of FIG. 40.

FIG. 44 illustrates a side view of FIG. 40. It is the profile of an elongated string chamber with integrated cylindrical end that is threaded to receive a threaded locking fastener or pin to secure the musical string within the threaded chamber. Once the conventional ball end 41 of the musical string enters the chamber 502, a threaded locking device or pin is threaded into the chamber 515. An Allen wrench is used to secure and mechanically lock the musical string. The remaining portion of the string travels through the elongated string chamber 504 and over the bridge saddle 509 to the tuning machines. The string is then secured by the locking nut 508.

Figure 45:
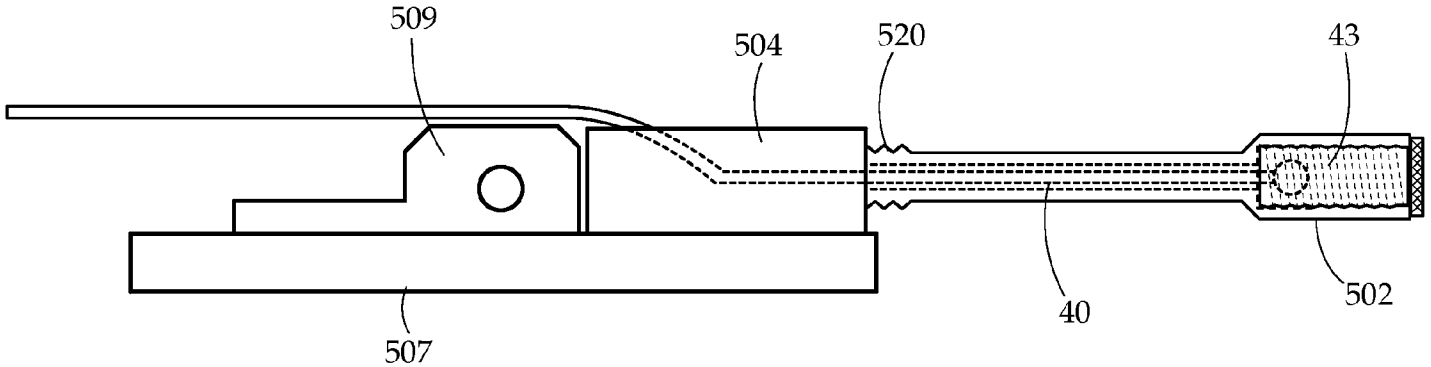
FIG. 45—Illustrated is the side profile of an elongated string chamber with integrated cylindrical end that is threaded to receive the threaded knurled style locking musical string system.
Figure 46:
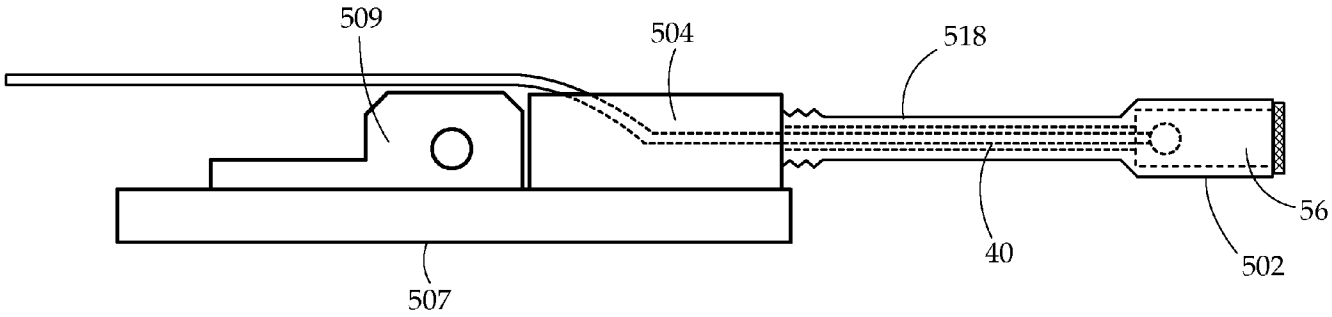
FIG. 46—Illustrated is the side profile of FIG. 45.

Again in FIG. 45 the side profile of an elongated string chamber with integrated cylindrical 502 is shown but this time it is threaded to receive the threaded knurled style locking musical string system 43. The threaded musical string enters the chamber and it is secured by hand, which mechanically locks the musical string. The remaining portion of the string travels through the elongated string chamber 504 and over the bridge saddle 509 to the tuning machines. The string is then secured by the locking nut 508. Also in FIG. 46 the side profile of an elongated string chamber 502 is shown but now with an integrated cylindrical end that is threaded to receive the magnetic knurled style locking musical string system 56. The threaded musical string enters the chamber and it is secured magnetically secured inside cylindrical end of this device. The remaining portion of the string travels through the elongated string chamber 504 and over the bridge saddle 509 to the tuning machines. The string is then secured by the locking nut.

Figure 48:
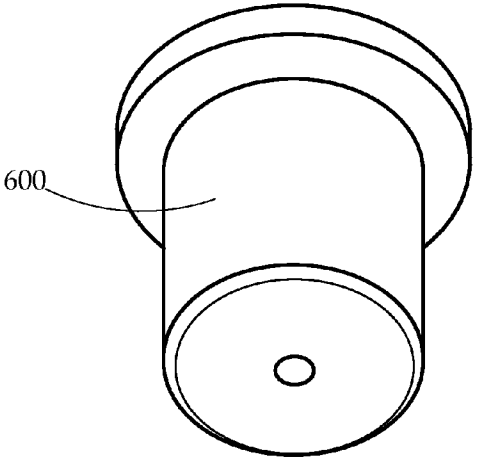
FIG. 48—Illustrated is a side view of an individual string ferrule.
Figure 47:
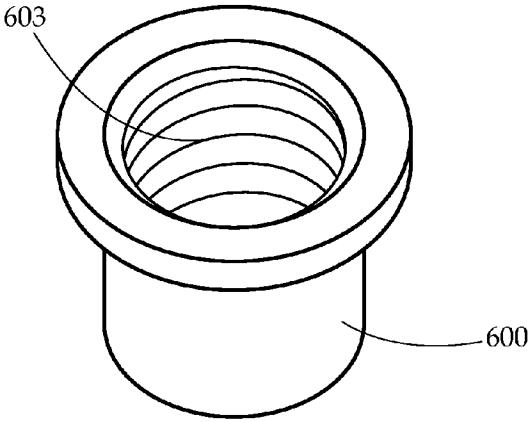
FIG. 47—Illustrated is a plan view of an individual string ferrule.
Figure 49:
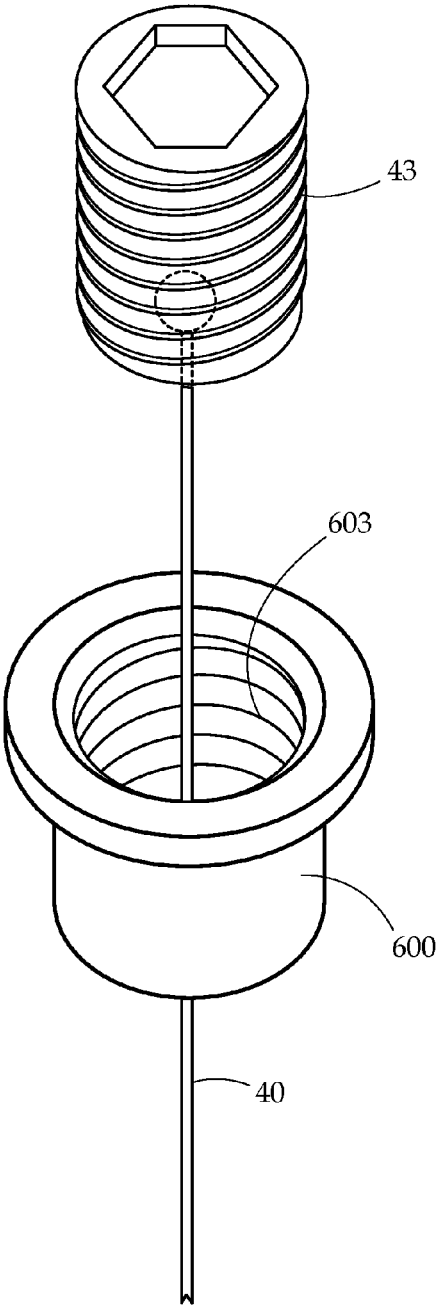
FIG. 49—Illustrated is a plan view of an individual string ferrule. A hex headed locking string-end is shown.

FIG. 47 is a top view of an individual string ferrule 600. A string ferrule is integrated into the body or structure of a musical instrument for the sole purpose of coupling with a musical string-end. In this figure the string ferrule is internally threaded 603 and the external portion is smooth in texture. A string ferrule is again shown by FIG. 48 but in a side view. A string ferrule is integrated into the body or structure of a musical instrument for the sole purpose of coupling with a musical string-end. In this figure the string ferrule the external portion is smooth in texture and a cylindrical string chamber is depicted. This string chamber allows the string to enter and exit the ferrule during the application and removal of them musical string. FIG. 49 adds a hex-headed locking string-end to a top view of a string ferrule 600. A string ferrule is integrated into the body or structure of a musical instrument for the sole purpose of coupling with a musical string-end. In this figure the string ferrule is internally threaded 603 and the external portion is smooth in texture. This string chamber allows the string 40 to enter and exit the ferrule during the application and removal of them musical string. A hex-headed locking string-end 48 is shown. The musical string is entering the string ferrule and out the cylindrical string chamber.

Figure 50:
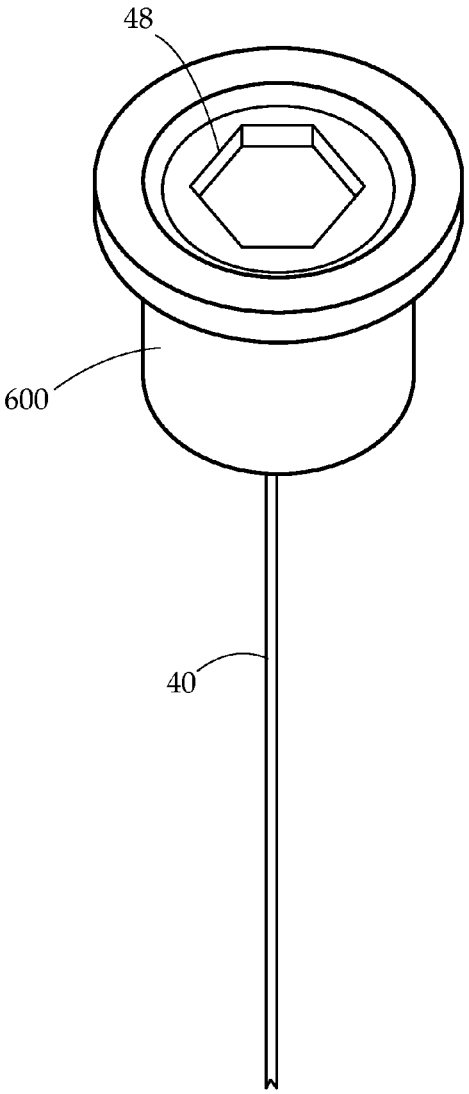
FIG. 50—Illustrated is a plan view of an individual string ferrule and locking string secured together.

In FIG. 50 an individual string ferrule 600 and locking string are secured together. An Allen wrench is required to mechanically secure the musical string 40 to the ferrule. A string ferrule is integrated into the body or structure of a musical instrument for the sole purpose of coupling with a musical string-end. In this figure the string ferrule is internally threaded and the external portion is smooth in texture. This string chamber allows the string to enter and exit the ferrule during the application and removal of them musical string. A hex-headed locking string-end 48 is shown. The musical string is entering the string ferrule and out the cylindrical string chamber.

Figure 51:
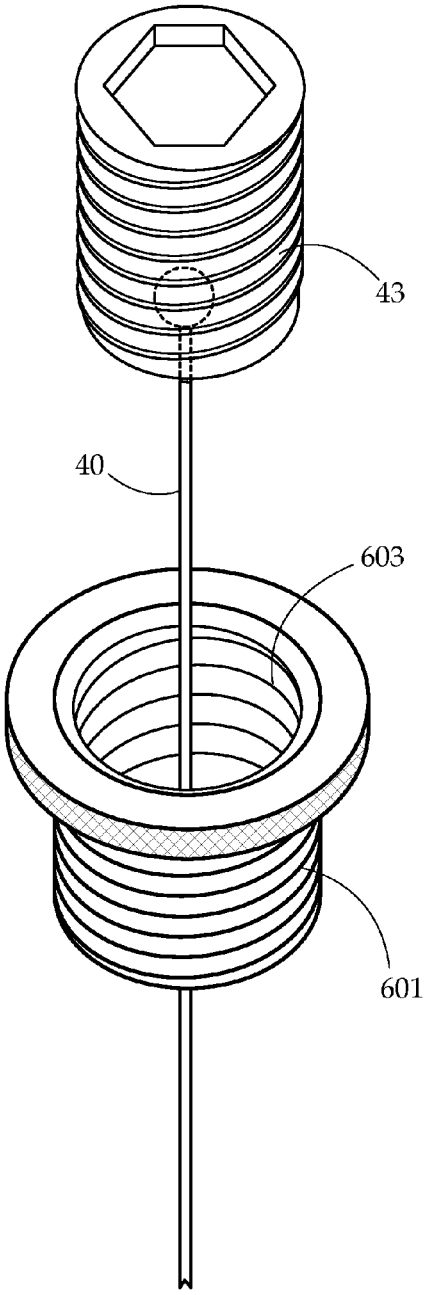
FIG. 51—Illustrated is a plan view of an individual string ferrule and locking string.

A top view of an individual string ferrule and locking string is again shown in FIG. 51, with the detail of a threaded string ferrule depicted. An Allen wrench is required to mechanically secure the locking musical string to the ferrule. A string ferrule is integrated into the body or structure of a musical instrument for the sole purpose of coupling with a musical string-end. In this figure the string ferrule is both internally and externally threaded 601, 603. The upper area of the string ferrule is knurled to assist the musician to mechanically lock the ferrule to the instrument itself. The instrument will have a threaded hole to receive this threaded style string ferrule. This string chamber allows the string to enter and exit the ferrule during the application and removal of the musical string. A threaded hex-head locking string-end is shown. The musical string 40 is entering the string ferrule and exiting out of the cylindrical string chamber.

Figure 52:
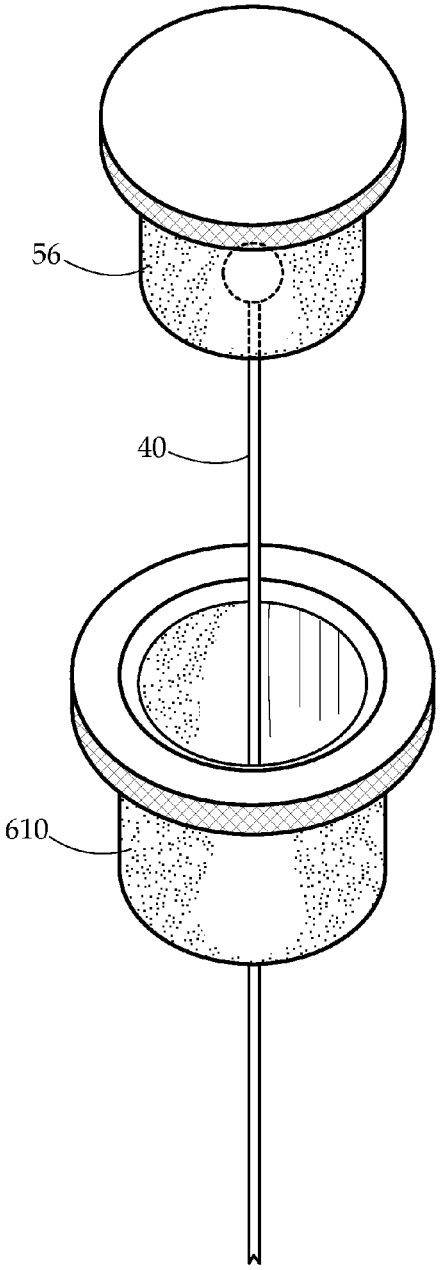
FIG. 52—Illustrated is a plan view of an individual magnetically charged string ferrule and magnetic locking string secured together.

An individual magnetically charged string ferrule and magnetic locking string are secured together in FIG. 52, a top view. An Allen wrench is required to mechanically secure the musical string to the ferrule. A string ferrule is integrated into the body or structure of a musical instrument for the sole purpose of coupling with a musical string-end. In this figure the string ferrule is smooth in texture internally and externally threaded 610. The upper area of the string ferrule is knurled to assist the musician to mechanically lock the ferrule to the instrument itself. The instrument will have a threaded hole to receive this threaded style string ferrule. This string chamber allows the string to enter and exit the ferrule during the application and removal of the musical string. A magnetic locking string-end 56 is shown. The musical string 40 is entering the string ferrule and exiting out of the cylindrical string chamber.

Figure 53:
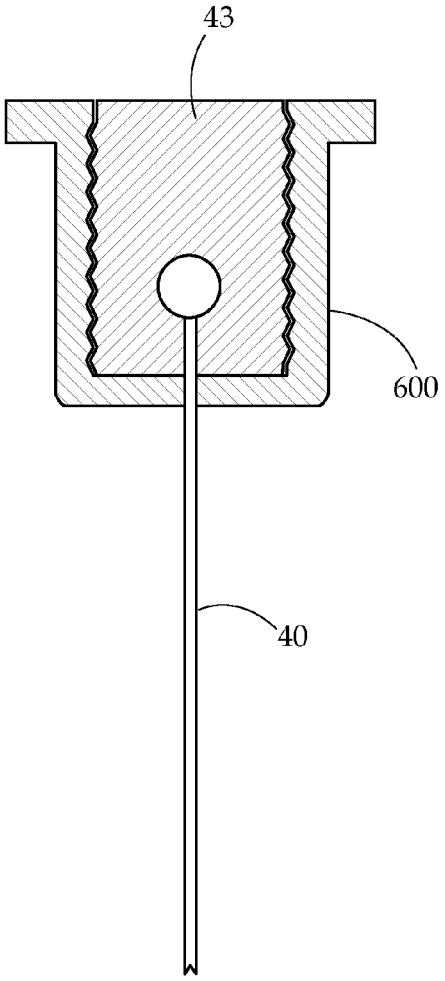
FIG. 53—This is the cutaway version of FIG. 50.
Figure 54:
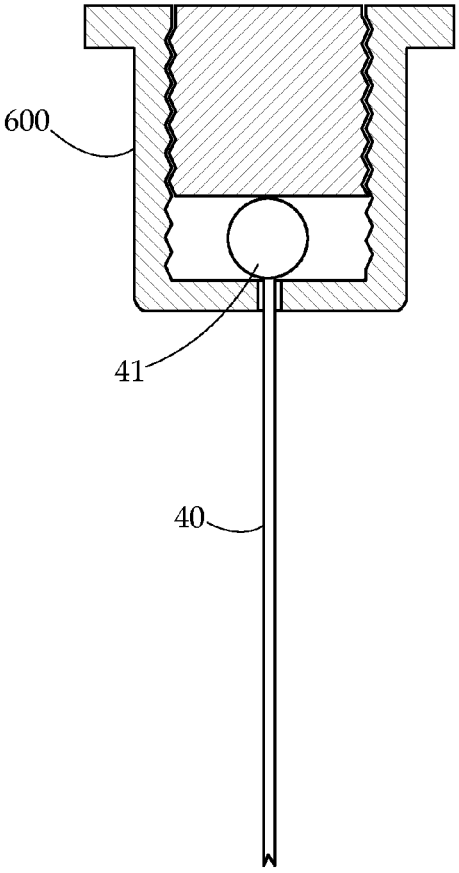
FIG. 54—This is the cutaway version of FIG. 50.

A cutaway version of FIG. 50 is illustrated in FIG. 53. An individual string ferrule and locking string are shown as secured together. An Allen wrench is required to mechanically secure the musical string to the ferrule. A string ferrule is integrated into the body or structure of a musical instrument for the sole purpose of coupling with a musical string-end. In this figure the string ferrule is internally threaded and the external portion is smooth in texture 600. This string chamber allows the string to enter and exit the ferrule during the application and removal of them musical string. A hex-headed locking string-end is shown. The musical string 40 is entering the string ferrule and exiting out of the cylindrical string chamber. Again FIG. 54 offers a cutaway perspective. Illustrated is an individual string ferrule and locking string secured together. An Allen wrench is required to mechanically secure the locking fastener or pin to the ball end of a musical string to the ferrule. A string ferrule is integrated into the body or structure of a musical instrument for the sole purpose of coupling with a musical string-end. In this figure the string ferrule is internally threaded and the external portion is smooth in texture. This string chamber allows the string to enter and exit the ferrule during the application and removal of them musical string. A hex-headed fastener and ball end of the musical string are shown. The musical string is entering the string ferrule and exiting out of the cylindrical string chamber.

Figure 55:
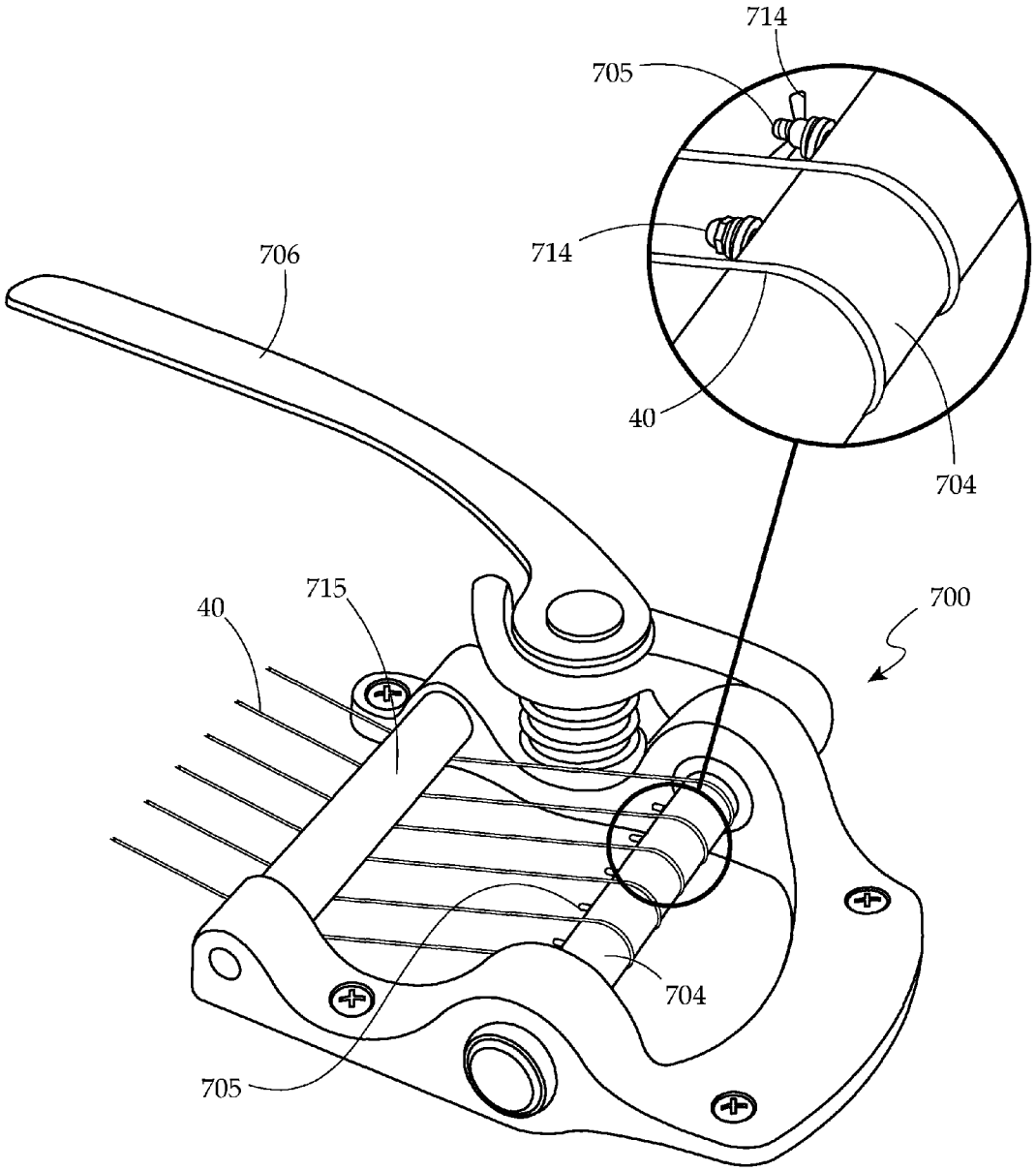
FIG. 55—Illustrated is a Bigsby® style tremolo system. A conventional ball ended string is mounted to the roller system.

A Bigsby® style tremolo system 700 is presented in FIG. 55. This vibrato system uses (2) rollers 715, 704 and bearing style devices within the assembly. The strings 40 attach to the external posts located on the Bigsby Tremolo. The rollers and bearing devices rotate when the tremolo arm is raised or depressed. The tremolo arm 706 utilizes a high tension compression spring that creates enough tension to counterbalance the string tension that is placed upon the tremolo system. Further illustrated is an image of a conventional ball ended string mounted to the roller system. The roller system has (6) threaded posts 705. The ball end of the string is placed upon the threaded post. A washer and a threaded acorn nut 714 or similar, is fastened upon the threaded post to secure the string by the inside of a ball end and string loop of a musical string. The string is thus mechanically locked on the roller bridge section of the tremolo unit. The strings are then looped under and over the rear roller, under the front roller to the tuning machines of the instrument.

Figure 56:
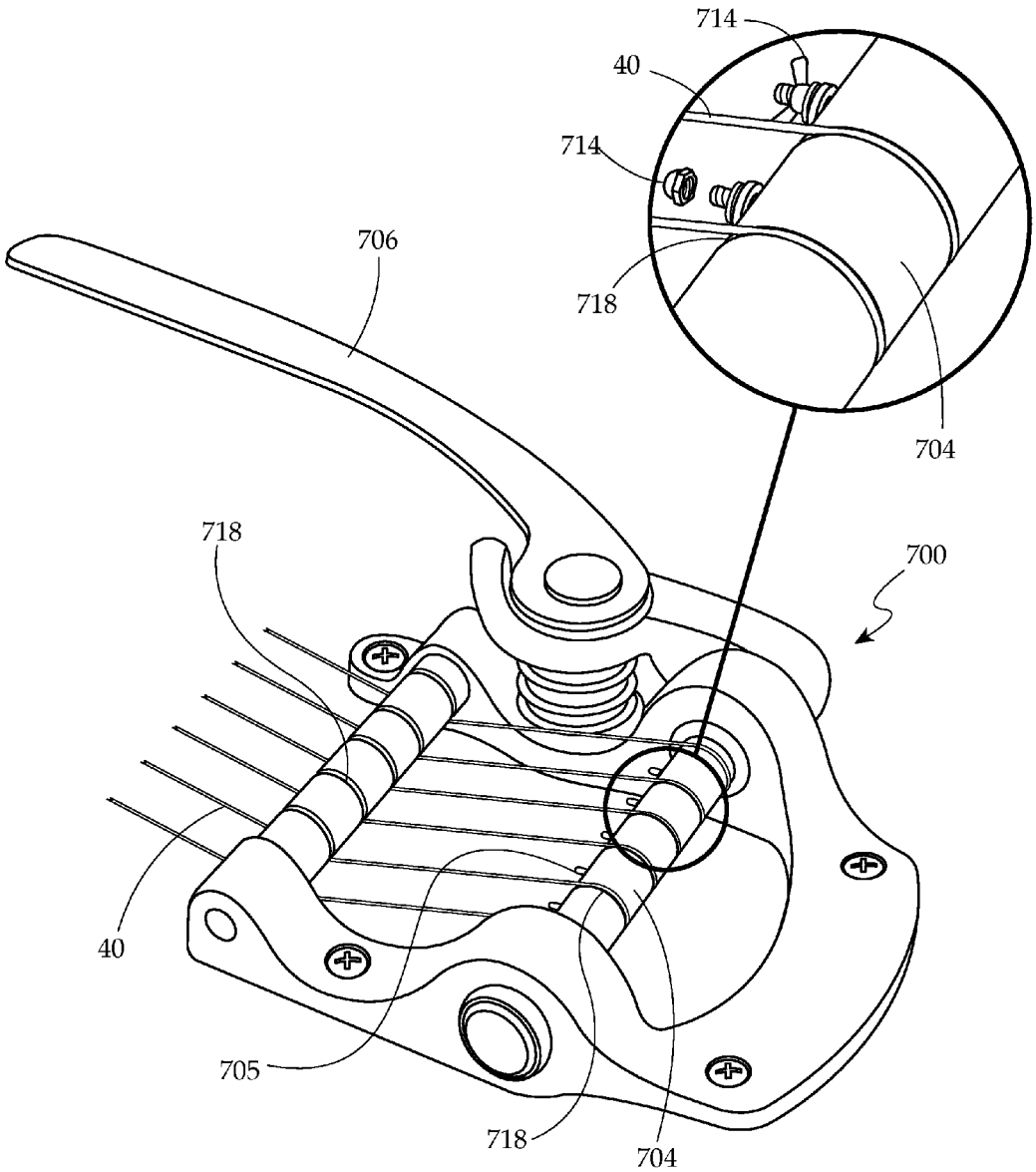
FIG. 56—Illustrated is a Bigsby® style tremolo system. A conventional ball ended string is mounted to the roller system.

Further illustrated in an image of a conventional ball ended string mounted to the roller system. The roller system has (6) threaded posts. The ball end of the string is placed upon the threaded post. A washer and a threaded wing nut or similar, is fastened upon the threaded post to secure the string by the inside of a ball end and string loop of a musical string. The string is mechanically locked on the roller bridge section of the tremolo unit. The strings are then looped under and over the rear roller, under the front roller to the tuning machines of the instrument. Again FIG. 56 is imagining a Bigsby® style tremolo system. This vibrato system uses (2) rollers, 715, 704, integrated channels 718 for each string, and bearing style devices within the assembly. The strings attach to the external posts located on the Bigsby® Tremolo. The rollers and bearing devices rotate when the tremolo arm 706 is raised or depressed. The tremolo arm utilizes a high tension compression spring that creates enough tension to counterbalance the string tension that is placed upon the tremolo system.

Illustrated in an image of a conventional ball ended string mounted to the roller system. The roller system has (6) threaded posts 705. The ball end of the string is placed upon the threaded post. A washer and a threaded acorn nut or similar, is fastened upon the threaded post to secure the string by the inside of a ball end and string loop of a musical string. The string is mechanically locked on the roller bridge section of the tremolo unit. The strings are then looped under and over the rear roller, under the front roller to the tuning machines of the instrument. The integrated individual string channels 718 within each roller eliminate side to side string movement which enhances tuning stability while the tremolo/vibrato is utilized.

Illustrated in an image of a conventional ball ended string mounted to the roller system. The roller system has (6) threaded posts. The ball end of the string is placed upon the threaded post. A washer and a threaded wing nut or similar, is fastened upon the threaded post to secure the string by the inside of a ball end and string loop of a musical string. The string is mechanically locked on the roller bridge section of the tremolo unit. The strings are then looped under and over the rear roller, under the front roller to the tuning machines of the instrument. The integrated individual string channels within each roller eliminate side to side string movement which enhances tuning stability while the tremolo/vibrato is utilized.

Continuing with the Bigsby® Style Tremolo System.

Figure 57:
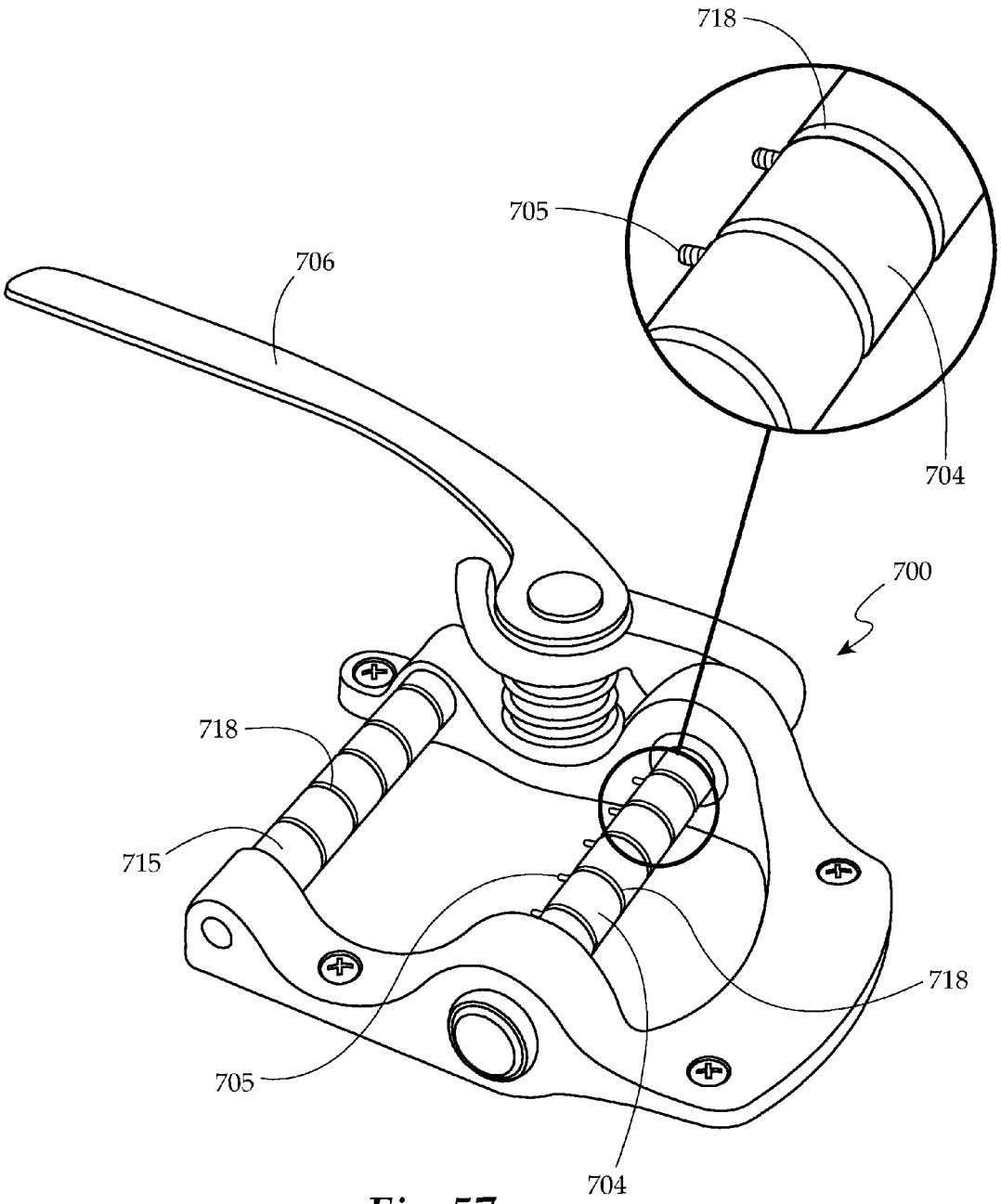
FIG. 57—Illustrated is a Bigsby® style tremolo system.

FIG. 57 has a vibrato system which uses (2) rollers 715, 704, integrated channels 718 for each string, and bearing style devices within the assembly. The strings attach to the external posts 705 located on the Bigsby Tremolo. The rollers and bearing devices rotate when the tremolo arm 706 is raised or depressed. The tremolo arm utilizes a high tension compression spring that creates enough tension to counterbalance the string tension that is placed upon the tremolo system. The roller system has (6) threaded posts 705. The integrated individual string channels 718 within each roller eliminate side to side string movement which enhances tuning stability while the tremolo/vibrato is utilized.

Figure 58:
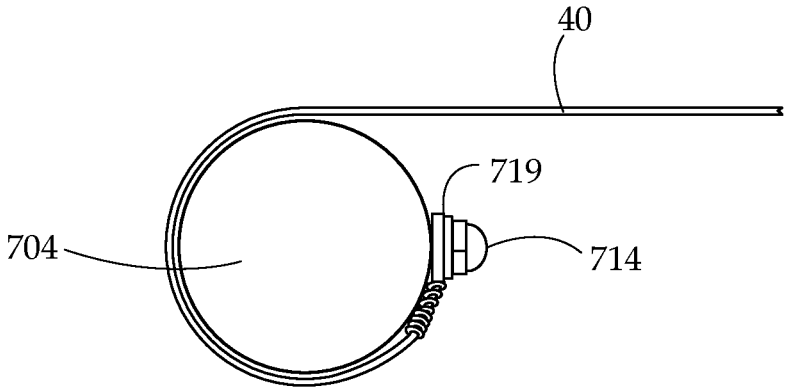
FIG. 58—Illustrates a cut away view the ball end of the string is placed upon the threaded post.
Figure 59:
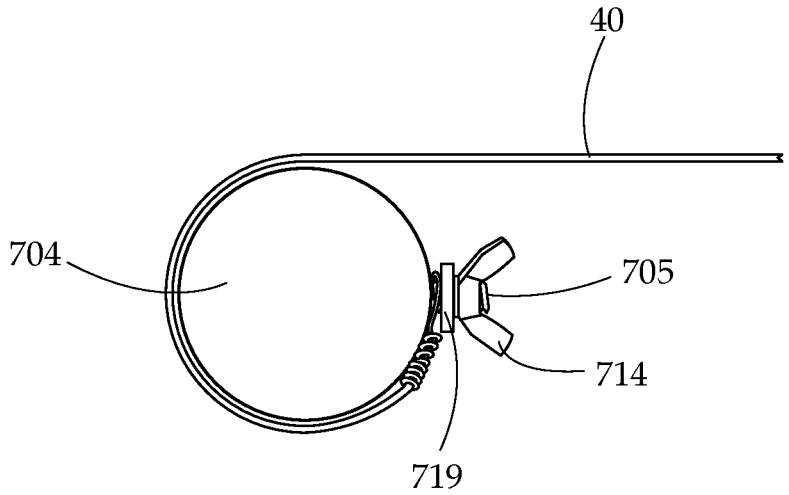
FIG. 59—Illustrates the string loop end of the string is placed upon the threaded post.

In a cut away view FIG. 58 illustrates the ball end of the string being placed upon the threaded post. A washer 719 and a threaded acorn nut 714 or similar, is fastened to the threaded post to secure the string by the inside of the ball end of a musical string. The string 40 is now mechanically locked on the roller bridge section 704 of the tremolo unit. The strings are then looped under and over the rear roller. FIG. 59 shows the string loop end of the string being placed upon the threaded post 705. A washer 719 and a threaded wing style nut 714 or similar, is fastened to the threaded post 705 to secure the string 40 by the inside of the string loop of a musical string. The string is now mechanically locked on the roller bridge section 704 of the tremolo unit. The strings are now looped under and over the rear roller.

Figure 60:
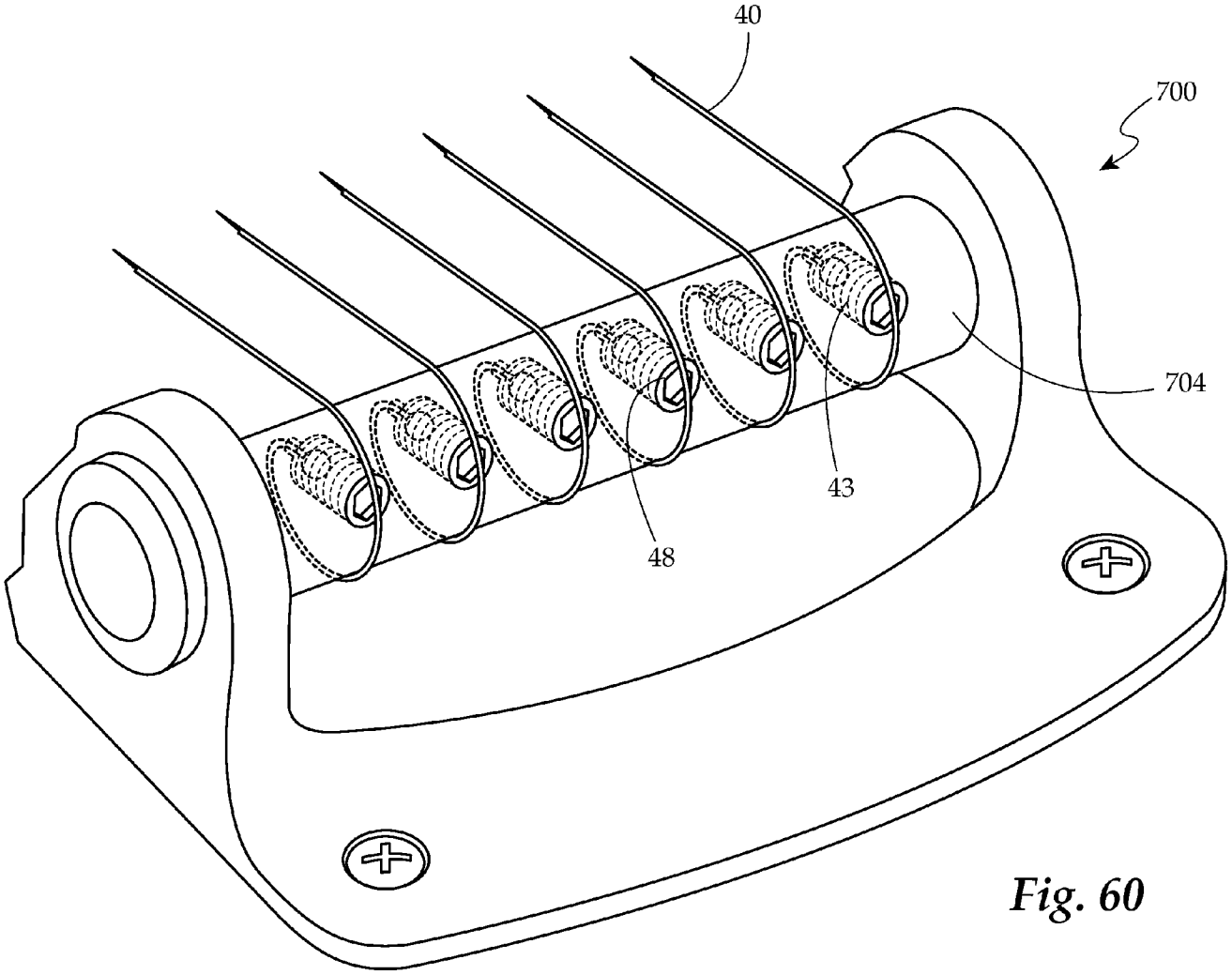
FIG. 60—Illustrates a threaded locking string-end that is inserted and secured into an integrated threaded string cavity within the rear roller.
Figure 61:
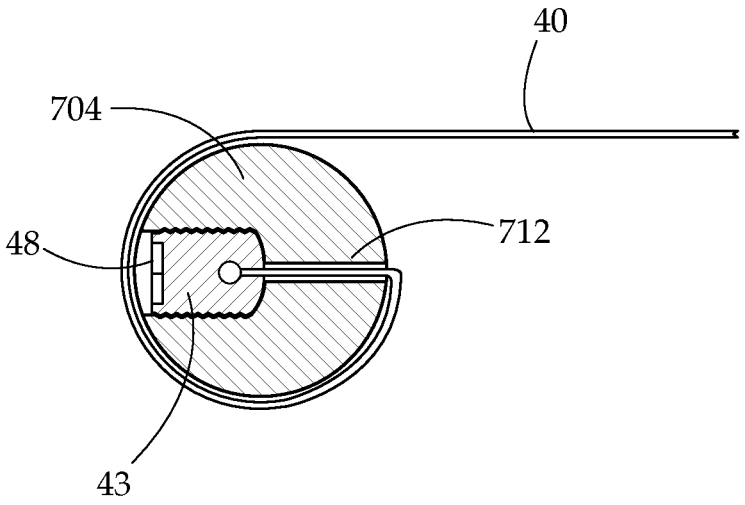
FIG. 61—This is the cutaway version of FIG. 60.
Figure 62:
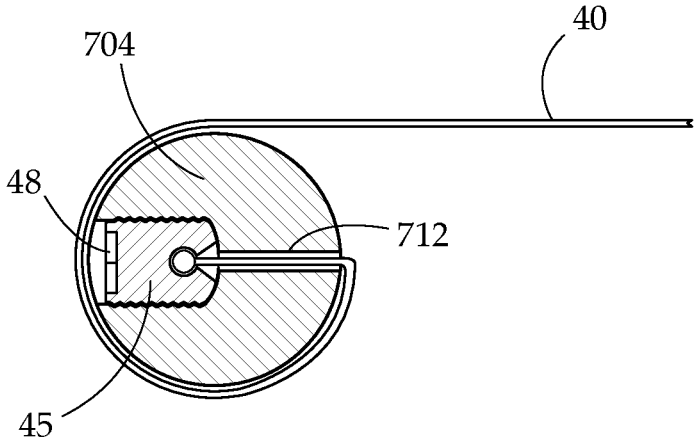
FIG. 62—Illustrates a threaded, rotating, hex headed locking string-end that is inserted and secured into an integrated threaded string cavity within the rear roller.

A threaded locking string-end that is inserted and secured into an integrated threaded string cavity 43 within the rear roller 704 is shown by FIG. 60. The string 40 enters the threaded cavity and into a smaller string chamber and then exits the rear roller. The string is then wrapped under and over the rear roller. FIG. 61 offers a cut away view of FIG. 60, by depicting a threaded, non-rotating, hex-headed locking string-end 48 that is inserted and secured into an integrated threaded string cavity 43 within the rear roller 704. The string enters the threaded cavity and into a smaller string chamber 712 and then exits the rear roller. The string is then wrapped under and over the rear roller 704. FIG. 62 further depicts the threaded, rotating, hex-headed locking string-end 48 that is inserted and secured into an integrated threaded string cavity within the rear roller. The string enters the threaded cavity 45 and into a smaller string chamber 712 and then exits the rear roller. The string is then wrapped under and over the rear roller.

Figure 63:
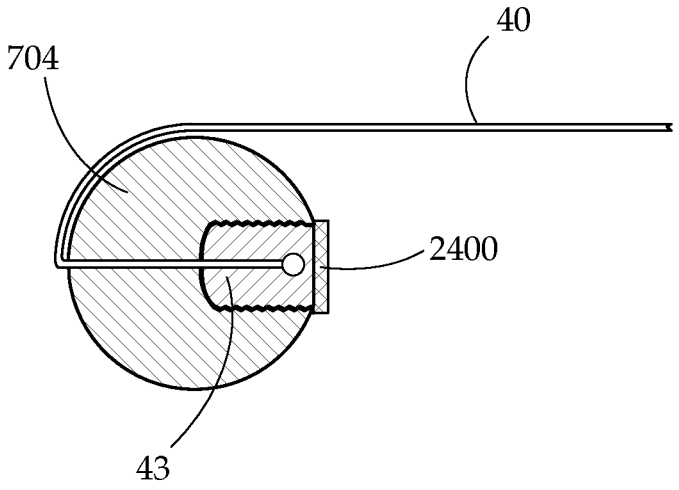
FIG. 63—Illustrates a threaded, non-rotating, knurled headed locking string-end that is inserted and secured into an integrated threaded string cavity within the rear roller.
Figure 64:
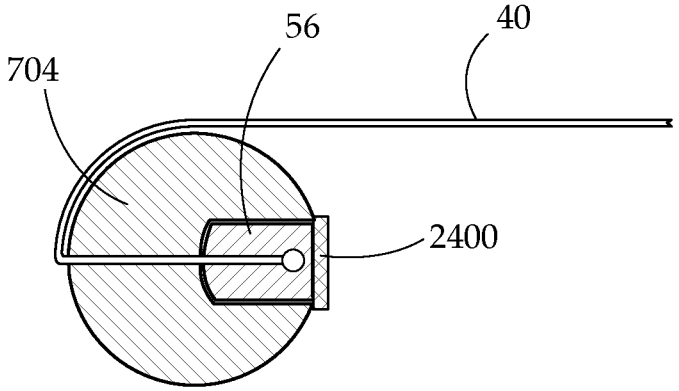
FIG. 64—Illustrates a magnetic, non-rotating, knurled headed locking string-end that is inserted and secured into an integrated unthreaded string cavity within the rear roller.
Figure 65:
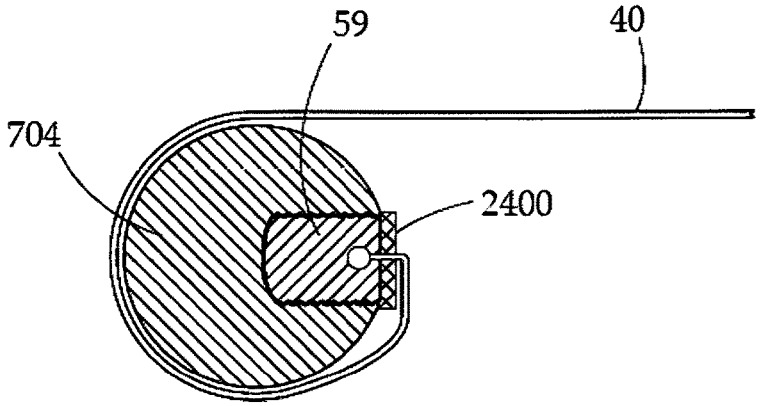
FIG. 65—Illustrates a threaded, non-rotating, knurled headed locking string-end that is inserted secured into an integrated threaded string cavity within the rear roller.

Whereas, FIG. 63 gives a non-rotating option. Shown is a threaded, non-rotating, knurled-headed locking string-end 2400 that is inserted and secured into an integrated threaded string cavity 43 within the rear roller 704. The string enters the threaded cavity and into a smaller string chamber and then exits the rear roller. The string is then wrapped over the rear roller. FIG. 64 illustrates a magnetic, non-rotating, knurled-headed locking string-end that is inserted and secured into an integrated unthreaded string cavity within the rear roller. The string enters the threaded cavity and into a smaller string chamber and then exits the rear roller. The string is then wrapped over the rear roller. Imaged by FIG. 65 is a threaded, non-rotating, knurled-headed locking string-end 2400 that is inserted secured into an integrated threaded string cavity 56 within the rear roller 704. The string exits from the knurled end side of the fastener. The string is then wrapped under and over the rear roller.

Figure 66:
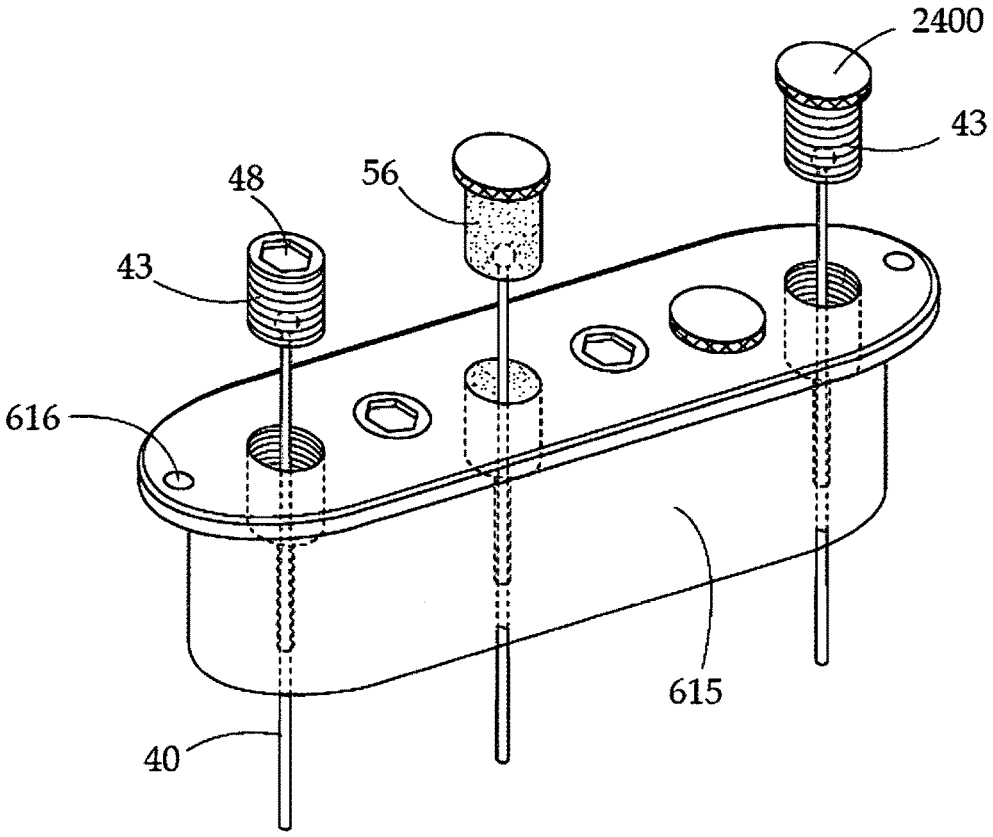
FIG. 66—Illustrates a threaded oblong block ferrule system for all (6) string chambers. Both a threaded knurled and a threaded hex-head locking string-end are shown.
Figure 67:
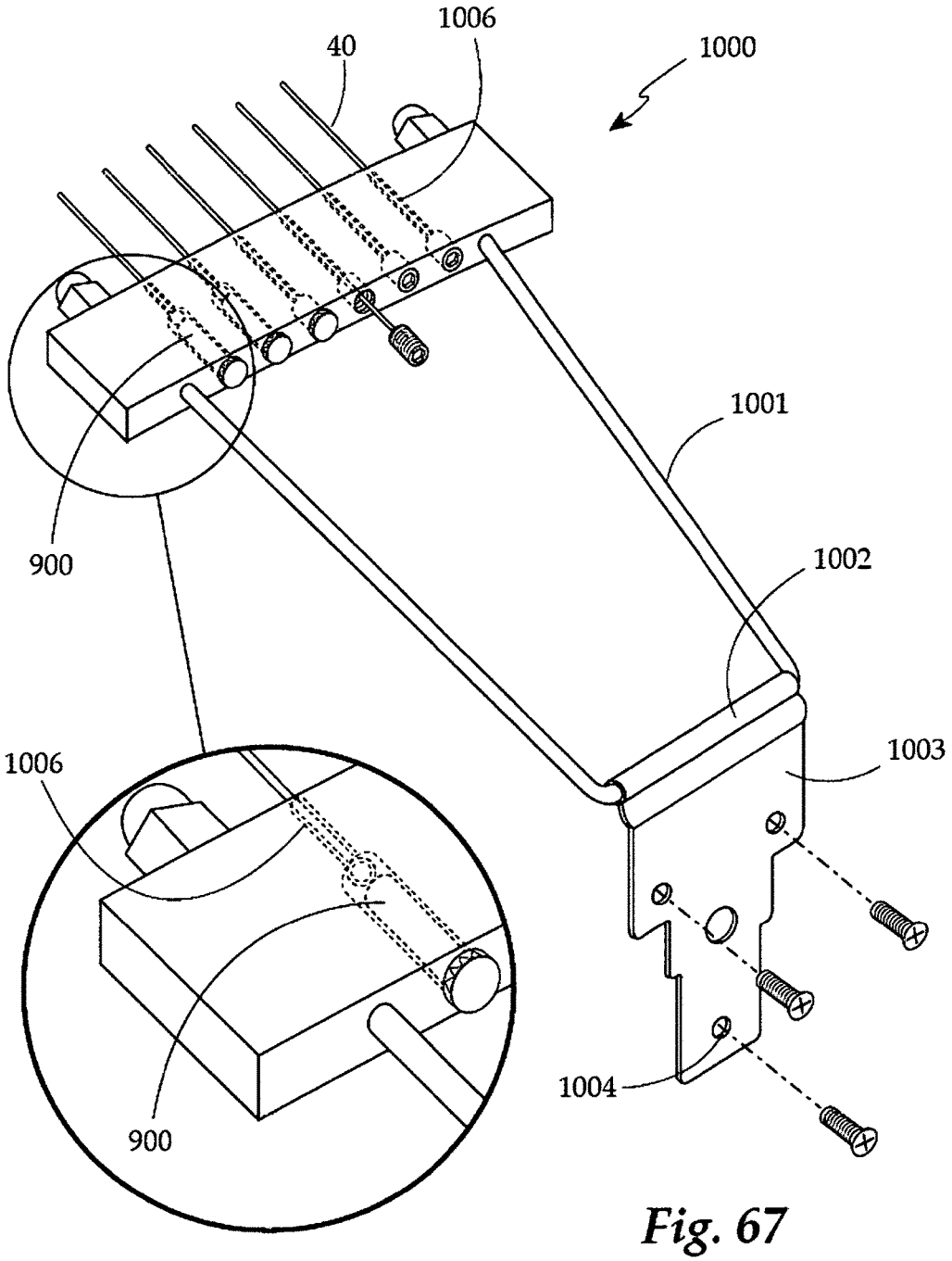
FIG. 67—Illustrates a trapeze tailpiece for an arch top style guitar. A threaded hex locking string, a knurled threaded locking string, and a magnetic knurled locking string are all pictured.

FIG. 66 illustrates a threaded oblong block ferrule system 615 for all (6) string chambers. The chambers are threaded 2500. FIG. 67 depicts a trapeze tailpiece for an arch top style guitar 1000. The trapeze tailpiece 1001 is mounted to the rim or sides of the instrument using wood screws. Large hinge and tailpiece mounting brackets are used to mechanically couple the string chamber block to the tailpiece system. The tailpiece has (6) integrated string chambers 2500 with cylindrical string end chambers to affix a threaded locking string or a magnetic string.

Shown is a threaded hex head locking string being secured into a threaded cylindrical "shallow depth" chamber integrated within the rear section of the tailpiece.

Shown is a knurled threaded locking string being secured into a threaded cylindrical "small depth" chamber 1006 integrated within the rear section of the tailpiece.

Shown is a magnetic knurled locking string in a non-threaded "larger depth" chamber 900.

Shown is a fastener and locking nut system securing the chamber block system to threaded tailpiece brackets on the trapeze tailpiece system.

Shown is the trapeze hinge 1002 and mounting bracket 1003 that secure the tailpiece to the instrument.

Figure 68:
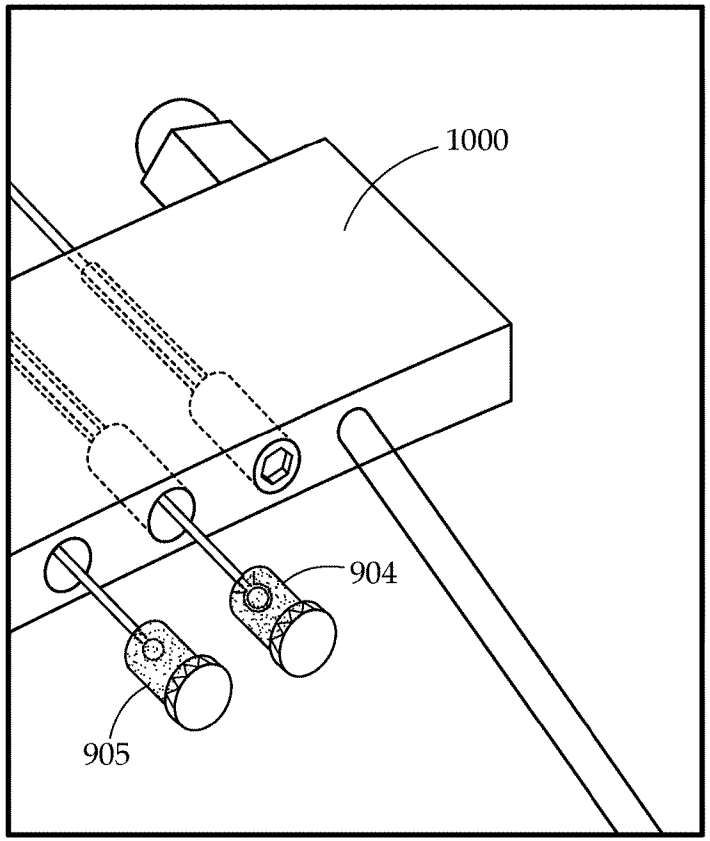
FIG. 68—Illustrates a trapeze tailpiece for an arch top style guitar. A knurled rotating magnetic locking string, a knurled non-rotating magnetic locking string, and a threaded hex head locking string are all pictured.

The trapeze tailpiece for an arch top style guitar is also detailed in FIG. 68. The trapeze tailpiece is mounted to the rim or sides of the instrument via wood screws. Large hinge and tailpiece mounting brackets are used to mechanically couple the string chamber block to the tailpiece system. The tailpiece has (6) integrated string chambers with cylindrical string end chambers to affix a threaded locking string or a magnetic string.

Shown is a knurled rotating magnetic locking string 905. The locking string goes into a non-threaded string cylindrical chamber contained in the trapeze tailpiece.

Shown is a knurled non-rotating magnetic locking string 904. The locking string goes into a non-threaded string cylindrical chamber contained in the trapeze tailpiece.

Shown is a threaded hex-head locking string secured in a threaded string chamber.

Shown is a fastener and locking nut system securing the chamber block system to threaded tailpiece brackets of the trapeze tailpiece system.

Figure 69:
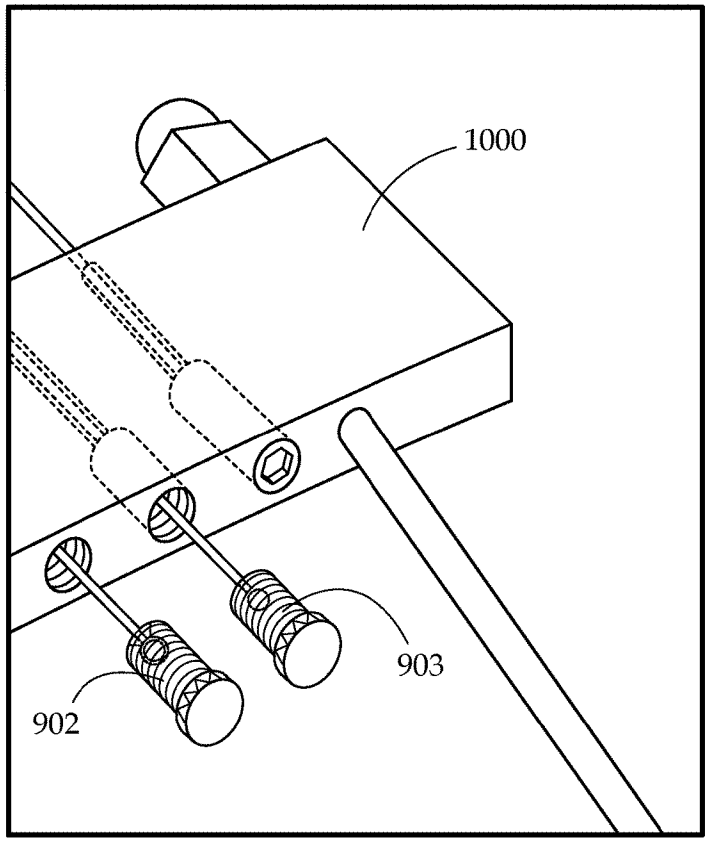
FIG. 69—Illustrates a trapeze tailpiece for an arch top style guitar. A knurled, non-rotating threaded locking string, a knurled rotating locking string, and a threaded hex head locking string are all shown.

Again in FIG. 69 the trapeze tailpiece for an arch top style guitar is explained. The trapeze tailpiece is mounted to the rim or sides of the instrument via wood screws. Large hinge and tailpiece mounting brackets are used to mechanically couple the string chamber block to the tailpiece system. The tailpiece has (6) integrated string chambers with cylindrical string end chambers to affix a threaded locking string or a magnetic string.

Shown is a knurled, non-rotating threaded locking string 902 being secured into a threaded cylindrical chamber integrated within the rear section of the tailpiece.

Shown is a knurled, rotating locking string 903 being secured into a threaded cylindrical chamber integrated within the rear section of the tailpiece.

Shown is a threaded hex-head locking string secured in a threaded string chamber.

Shown is a fastener and locking nut system securing the chamber block system to threaded tailpiece brackets of the trapeze tailpiece system.

Figure 70:
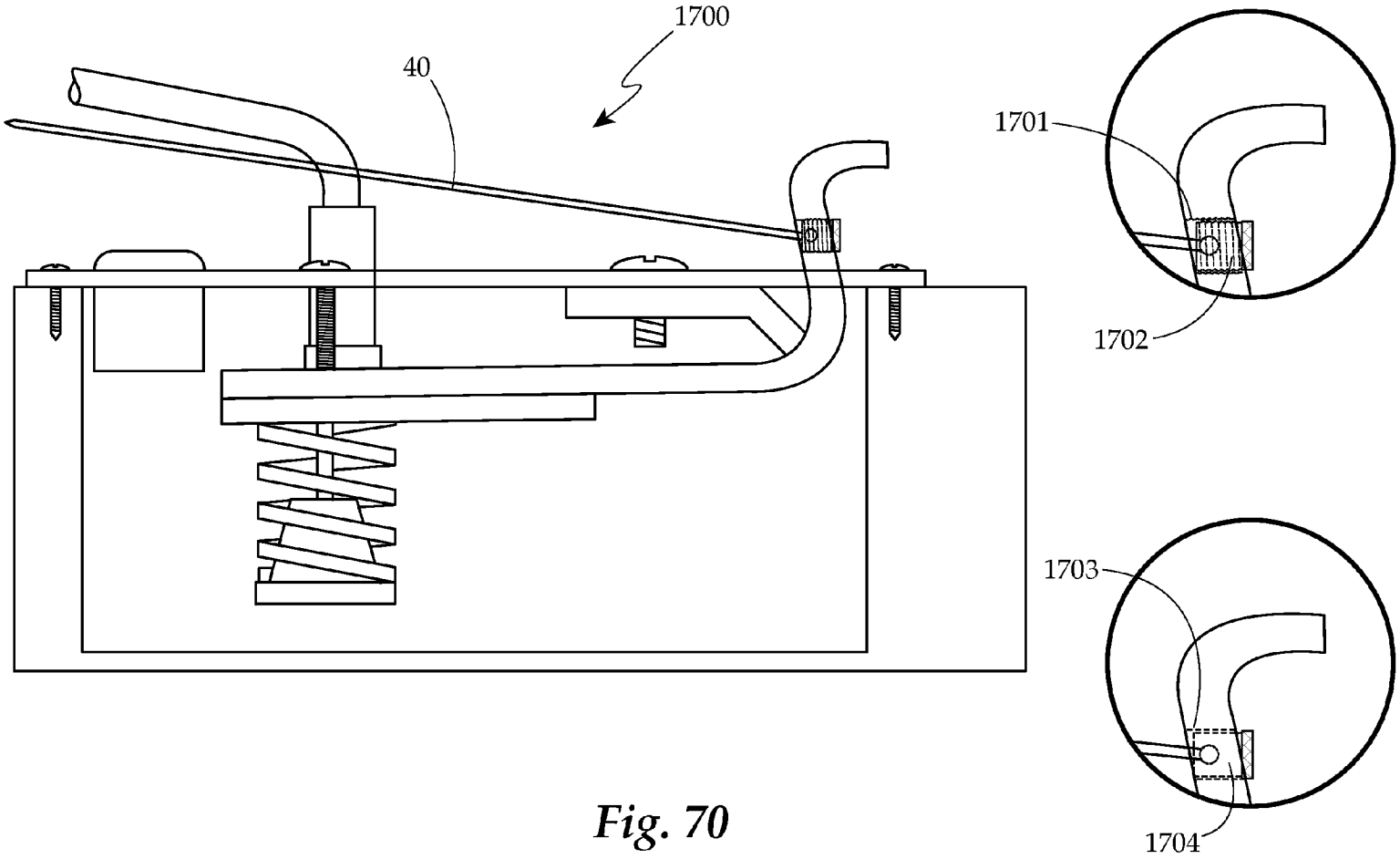
FIG. 70—(Side Profile) Illustrates the Fender® style Jaguar®/Jazzmaster® Tremolo System. Shown is a threaded knurled locking string secured into a threaded chamber and a non-threaded chamber.

The Fender® style Jaguar®/Jazzmaster® Tremolo System is shown in a side profile in FIG. 70. This system utilizes a main tremolo spring to counterbalance the string tension made upon the tremolo system. The tremolo's spring tension adjustment screw allows for incremental spring tension adjustments that can made to counterbalance the system. A sliding locking mechanism is used to lock the tremolo in a non-floating position. The strings attach at the rear of the tremolo plate by threading the string through the tailpiece string cavity and over the bridge saddle to the tuning machines. The cylindrical string cavities can be threaded 1701 to receive a threaded locking string 1702 or unthreaded 1703 to receive a magnetic locking string 1704.

Shown is threaded knurled locking string that is secured into a cylindrical threaded chamber within the rear steel tailpiece section of the tremolo bridge.

Shown is knurled magnetic locking string that is secured into a non-threaded cylindrical chamber within the rear steel tailpiece section of the tremolo bridge.

Figure 71:
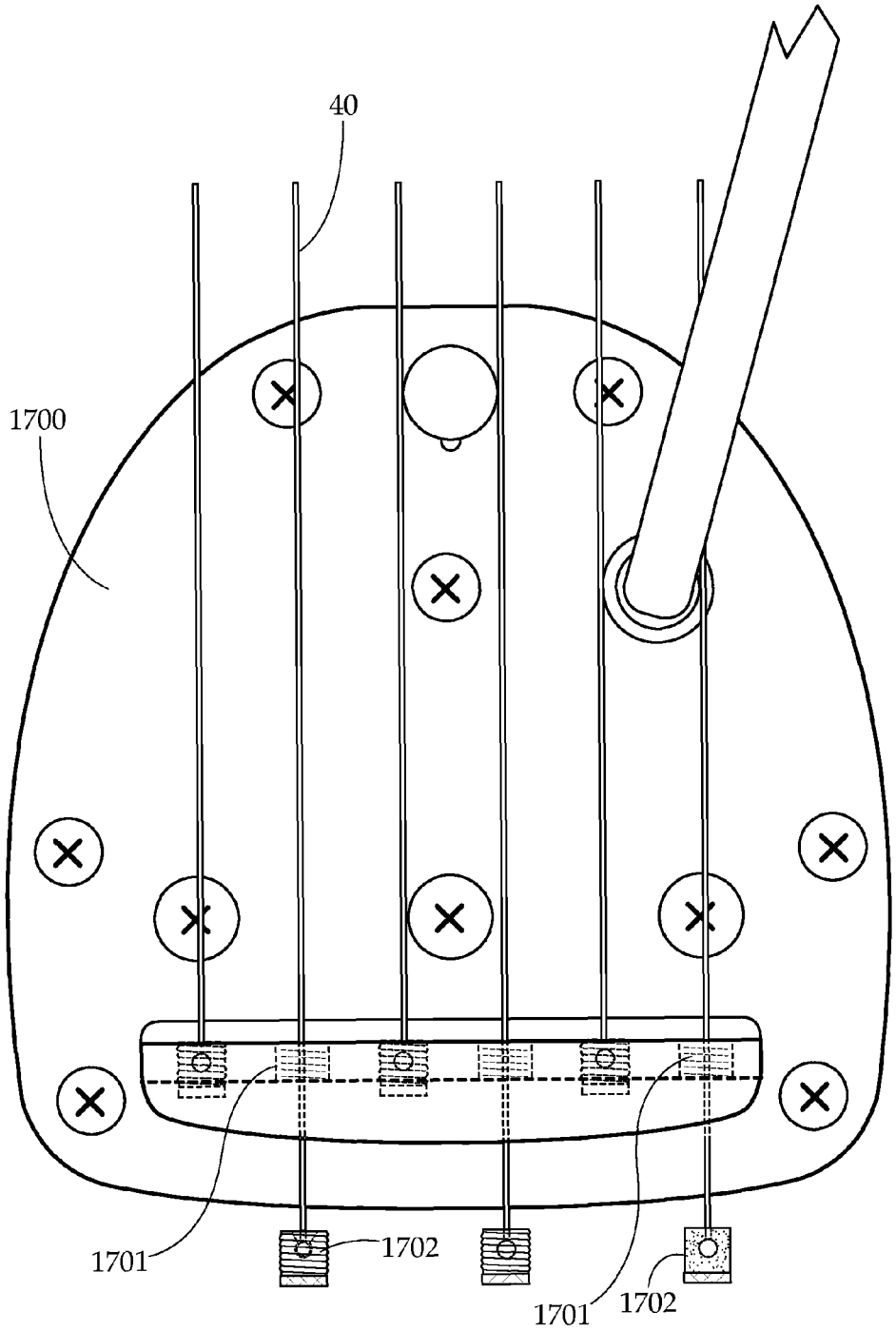
FIG. 71—Illustrates a top profile of the Fender® style Jaguar®/Jazzmaster® Tremolo System. A knurled rotating threaded locking string, a knurled non-rotating locking string, and a knurled non-rotating magnetic locking string are all shown.

FIG. 71 illustrates the top view of the Fender® style Jaguar®/Jazzmaster® Tremolo System 1700. This system utilizes a main tremolo spring to counterbalance the string tension made upon the tremolo system. The tremolo's spring tension adjustment screw allows for incremental spring tension adjustments that can made to counterbalance the system. A sliding locking mechanism is used to lock the tremolo in a non-floating position. The strings attach at the rear of the tremolo plate by threaded the string through the tailpiece string cavity and over the bridge saddle to the tuning machines. The cylindrical string cavities can be threaded 1701 to receive a threaded locking string 1702 or unthreaded 1703 to receive a magnetic locking string 1704.

Shown is a knurled rotating threaded locking string. The locking string goes into a non-threaded string cylindrical chamber contained in the tremolo bridge.

Shown is threaded knurled non-rotating locking string that is secured into a cylindrical threaded chamber within the rear steel tailpiece section of the tremolo bridge.

Shown is a knurled non-rotating magnetic locking string. The locking string goes into a non-threaded string cylindrical chamber contained in the tremolo bridge.

Figure 72:
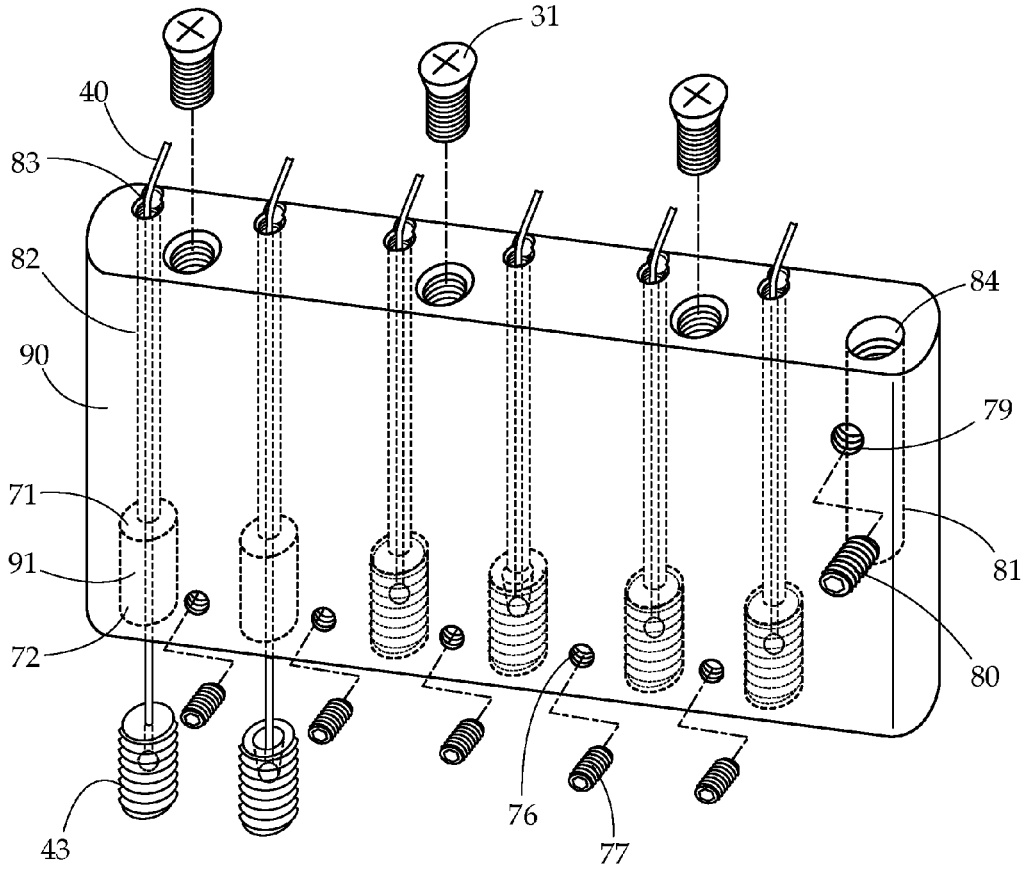
FIG. 72—Illustrates a top and side view of the locking inertia block with integrated threaded cylindrical string end chambers and string FIG. 73—illustrates guitar tuning machines FIG. 74—Illustrated is a threaded, no-load, self-locking tuning machine.

A locking inertia block 90 with integrated threaded cylindrical string end chambers 91 and string cavities 82 is depicted by a top and side view in FIG. 72. On top of the inertial is a roller system on each of the (6) cavities 83 to reduce stressors that may result in string breakage. A threaded tremolo arm cavity 84 and locking tremolo arm cavity 79 and screw 80 are also depicted. The (3) steel machine screws 31 mount the bridge plated into the inertia block via the (3) threaded cavities depicted on top of the inertia block.

Shown is a threaded hex-head non-rotating string-end and a threaded string chamber 43. The string 40 is secured to the tremolo system with an Allen Wrench.

Shown is an upper threshold chamber 71

Shown is a lower threshold chamber 72

Shown is a threaded chamber 76

Shown if a screw mechanism 77

Figure 73:
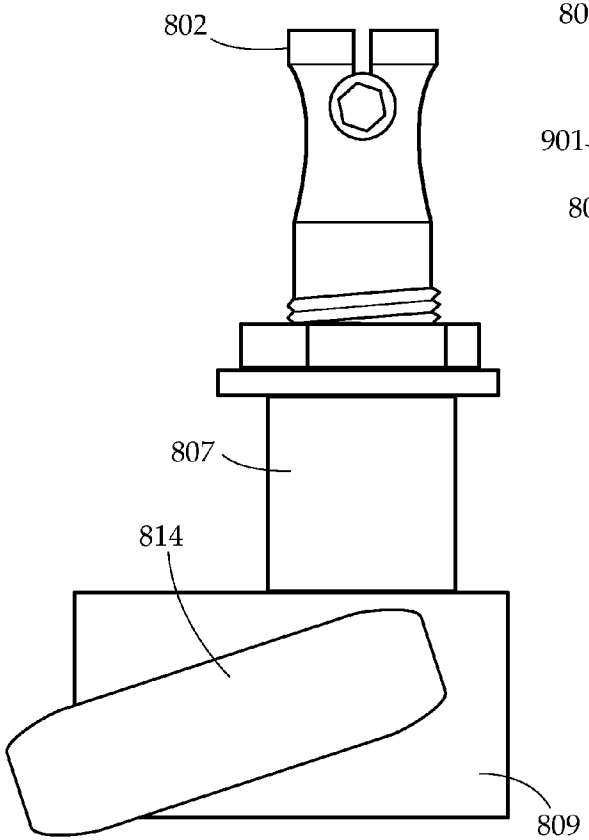

FIG. 73 captures guitar tuning machines. Tuning knobs 814 make use of a worm gear in order to allow the user to tighten the string without the string being able to loosen itself. As a worm gear is rotated by a user while tuning the guitar, its teeth move side to side relative to the crown gear it is turning, pushing these teeth around in a circle. However, when the crown gear tries to push back, it is pushing perpendicular to the direction of the worm gear's rotation, almost entirely into the worm gear's teeth. The coefficient of friction between the gears is such that the frictional force between the gears always matches the rotational force generated by the contact between the two gears. As a result, it exerts no net rotational force on the worm gear.

Figure 74:
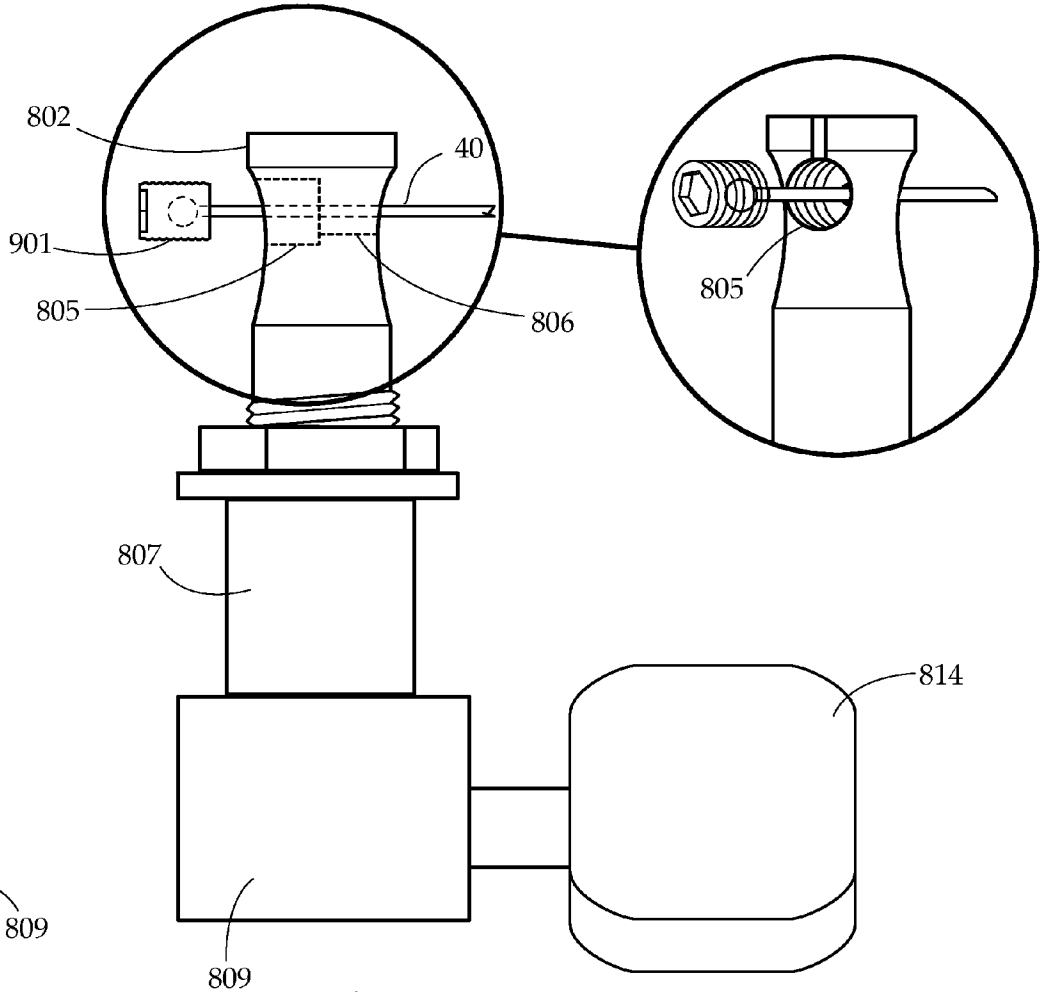

FIG. 74 illustrates is a threaded, no-load, self-locking tuning machine 809. The top of the tuner shaft 802 has a slotted opening that extends into the threaded string cavity of the tuner 805. The musical string is then placed into the slotted area of the tuner 806. Once the string 40 is in position, the threaded hex head locking string is then secured to the tuner post by an Allen wrench. The locking tuner does not require an external locking mechanism, because the string 40 is threaded and self locking. In this design, all the string tension remains upon the shaft of the tuner and not the locking pin 812 as subjected in other locking tuner designs. The musical string will not be subjected to crushing or stressors that are current in present technology. The tuning machine uses a both a worm and crown gear system 809. The worm gear is integrated into the tuner housing 807. The tuner housing 807 has a hex head design which is affixed to the crown gear. The crown and worm gear assembly 809 are interlocked in place within the housing of the tuner. As a worm gear is rotated by a person tuning the guitar, the crown gear rotates in a circular motion. However, when the crown gear tries to push back, it is pushing perpendicular to the direction of the worm gear's rotation, almost entirely into the worm gear's teeth. The coefficient of friction between the gears is such that the frictional force between the gears always matches the rotational force generated by the contact between the two gears. As a result, it exerts no net rotational force on the worm gear.

Shown is the tuner button 814, which is secured to the worm gear 809.

Shown is a Large tuner housing 807

Shown is large threaded section of tuner shaft 802

Shown is washer

Shown is threaded tuner bushing

Shown is smaller tuner shaft with slotted end 806

Shown is locking hex screw with string going through the tuner shaft

Shown is close up of threaded tuner shaft circular string chamber 816

Figure 75:
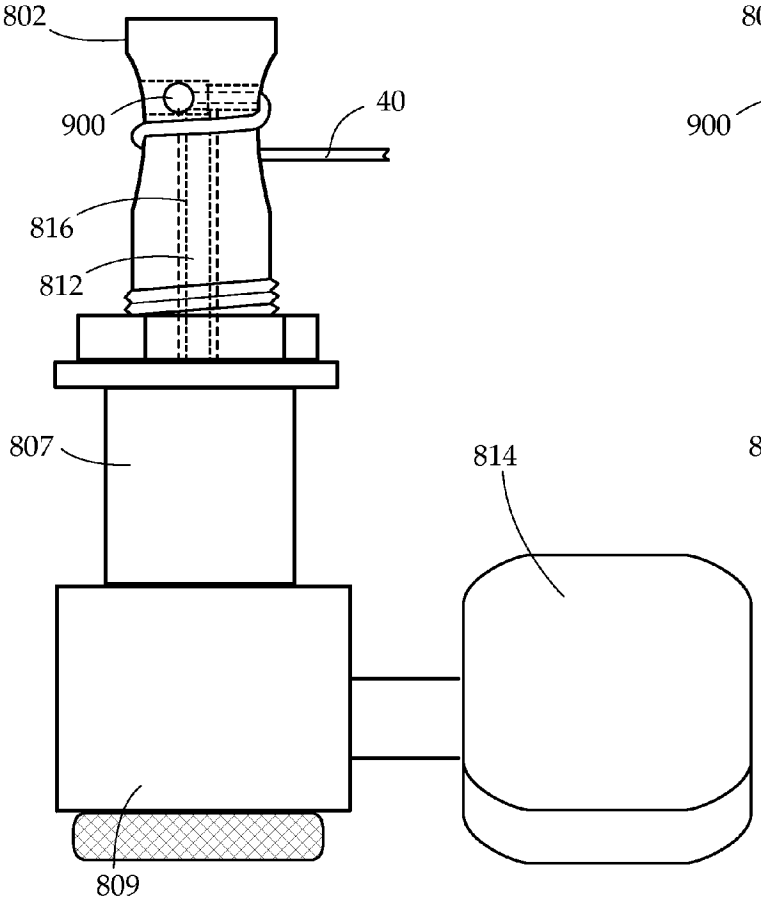
FIG. 75—Illustrated is a threaded, no-load, pin-locking tuning machine. The top of the tuner shaft has a slotted opening that extends into the threaded string cavity of the tuner.
Figure 78:
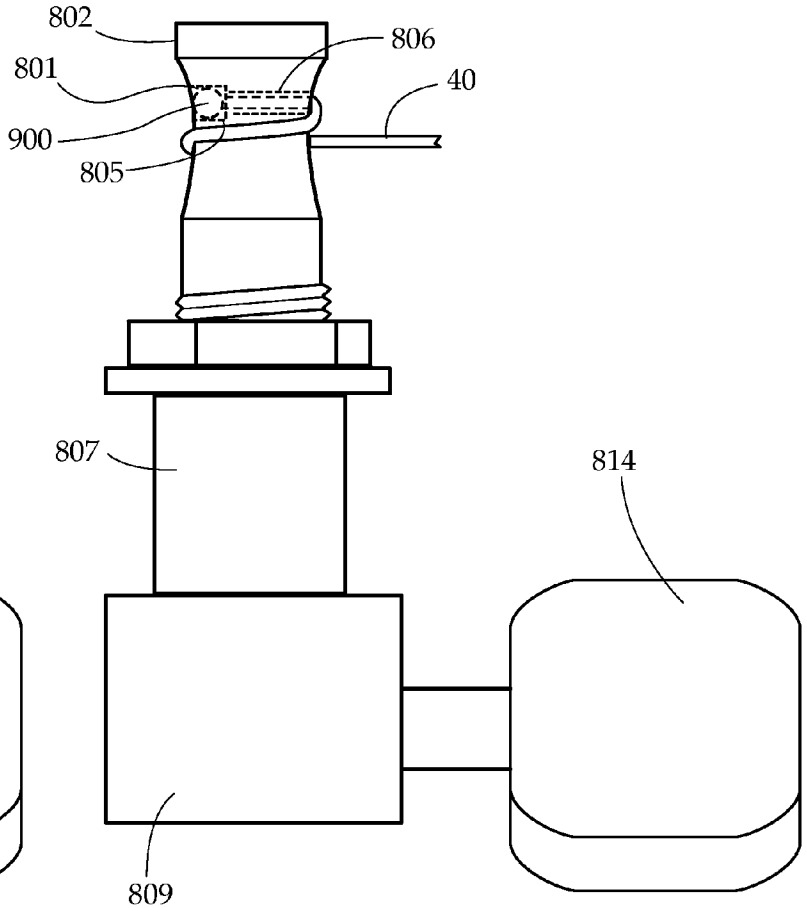
FIG. 78—Illustrated is a threaded, no-load, self-locking tuning machine wherein the top of the tuner shaft has a slotted opening that extends into the threaded string cavity of the tuner.

FIG. 75 illustrates is a threaded, no-load, pin-locking tuning machine. The top of the tuner shaft 802 has a slotted opening that extends into the threaded string cavity of the tuner. The musical string 40 is then placed into the slotted area of the tuner. Once the string 40 is in position, the ball 900 is then secured to the tuner post by the knurled screw and pin system. The tuner shaft has an integrated chamber 816 for the locking pin 812. The knurled screw pushes the locking pin 812 up the chamber 816 and into the string cavity 806. While in the string cavity 806, the user exhorts force upon the knurled locking screw to secure the ball end 900 of the string 40 with the locking pin 812. In this design, the locking pin 812 is only securing the ball end 900 of the string 40 and not the string 40 itself; therefore, the locking mechanism is not creating stressors or damaging the wound or unwound musical strings 40. In this design, all the string tension remains upon the shaft of the tuner and not the locking pin 812 as subjected in other locking tuner designs. Since the center of the tuner cavity 816 is holding the force of the string, the knurled screw and locking pins 812 function is to prevent the negative force upon the tuner machine when the string is detuned by a tremolo system. The musical string will not be subjected to crushing or stressors that are current in present technology. The tuning machine uses a both a worm and crown gear system.

The worm gear is integrated into the tuner's post. The tuner shaft assembly has a hex head design which is affixed to the crown gear. The crown and worm gear assembly are interlocked in place within the housing of the tuner. As a worm gear is rotated by a person tuning the guitar, the crown gear rotates in a circular motion. However, when the crown gear tries to push back, it is pushing perpendicular to the direction of the worm gear's rotation, almost entirely into the worm gear's teeth. The coefficient of friction between the gears is such that the frictional force between the gears always matches the rotational force generated by the contact between the two gears. As a result, it exerts no net rotational force on the worm gear.

Shown is the tuner button, which is secured to the worm gear.

Shown is a Large tuner housing 807

Shown is large threaded section of tuner shaft 802

Shown is washer

Shown is threaded tuner bushing

Shown is smaller tuner shaft with slotted end 806

Shown is an unthreaded string chamber

Shown ball end 900 of a musical string 40 secured against the post of the tuner Shown is a locking pin 812 against the ball end 900 of the string 40

Shown is a knurled nut

Figure 76:
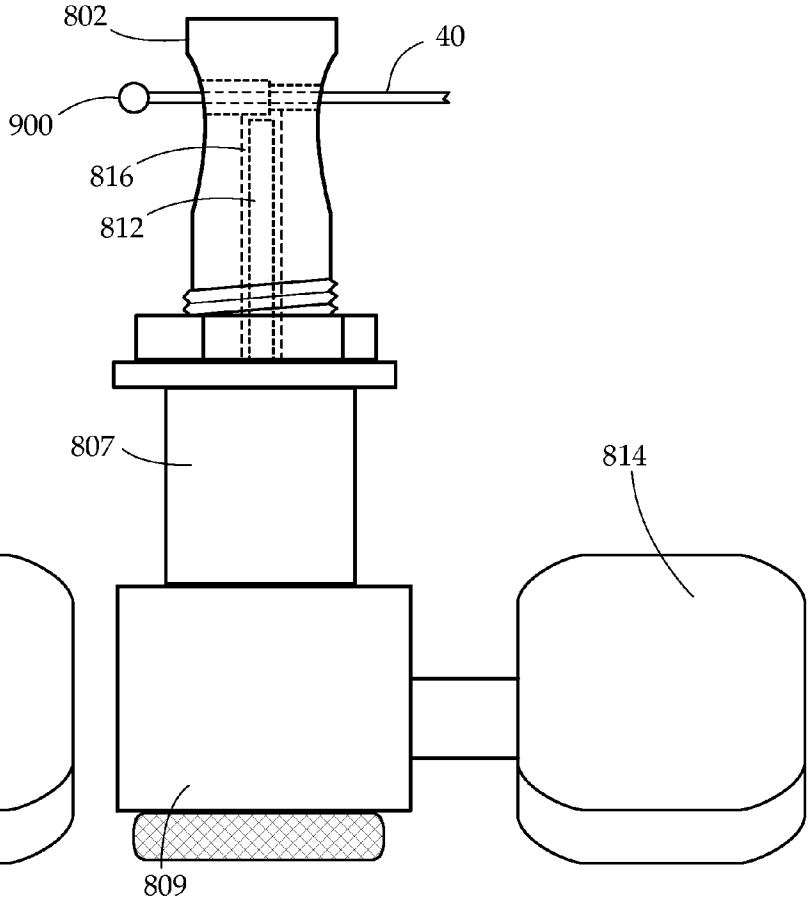
FIG. 76—Illustrated is a threaded, no-load, pin-locking tuning machine. The top of the tuner shaft has a slotted opening that extends into the threaded string cavity of the tuner.

FIG. 76 illustrates is a threaded, no-load, pin-locking tuning machine. The top of the tuner shaft 802 has a slotted opening that extends into the threaded string cavity of the tuner. The musical string 40 is then placed into the slotted area of the tuner. Once the string is in position, the ball 900 is then secured to the tuner post by the knurled screw and pin system. The tuner shaft has an integrated chamber 816 for the locking pin 812. The knurled screw pushes the locking pin 812 up the chamber and into the string cavity. While in the string cavity, the user exhorts force upon the knurled locking screw to secure the ball end 900 of the string 40 with the locking pin 812. In this design, the locking pin 812 is only securing the ball end 900 of the string 40 and not the string 40 itself; therefore, the locking mechanism is not creating stressors or damaging the wound or unwound musical strings.

In this design, all the string tension remains upon the shaft of the tuner and not the locking pin 812 as subjected in other locking tuner designs. Since the center of the tuner cavity 816 is holding the force of the string 40, the knurled screw and locking pins 812 function is to prevent the negative force upon the tuner machine when the string 40 is detuned by a tremolo system. The musical string 40 will not be subjected to crushing or stressors that are current in present technology. The tuning machine uses a both a worm and crown gear system 809. The worm gear is integrated into the tuner's post. The tuner shaft assembly 807 has a hex head design which is affixed to the crown gear. The crown and worm gear assembly are interlocked in place within the housing of the tuner. As a worm gear is rotated by a person tuning the guitar, the crown gear rotates in a circular motion. However, when the crown gear tries to push back, it is pushing perpendicular to the direction of the worm gear's rotation, almost entirely into the worm gear's teeth. The coefficient of friction between the gears is such that the frictional force between the gears always matches the rotational force generated by the contact between the two gears. As a result, it exerts no net rotational force on the worm gear.

Shown is the tuner button, which is secured to the worm gear.

Shown is Large tuner housing 807

Shown is large threaded section of tuner shaft 802

Shown is washer

Shown is threaded tuner bushing

Shown is smaller tuner shaft with slotted end 806

Shown is an unthreaded string chamber

Shown ball end 900 of a musical string 40 secured against the post of the tuner Shown is a locking pin 812 against the ball end 900 of the string 40

Shown is a knurled nut

Figure 77:
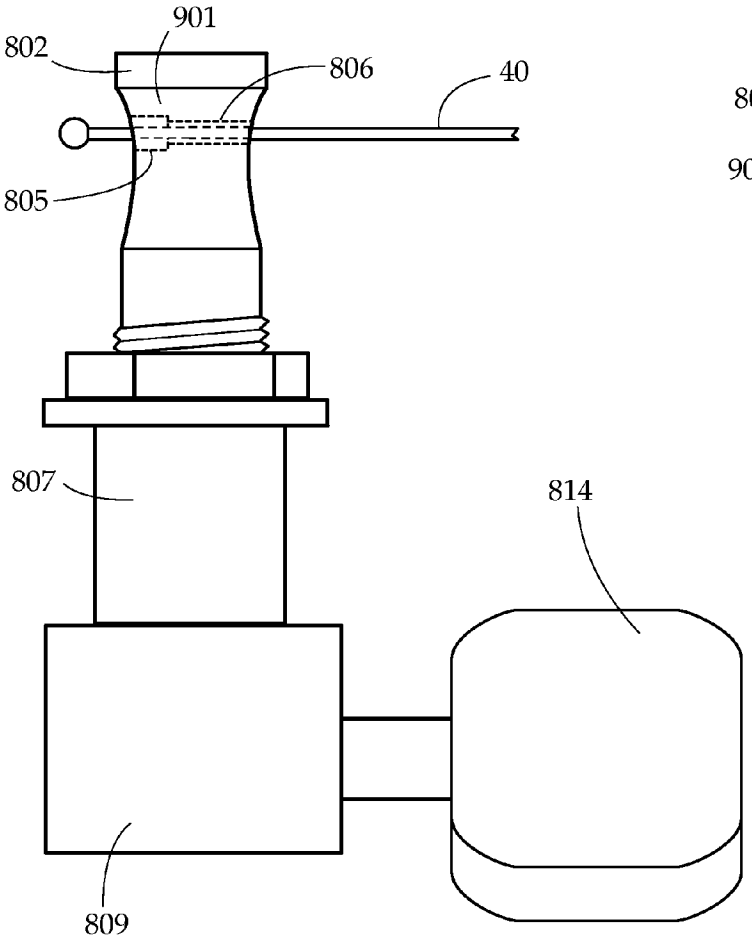
FIG. 77—Illustrated is a threaded, no-load, self-locking tuning machine.

FIG. 77 illustrates a threaded, no-load, self-locking tuning machine. The top of the tuner shaft has a slotted opening 806 that extends into the threaded string cavity 805 of the tuner. The musical string 40 is then placed into the slotted area of the tuner. Once the string 40 is in position, the ball end 900 of the string 40 is then held in place within the chamber 801 by the user. The user then rotates the tuning mechanism and placed one string wrap around the tuner, which locks the ball end 900 in place. The string wrap makes physical contact with the ball end 900, therefore, using the force of string tension to secure the ball end 900 to the tuner post. Since the center of the tuner shaft is holding the force of the string 40, the primary function of the string wrap is to prevent the negative force upon the tuner machine when the string is detuned by a tremolo system. In this design, all the string tension remains upon the shaft of the tuner and not the locking pin 812 as subjected in other locking tuner designs. The musical string 40 will not be subjected to crushing or stressors that are current in present technology.

The tuning machine uses a both a worm and crown gear system. The worm gear is integrated into the tuner's post. The tuner shaft assembly has a hex head design which is affixed to the crown gear. The crown and worm gear assembly are interlocked in place within the housing of the tuner 807. As a worm gear is rotated by a person tuning the guitar, the crown gear rotates in a circular motion. However, when the crown gear tries to push back, it is pushing perpendicular to the direction of the worm gear's rotation, almost entirely into the worm gear's teeth. The coefficient of friction between the gears is such that the frictional force between the gears always matches the rotational force generated by the contact between the two gears. As a result, it exerts no net rotational force on the worm gear.

Shown is the tuner button 814, which is secured to the worm gear.

Shown is large tuner housing 807. Worm and crown gears are contained herein

Shown is large threaded section of tuner shaft 802

Shown is washer

Shown is threaded tuner bushing

Shown is smaller tuner shaft with slotted end 806

Shown is ball end 900 of string 40

Shown is a locking string wrap around the tuner post

Figure 79:
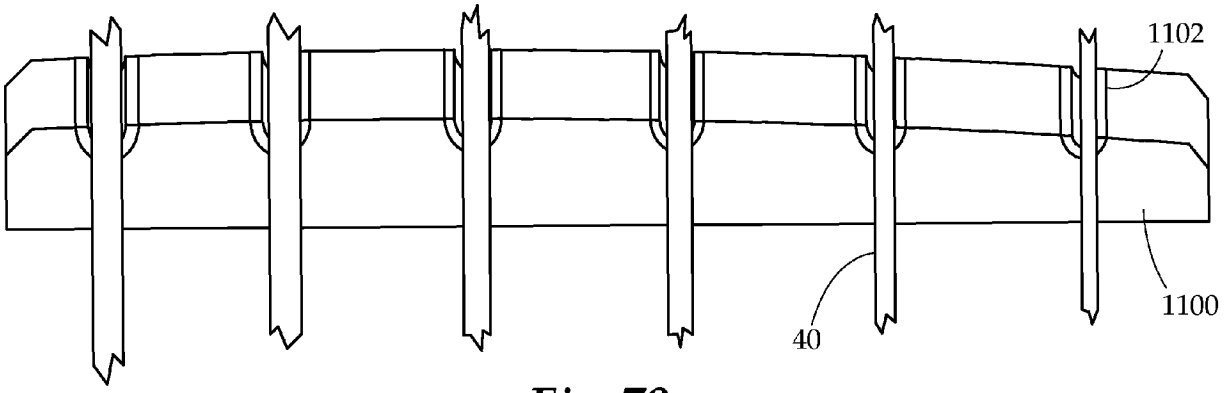
FIG. 79—Illustrated is a customizable instrument nut system that is affixed to the neck.
Figure 80:
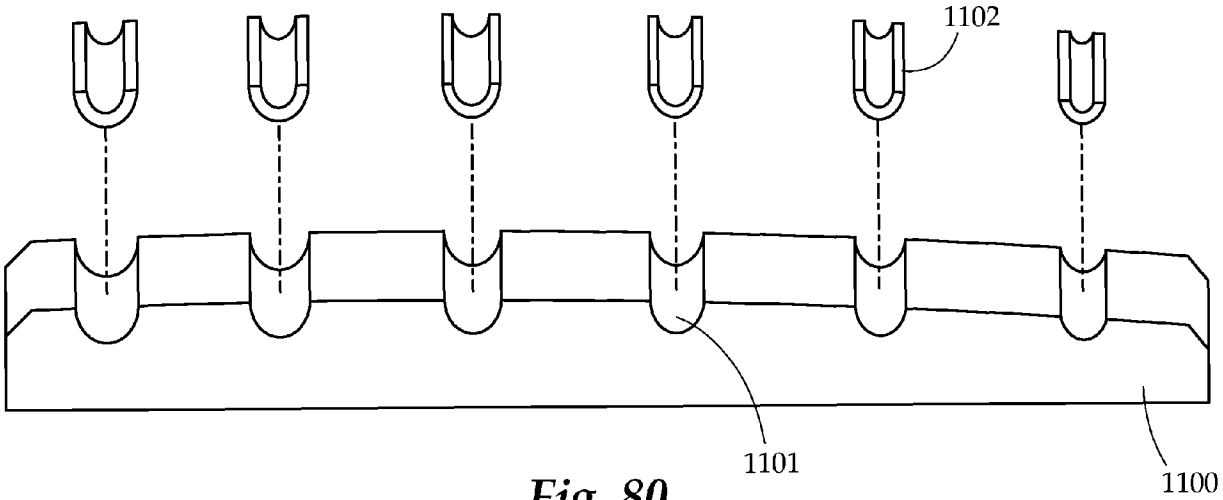
FIG. 80—Illustrated is a customizable instrument nut system that is affixed to the neck.

A customizable instrument nut system that is affixed to the neck of the guitar is shown in FIGS. 79 and 80. The system is comprised of a main base 1100 with integrated cutaway sections 1101 to couple with an array interchangeable nut slot materials 1102, custom designed for each string of the musical instrument. The main base of the nut system can be manufactured from metal, titanium, aluminum, brass, bone, plastic, synthetic materials, composite materials, or other natural or manmade products. The individual string slot inserts can be manufactured from metal, titanium, aluminum, brass, bone, plastic, synthetic materials, composite materials, or other natural or manmade products. The material can be interchangeable, allowing the user to choose the type of string slot material and tone desired, for each of the strings. This allow for individual customization of the instrument's nut. The string inserts can be glued, press fit or slotted onto the main section of the material, which then can be removed when the individual nut material has been worn down or deemed defective.

In present technology, the entire nut is made out of one piece of material with integrated slots that are either pre-fabricated or have to be specially formed and cut by the manufacturer or Luthier. Moreover, there is no individual customization of this nut material nor are there replaceable nut slot materials for when the nut gets worn down or becomes defective. The user only has one choice of material they can use on the nut. The replacement nut and nut slot design gives the user unlimited choices of widths, heights, radii, nut material, nut slot designs or combination thereof.

The replaceable nut slot material can be manufactured in different radii, widths, and thicknesses, or combination thereof for individual gauge strings for a custom fit design and overall enhancement of the instrument's performance. This allows the guitarist to customize each individual nut slot for optimum performance, tonality, and custom tapering the overall sound of each individual string. Individual nut slots can be made with precision as well as being replaceable.

Shown is the main base of the nut system with integrated channels to couple with the individual nut slot material for each individual musical string.

Shown is an individual nut slot that is secured to the main base of the nut.

Continuing with the customizable instrument nut, FIG. 80 also depicts this system. The system is comprised of a main base with integrated cutaway sections to couple with an array interchangeable nut slot material custom designed for each string of the musical instrument. The main base of the nut system can be manufactured from metal, titanium, aluminum, brass, bone, plastic, synthetic materials, composite material for nut, or other natural or manmade products.

The individual string slot inserts can be manufactured from metal, titanium, aluminum, brass, bone, plastic, synthetic materials, composite material, or other natural or manmade products. The material can be interchangeable as well, allowing the user to choose the type of string slot material and tone desired for each of the strings. This allows for individual customization of the instrument's nut. The string inserts can be glued, press fit or slotted onto the main section of the material, which then can be removed when the individual nut material has been worn down or deemed defective.

Shown is the main base of the nut system with integrated channels to couple with the individual nut slot material for each individual musical string.

Shown is an individual nut slot for each individual musical string.

Figure 81:
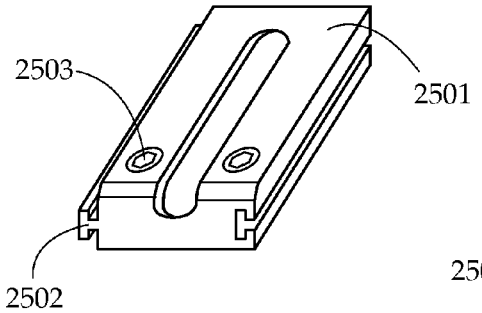
FIG. 81—(Side profile)—Illustrates a rectangle shaped interlocking bridge saddle.

FIG. 81—(Side profile)—Illustrates a rectangle shaped interlocking bridge saddle 2501. The saddle can be manufactured from metal, titanium, aluminum, brass, bone, plastic, synthetic materials, composite materials, or other natural or manmade products. The saddle has both an integrated channel and a protruding channel 2502. The saddles are mounted to the bridge plate by their integrated threaded intonation screw cavities 2503 that are located at the rear of the saddle. Intonation screws mount the saddles to the bridge plate, as well as, adjusting the overall length of the musical string. The saddles utilized two height adjustment screws to adjust string distance from the fret board.

Figure 82:
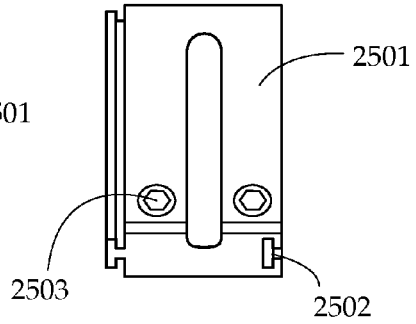
FIG. 82 (Front Profile)—Illustrates a rectangle shaped interlocking bridge saddle.

FIG. 82 (Front Profile)—Illustrates a rectangle shaped interlocking bridge saddle 2501. The saddle can be manufactured from metal, titanium, aluminum, brass, bone, plastic, synthetic materials, composite materials, or other natural or manmade products. The saddle has both an integrated channel and a protruding channel 2502. The saddles are mounted to the bridge plate by their integrated threaded intonation screw cavities 2503 that are located at the rear of the saddle. Intonation screws mount the saddles to the bridge plate, as well as, adjusting the overall length of the musical string. The saddles utilized two height adjustment screws to adjust string distance from the fret board.

Figure 83:
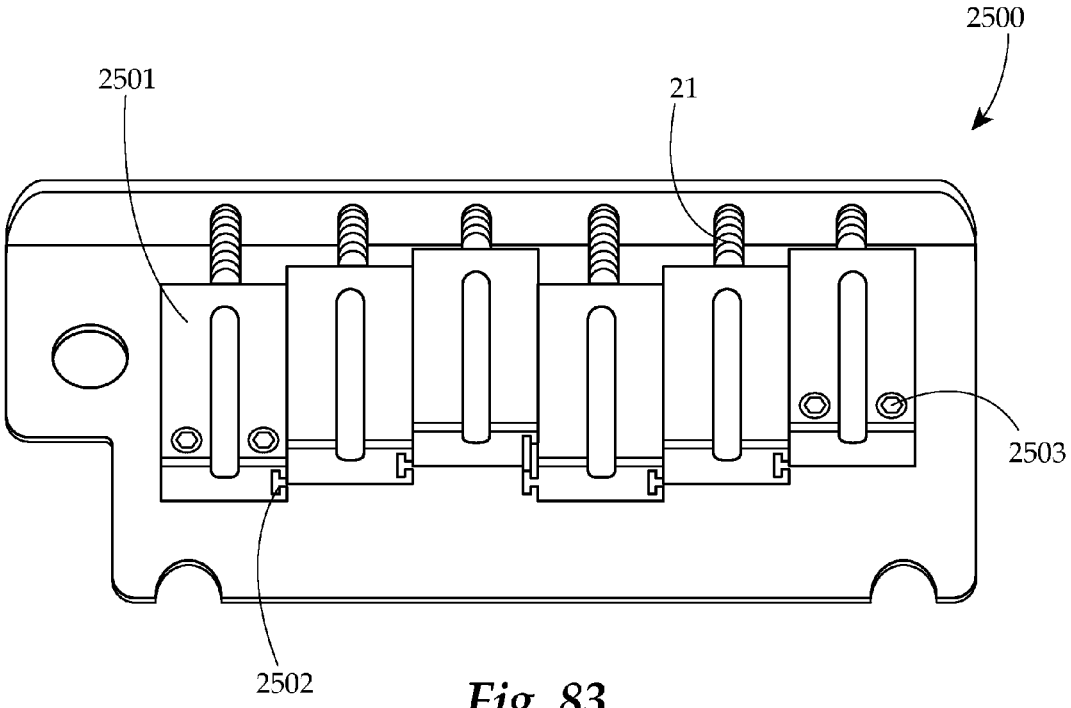
FIG. 83—(Perspective View). Illustrates the Interlocking Bridge Saddle System.

FIG. 83—(Perspective View). Illustrates the Interlocking Bridge Saddle System 2500. The saddle 2501 can be manufactured from metal, titanium, aluminum, brass, bone, plastic, synthetic materials, composite materials for nut, or other natural or manmade products. The saddle has both an integrated channel and a protruding channel 2502. The saddles are mounted to the bridge plate by their integrated threaded intonation screw cavities 2503 that are located at the rear of the saddle. Intonation screws 21 mount the saddles to the bridge plate, as well as, adjusting the overall length of the musical string. The saddles utilized two height adjustment screws to adjust string distance from the fret board. The purposes of these channels are to create an interlocking saddle system to minimize any side to side movement. In present technology, vintage bridge style systems have individually mounted saddle systems are independent do to not have interlocking capabilities or locking capabilities. The saddle's interlocking mechanisms have an integrated radii system designed for instrument neck curvature or radius.

Figure 84:
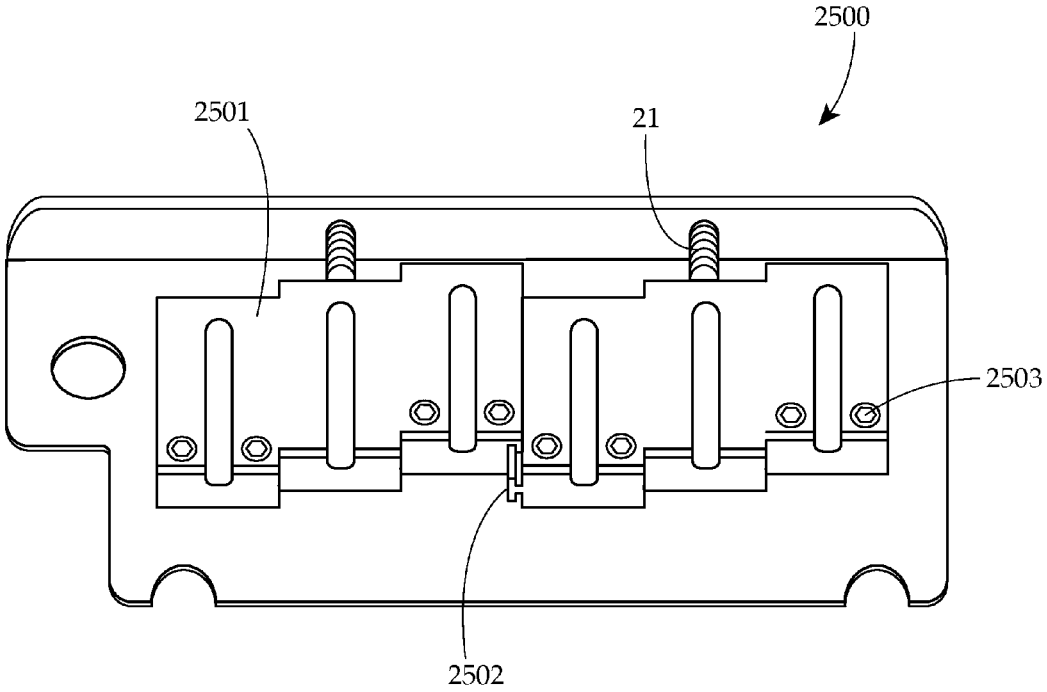
FIG. 84—(Perspective View). Illustrates the Compensated Bridge Saddle System.

FIG. 84—(Perspective View). Illustrates the Compensated Bridge Saddle System. The saddle can be manufactured from metal, titanium, aluminum, brass, bone, plastic, synthetic materials, composite material for nut, or other natural or manmade products. The (2) saddles are one piece units designed to compensate and intonate for three strings. The (2) compensated saddles are mounted to the bridge plate their integrated threaded intonation screw cavities that are located at the rear of the center saddle. The two intonation screws mount the saddles to the bridge plate, as well as, adjusting the overall length of the musical string. The saddles utilized two height adjustment screws to adjust both the radii and the string distance from the fret board.

Figure 85:
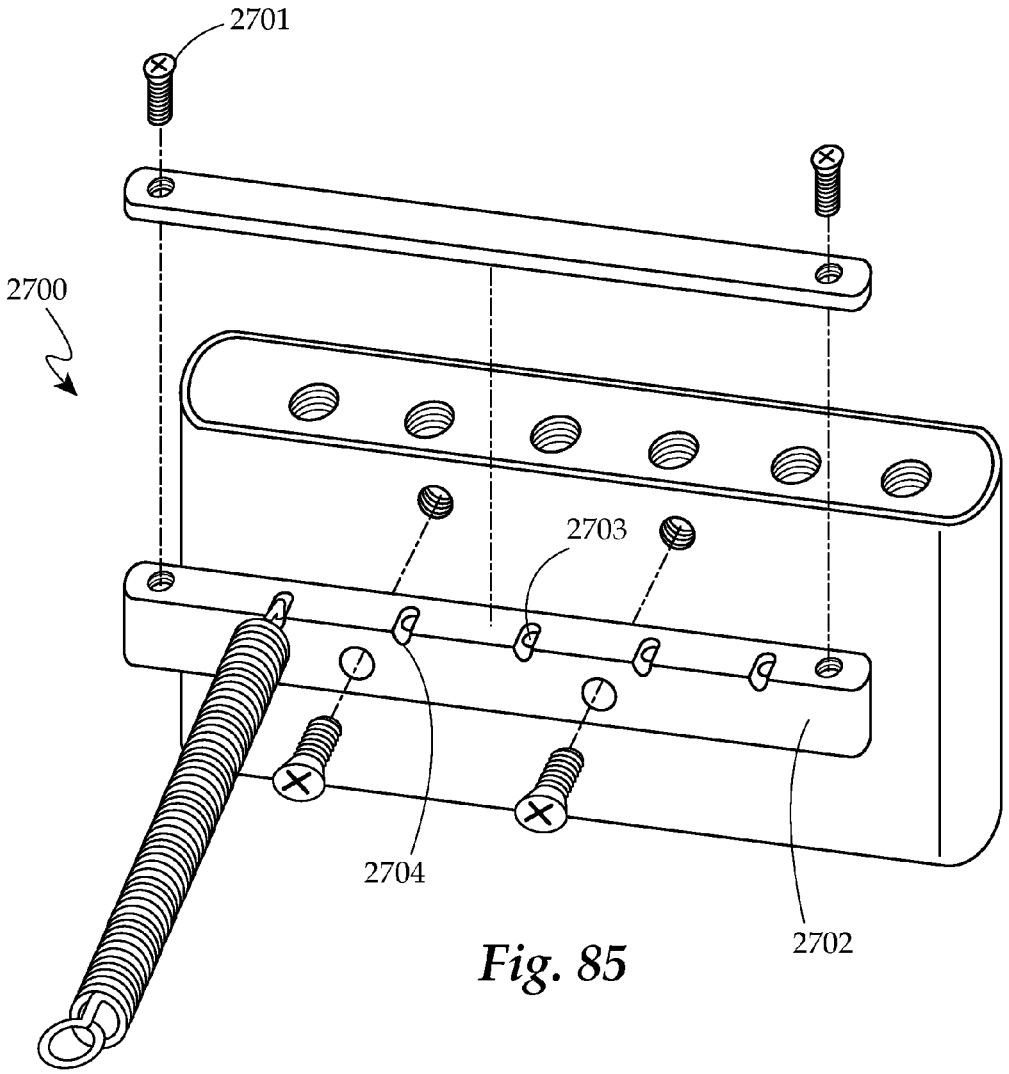
FIG. 85—Illustrated in a Main Inertia block with six threaded string chambers and a tremolo Spring Inertia Block System.

The height adjustment screws are located on either side of the each compensated saddle system. The purposes of the Compensated Saddle System are to minimize any side to side movement of the saddles, simplify guitar set-up procedures, and enhancing tone sustain because the string are vibrating over a solid saddle system unit. FIG. 85—Illustrated in a Main Inertia block 2700 with six threaded string chambers and a tremolo Spring Inertia Block System 2702. The Main and Tremolo Spring Inertia Block Systems are mechanically coupled together via a machine screw and (2) specially threaded cavities located near the lower front edge of the inertia block. The tremolo spring are set inside specially designed channel and a cover is then secured to the Tremolo Spring Inertia Block by (2) machine screws 2701.

Figure 86:
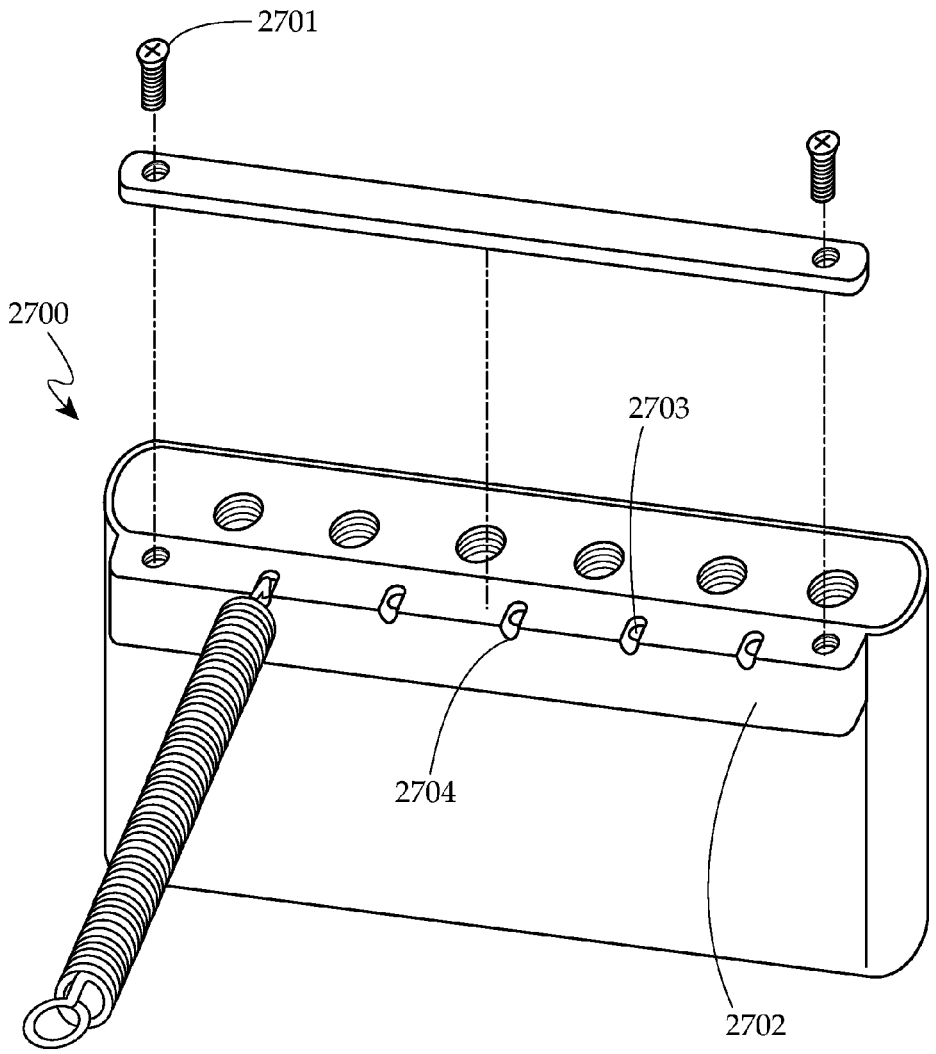
FIG. 86—Illustrated in a Main Inertia block with six threaded string chambers and a tremolo Spring Inertia Block System.

FIG. 86—Illustrated in a Main Inertia block with six threaded string chambers and a tremolo Spring Inertia Block System. The Main and integrated Tremolo Spring Inertia Block Systems can be machined as a one piece unit. They can be manufactured from metal, titanium, aluminum, brass, synthetic materials, composite materials or other natural or manmade products. The tremolo spring are set inside specially designed channel and a cover is then secured to the Tremolo Spring Inertia Block by (2) machine screws.

Figure 87:
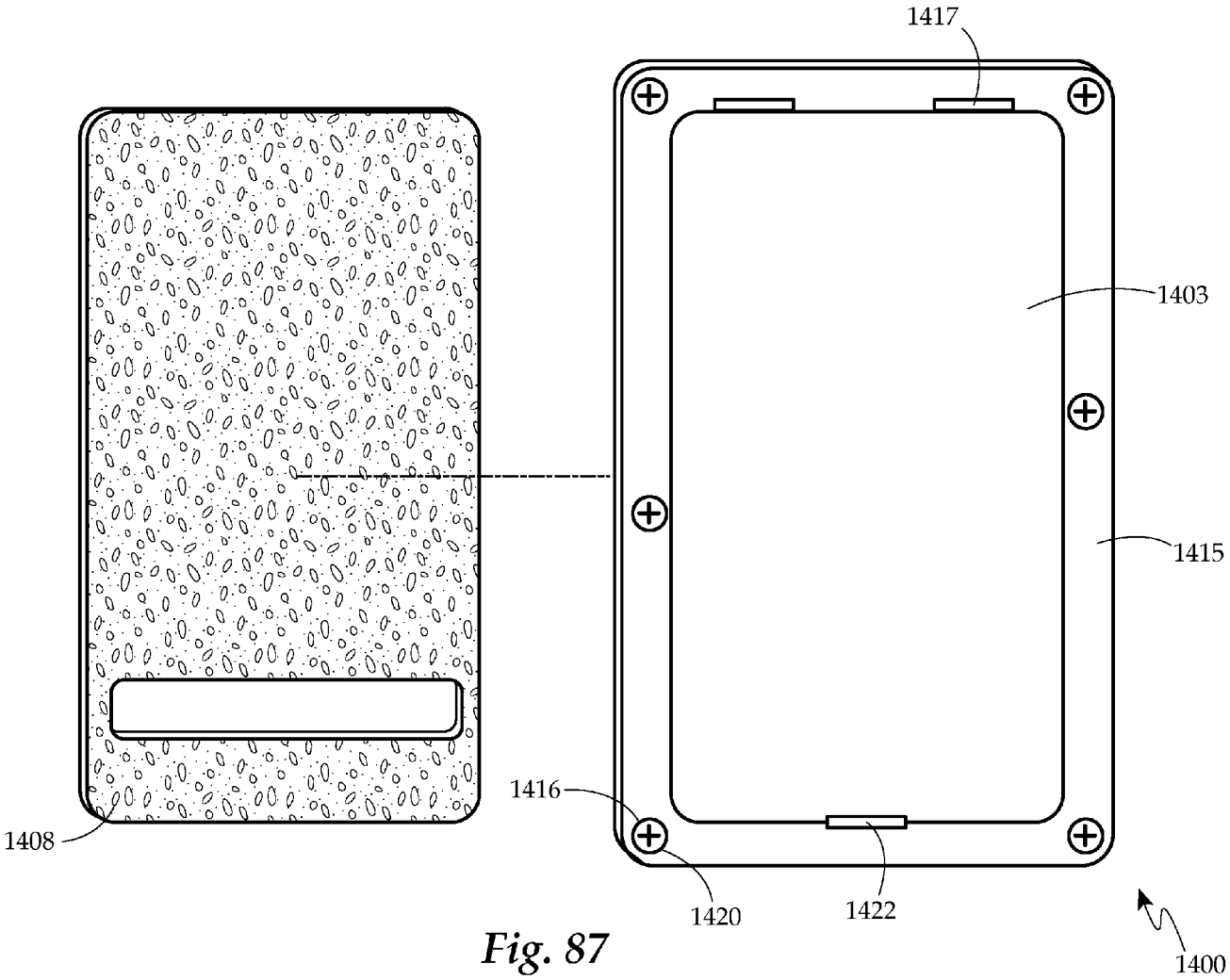
FIG. 87—Illustrated is a Tremolo Cover Surround, hinged Tremolo Cover with integrated locking mechanism that works in conjunction with the Tremolo Cover Surround.

FIG. 87—Illustrated is a Tremolo Cover Surround, 1400 hinged 1417 Tremolo Cover 1403 with integrated locking mechanism 1422 that works in conjunction with the Tremolo Cover Surround. The rear of the tremolo cover also has a spring dampening system, 1408 which can be made out of foam or any other natural, composite material or combination thereof, to eliminate sympathetic spring vibration within the tremolo cavity. This will prohibit springs from making reverberation sounds within the chamber which can be picked up by the instruments electronic systems. The hinged 1417 tremolo cover 1403 also has a molded Allen wrench compartment 1419 which secures the aforementioned The Tremolo Cover Surround has 6 chambers 1416 on the outer edge 1415 to be able to be secured to the instrument with screws 1416. When opened, the removable hinged 1417 tremolo cover allows the user to access to the tremolo springs and musical strings. This allows the user to make fine adjustments to the instrument and bridge system. These rear tremolo plates can be custom designed in an array of geometric designs, formats, depth and contour.

Figure 88:
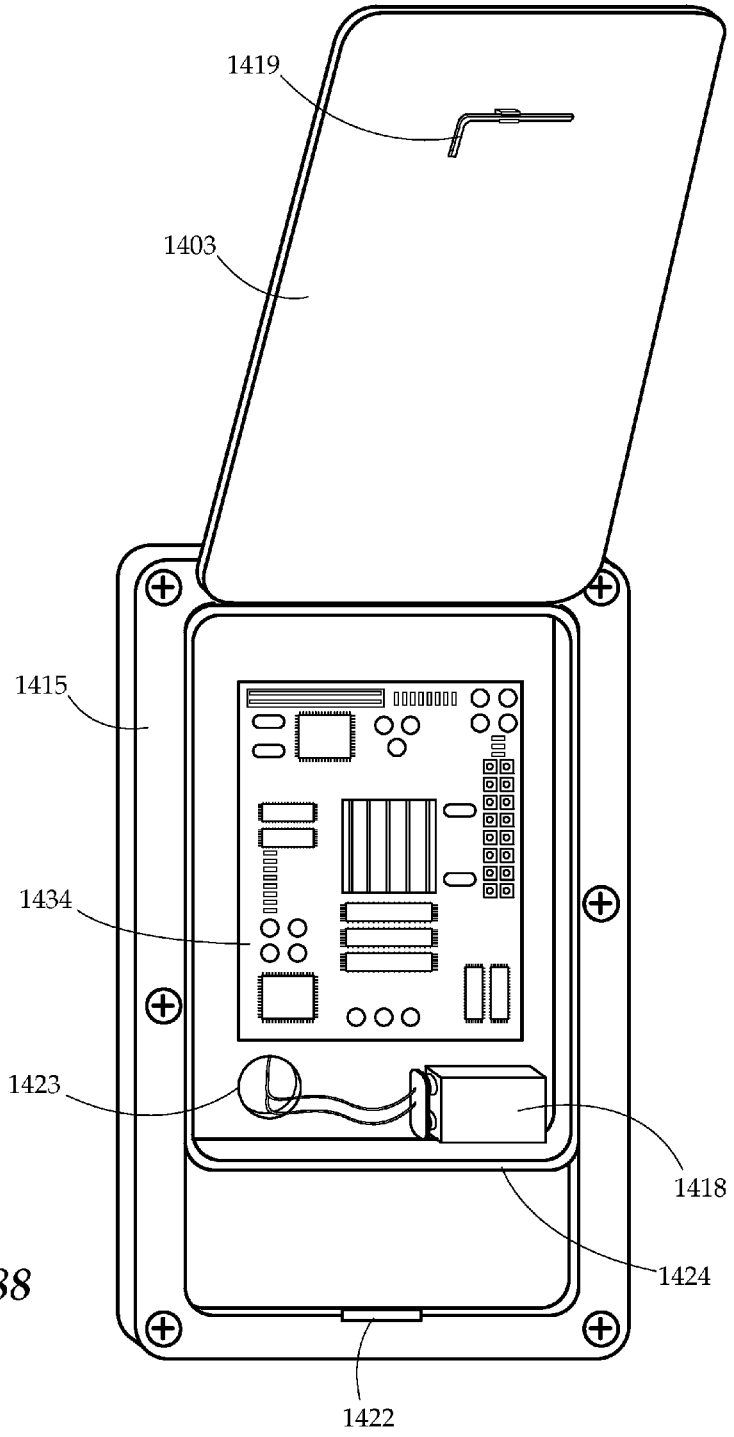
FIG. 88—Illustrated is an Expanded Tremolo Cover Surround, hinged Tremolo Cover with integrated locking mechanism that works in conjunction with the Expanded Tremolo Cover Surround.

FIG. 88—Illustrated is an Expanded Tremolo Cover Surround, hinged Tremolo Cover with integrated locking mechanism that works in conjunction with the Expanded Tremolo Cover Surround. The Expanded Tremolo Cover Surround is enlarged to form a compartment place 1424 components such as, but not limited to the following: Batteries, power sources, AC/DC power, electronic circuit boards 1434, computer chips, smart phones (i.e. i-Phone® or similar products), microprocessors, and computer interface jacks, USB, Fire wire, or any other present or future computer interface hardware or software. The 9-volt battery 1418 compartment is used for powering active electronics or after-market electronic products. After-market products can be electronic equalization products, booster systems, piezo transducer systems, noise reduction systems or other circuit board system that can fit in this area. Internal/integrated computer processors and effects processors can be configured. These cavities can be enlarged and re-configured to suit the size of the components and battery systems. USB cable and various "pin" type connector attachments can be placed and/or configured to the compartments. The rear plate designs can be custom configured for the design of the components that will be integrated within this system.

Wireless systems circuit board and components can be configured as well. Electronics can be made and placed inside this cover and encased in epoxy or other material to prevent damage to the various components. The electronic components can be of the swivel type, which can be extendable during use and retractable when not operational. These rear tremolo plates can be custom designed in an array of geometric designs, formats, depth and contour. The rear of the tremolo cover also has a spring dampening system, which can be made out of foam or any other natural, composite material or combination thereof, to eliminate sympathetic spring vibration within the tremolo cavity. This will prohibit springs from making reverberation sounds within the chamber which can be picked up by the instruments electronic systems. The Tremolo Cover Surround has 6 chambers on the outer edge to be able to be secured to the instrument with screws. When opened, the removable hinged tremolo cover allows the user to access to the tremolo springs and musical strings. This allows the user to make fine adjustments to the instrument and bridge system.

Shown is a 9 volt battery

Shown is a circuit board with attached components

Shown is a circular access cavity to facility wiring the harness 1423.

Figure 89:
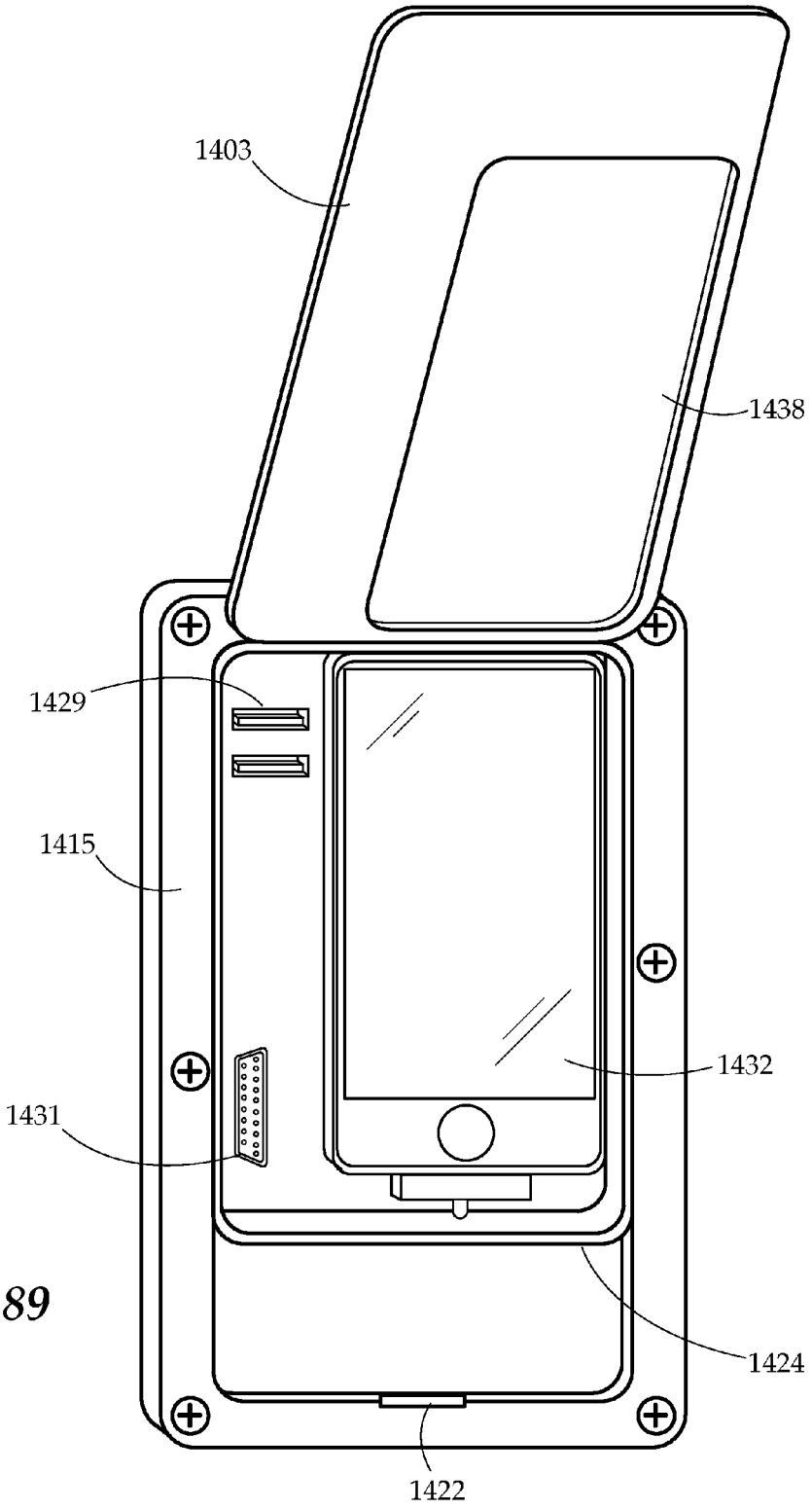
FIG. 89—Illustrated is an Expanded Tremolo Cover Surround.

FIG. 89—Illustrated is an Expanded Tremolo Cover Surround, hinged Tremolo Cover with integrated locking mechanism that works in conjunction with the Expanded Tremolo Cover Surround. The Expanded Tremolo Cover Surround is enlarged to from a compartment place 1424 components such as, but not limited to the following: Batteries, power sources, AC/DC power, electronic circuit boards, computer chips, smart phones 1432 (i.e. i-Phone® or similar products), microprocessors, and computer interface jacks, USB, 1429 Fire wire, or any other present or future computer interface hardware or software. The 9-volt battery compartment is used for powering active electronics or after-market electronic products. After-market products can be electronic equalization products, booster systems, piezo transducer systems, noise reduction systems or other circuit board system that can fit in this area. Internal/integrated computer processors and effects processors can be configured. These cavities can be enlarged and re-configured to suit the size of the components and battery systems. USB cable and various "pin" type connector attachments can be placed and/or configured to the compartments.

The rear plate designs can be custom configured for the design of the components that will be integrated within this system. Wireless systems circuit board and components can be configured as well. Electronics can be made and placed inside this cover 1438 and encased in epoxy or other material to prevent damage to the various components. The electronic components can be of the swivel type, which can be extendable during use and retractable when not operational. These rear tremolo plates can be custom designed in an array of geometric designs, formats, depth and contour. The rear of the tremolo cover also has a spring dampening system, which can be made out of foam or any other natural, composite material or combination thereof, to eliminate sympathetic spring vibration within the tremolo cavity. This will prohibit springs from making reverberation sounds within the chamber which can be picked up by the instruments electronic systems.

The Tremolo Cover Surround has 6 chambers on the outer edge to be able to be secured to the instrument with screws. When opened, the removable hinged tremolo cover allows the user to access to the tremolo springs and musical strings. This allows the user to make fine adjustments to the instrument and bridge system.

Shown is an I-Phone® 1432 hand held phone and computer. This unit can run software applications, communication applications with various devices, internet accessible, and it can be used to communicate with other devices by wires or wirelessly.

Figure 90:
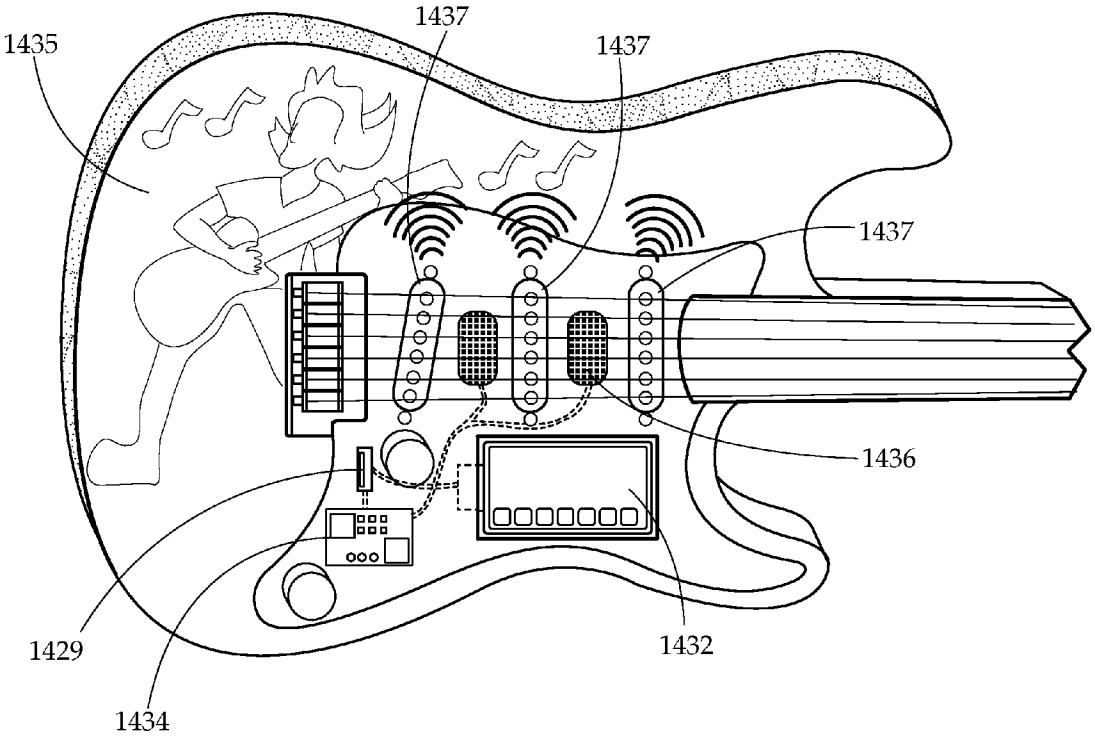
FIG. 90—Illustrated is an Electronic Guitar and Pick Guard System.

Shown are (2) USB ports 1429, (1) pin style connector 1431, (1) power source device for I-Phone® FIG. 90—Electronic Guitar and Pick Guard System—The guitar is of a semi-hollow design in which 2 LED displays are placed on the front and back of the guitar. The displays are mounted along the external bracing system of the guitar's structure. The guitar can work in conjunction with a computer processor, touch screen or voice command technology. The guitar can interface with computerized storage devices capable of interface capabilities, internet access and downloading and storing files/DATA.

An internal and external hard drive system may work in conjunction with the instrument to obtain audio or video data or other files. External Hardware interfaces exist in computing systems between many of the components such as the various buses, storage devices, other I/O devices, etc. A hardware interface is described by the mechanical, electrical and logical signals at the interface and the protocol for sequencing them (sometimes called signaling). A standard interface, such as SCSI, decouples the design and introduction of computing hardware, such as I/O devices, from the design and introduction of other components of a computing system, thereby allowing users and manufacturer's great flexibility in the implementation of computing systems. Hardware interfaces can be parallel where performance is important or serial where distance is important.

The invention can be mounted directly, or recessed into the structure of the musical instrument, pick guard, tremolo cover, or any other external or internal surface. This invention will allow the user to place apps/files/or downloaded software/capable of two-way communication or multiple communications and interaction with other devices. This device can also have a computerized potentiometers/modules to control/operate the computerized device. The pick guard can be a LCD/LED or other advanced visual and audio display device which can interact with pictures, videos and other computerized applications from the guitar's computer system. The computer system/I-pod or other advanced computer can be integrated into or onto an instrument. Voice activation programs could be added so the user can verbally change programs with or without the need of mechanical devices. Voice control would allow the musician to communicate with musical gear, PA systems, as well as other musicians and staff. The rear cover housing can be weather and impact resistant to reduce to protect the computerized device from adverse weather conditions. The computer can control all aspects of computerized bridge and tuning machines; pickup sounds; audio and visual effects, as well as other applications.

All files in the computer system may be removed from one guitar and integrated into another one. Multiple musicians can communicate their musical ideas with each other with a similar comparable computerized device. The computerized device can hold musical effects in which parameters can be edited by the integrated computerized device or altered by an external computerized device via internet or computer interface systems. Computer interface jacks and wireless communication capabilities, such as firewire, USB, Ethernet, parallel ports and other advanced systems can be incorporated into the system to allow for communication between computerized devices, sound systems, internet accessibility, and internal and external recording capabilities. The LCD-LED or other display systems will allow the user the flexibility and versatility to effective to communicate their audio and visual experience related to their musical expression. The guitar's passive pickups or digital pickups can be integrated into this system. In addition, a computerized electronic/digital pickups system may be incorporated into the devices to create seamless interface between the computer system hardware, software and electronics system.

The electronic/computerized digital components will afford the guitar to have superior sound quality and articulation that are not present in current passive systems. In addition, computers and software would be able to edit the electronic sounds/tonality of the pickups, hence altering/editing the musical sound of the instrument during song editing. Power supplies capabilities can be incorporated into the design for battery, electric, solar power as well as other technological advancements of computerized electronic devices in relation to power source applications. The LCD/LED displays can be part of the guitar's overall design, and can be integrated into the guitar body and neck designs. The LCD/LED displays can teach musicians how to play their instrument with the assistance of an integrated computer system. The neck, fret board, pick guard, strings, electronic digital pickups, transducers, potentiometers, guitar body, can be integrated within touch screen technologies.

Shown is a LED display on both sides of the instrument 1435

Shown is the semi-hollow body bracing structure of the instrument

Shown is a LED touch screen pick guard

Shown is a microprocessor with touch screen 1434

Shown are digital pickups with individual adjustments for each string

Shown are (2) digital stereo speakers 1436

Shown is a USB Port 1429

Shown is a electronic device to control the microprocessor 1432

Shown are (2) digital potentiometers.

Shown is a electronic neck and fret board system

Shown is an image on the LED screen 1435

Figure 91:
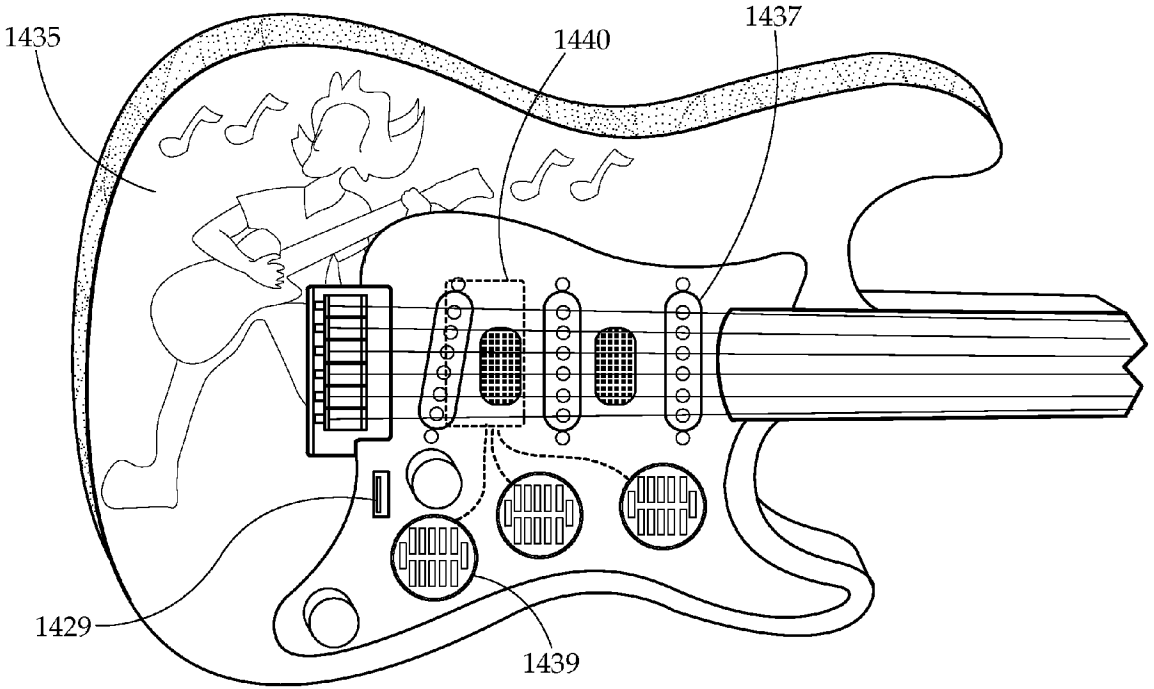
FIG. 91—Illustrated is an Electronic Guitar and Pick Guard System.

FIG. 91—Electronic Guitar and Pick Guard System—The guitar is of a semi-hollow design in which 2 LED displays are placed on the front and back of the guitar. The displays are mounted along the external bracing system of the guitar's structure. The guitar can work in conjunction with a computer processor, touch screen or voice command technology. The guitar can interface with computerized storage devices capable of interface capabilities, internet access and downloading and storing files/DATA. An internal and external hard drive system may work in conjunction with the instrument to obtain audio or video data or other files. External Hardware interfaces exist in computing systems between many of the components such as the various buses, storage devices, other I/O devices, etc. A hardware interface is described by the mechanical, electrical and logical signals at the interface and the protocol for sequencing them (sometimes called signaling). A standard interface, such as SCSI, decouples the design and introduction of computing hardware, such as I/O devices, from the design and introduction of other components of a computing system, thereby allowing users and manufacturer's great flexibility in the implementation of computing systems. Hardware interfaces can be parallel where performance is important or serial where distance is important.

The invention can be mounted directly, or recessed into the structure of the musical instrument, pick guard, tremolo cover, or any other external or internal surface. This invention will allow the user to place apps/files/or downloaded software/capable of two-way communication or multiple communications and interaction with other devices. This device can also have a computerized potentiometers/modules to control/operate the computerized device. The pick guard can be a LCD/LED or other advanced visual and audio display device which can interact with pictures, videos and other computerized applications from the guitar's computer system. The computer system/I-pod or other advanced computer can be integrated into or onto an instrument. Voice activation programs could be added so the user can verbally change programs with or without the need of mechanical devices. Voice control would allow the musician to communicate with musical gear, PA systems, as well as other musicians and staff. The rear cover housing can be weather and impact resistant to reduce to protect the computerized device from adverse weather conditions.

The computer can control all aspects of computerized bridge and tuning machines; pickup sounds; audio and visual effects, as well as other applications. All files in the computer system may be removed from one guitar and integrated into another one. Multiple musicians can communicate their musical ideas with each other with a similar comparable computerized device. The computerized device can hold musical effects in which parameters can be edited by the integrated computerized device or altered by an external computerized device via internet or computer interface systems. Computer interface jacks and wireless communication capabilities, such as firewire, USB, Ethernet, parallel ports and other advanced systems can be incorporated into the system to allow for communication between computerized devices, sound systems, internet accessibility, and internal and external recording capabilities. The LCD-LED or other display systems will allow the user the flexibility and versatility to effective to communicate their audio and visual experience related to their musical expression.

The guitar's passive pickups or digital pickups can be integrated into this system. In addition, a computerized electronic/digital pickups system may be incorporated into the devices to create seamless interface between the computer system hardware, software and electronics system. The electronic/computerized digital components will afford the guitar to have superior sound quality and articulation that are not present in current passive systems. In addition, computers and software would be able to edit the electronic sounds/tonality of the pickups, hence altering/editing the musical sound of the instrument during song editing. Power supplies capabilities can be incorporated into the design for battery, electric, solar power as well as other technological advancements of computerized electronic devices in relation to power source applications. The LCD/LED displays can be part of the guitar's overall design, and can be integrated into the guitar body and neck designs. The LCD/LED displays can teach musicians how to play their instrument with the assistance of an integrated computer system. The neck, fret board, pick guard, strings, electronic digital pickups, transducers, potentiometers, guitar body, can be integrated within touch screen technologies.

Shown is a LED display on both sides of the instrument
Shown is the semi-hollow body bracing structure of the instrument
Shown is a LED touch screen pick guard
Shown are (3) solar panels 1439
Shown are passive pickups with individual adjustments for each string 1437
Shown are (2) digital stereo speakers
Shown is a USB Port 1429
Shown is a power source 1440
Shown are (2) potentiometers.
Shown is a conventional neck and fret board system
Shown is an image on the LED screen 1435

Figure 92:
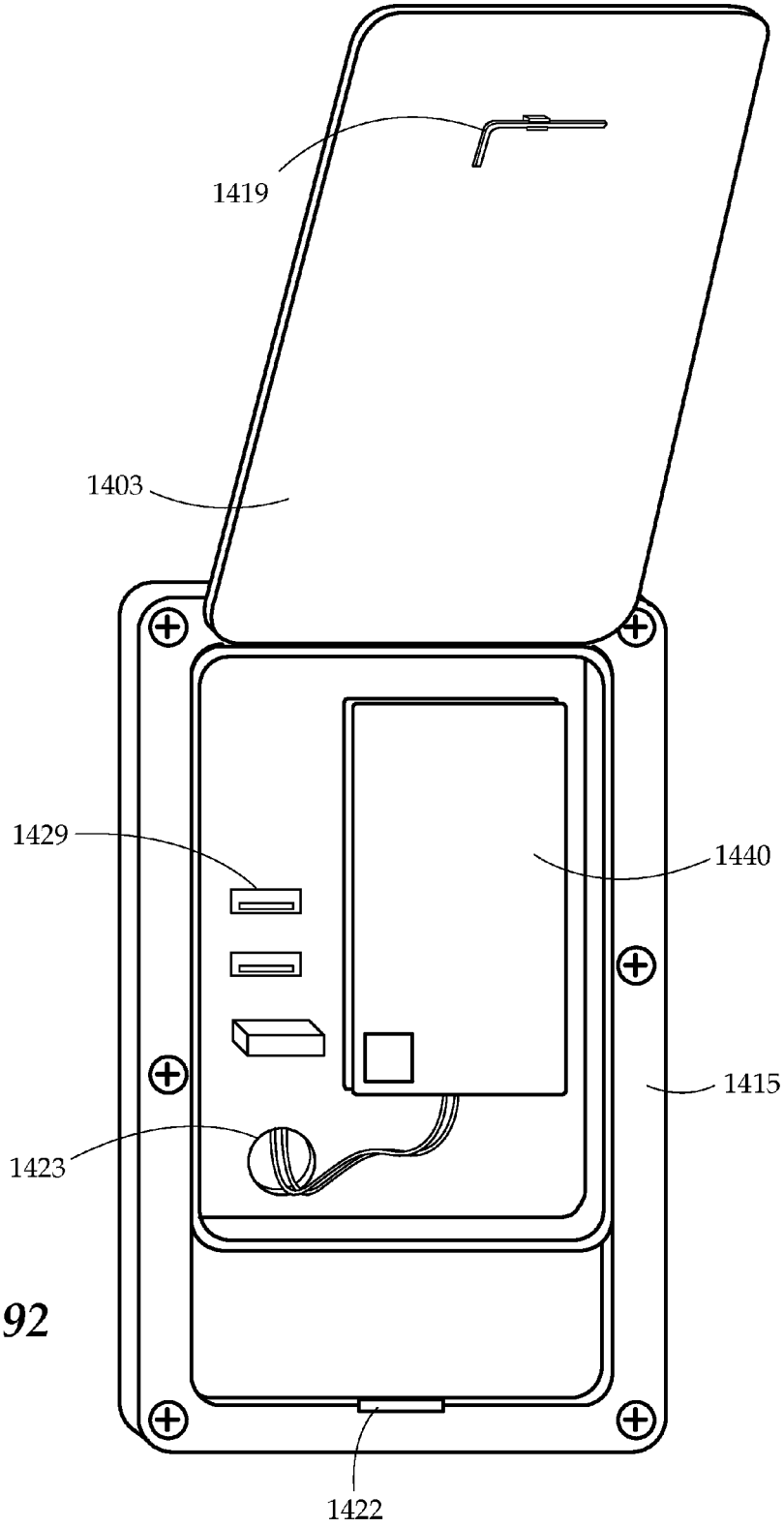
FIG. 92—Illustrated is an Expanded Tremolo Cover Surround.

FIG. 92—Illustrated is an Expanded Tremolo Cover Surround, hinged Tremolo Cover with integrated locking mechanism that works in conjunction with the Expanded Tremolo Cover Surround. The Expanded Tremolo Cover Surround is enlarged to from a compartment place components such as, but not limited to the following: Batteries, power sources, AC/DC power, electronic circuit boards, computer chips, smart phones (i.e. i-Phone® or similar products), microprocessors, and computer interface jacks, USB, Fire wire, or any other present or future computer interface hardware or software. The 9-volt battery compartment is used for powering active electronics or after-market electronic products. After-market products can be electronic equalization products, booster systems, piezo transducer systems, noise reduction systems or other circuit board system that can fit in this area. Internal/integrated computer processors and effects processors can be configured. These cavities can be enlarged and re-configured to suit the size of the components and battery systems. USB cable and various "pin" type connector attachments can be placed and/or configured to the compartments.

The rear plate designs can be custom configured for the design of the components that will be integrated within this system. Wireless systems circuit board and components can be configured as well. Electronics can be made and placed inside this cover and encased in epoxy or other material to prevent damage to the various components. The electronic components can be of the swivel type, which can be extendable during use and retractable when not operational. These rear tremolo plates can be custom designed in an array of geometric designs, formats, depth and contour. The rear of the tremolo cover also has a spring dampening system, which can be made out of foam or any other natural, composite material or combination thereof, to eliminate sympathetic spring vibration within the tremolo cavity. This will prohibit springs from making reverberation sounds within the chamber which can be picked up by the instruments electronic systems. The Tremolo Cover Surround has 6 chambers on the outer edge to be able to be secured to the instrument with screws. When opened, the removable hinged tremolo cover allows the user to access to the tremolo springs and musical strings. This allows the user to make fine adjustments to the instrument and bridge system. Shown is a battery source, Power source input, 1440 (2) USB connections 1429 or similar. Also shown is a circular access cavity for the wiring harness 1423.

Figure 93:
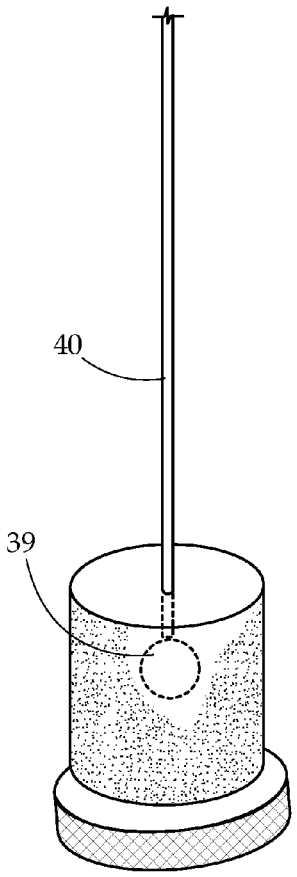
FIG. 93—Illustrates a magnetic, locking musical string with a knurled ended fastener system.
Figure 94:
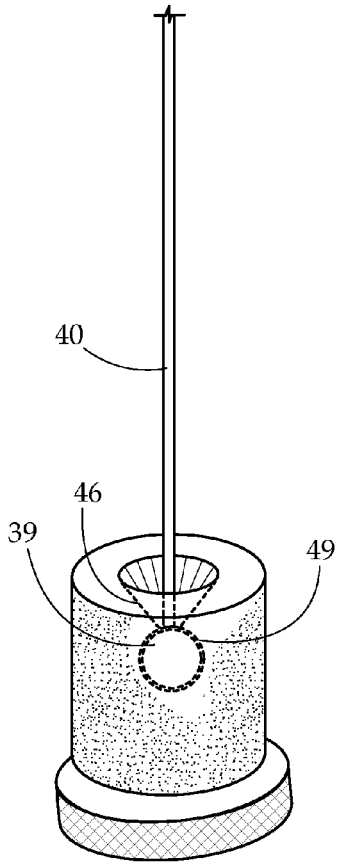
FIG. 94—Illustrates a magnetic, locking musical string with a knurled ended fastener system.

FIG. 93—Illustrates a magnetic, locking musical string 40 with a knurled ended fastener system. The magnetic locking end ensures that there is a strong mechanical contact with the musical instrument to prevent unwanted movement of the musical string. This locking string design enhances sustain, tonality, and transfer of string vibrations throughout the instrument. The locking string also prevents the string from ejecting from the instrument upon accidental breakage and therefore preventing damage to the instrument and/or a serious injury to the user. The locking string can be used as a deterrent to prevent young children from being injured from an ejecting string end. FIG. 94—Illustrates a magnetic, locking musical string with a knurled ended fastener system. This musical string has an integrated conical design 46 on the threaded end 47 of this faster system 45. The conical string end allows the string to rotate at various degrees and axes to allow the ball end 39 of the musical string that is integrated into this string end design 49. The string end can be mount on one plane and the string can be rotate on another plane without create stressors upon the musical string. The magnetic locking end ensures that there is a strong mechanical contact with the musical instrument to prevent unwanted movement of the musical string.

In conclusion, herein is presented a stringed instrument system. The invention is illustrated by example in the drawing figures, and throughout the written description. It should be understood that numerous variations are possible, while adhering to the inventive concept. Such variations are contemplated as being a part of the present invention.

What is claimed is:

1. A tremolo cover surround system comprising:

a tremolo cover surround;

a hinged cover that works in conjunction with the tremolo cover surround; and a spring dampening system, wherein the spring dampening system is located on a rear section of the tremolo cover surround.

2. The tremolo cover surround system of claim 1, wherein the hinged cover further comprises an integrated locking mechanism.

3. The tremolo cover surround system of claim 1, wherein the spring dampening system is made of a material to eliminate sympathetic spring vibration within a tremolo cavity, selected from the group consisting of: foam, a natural material, a composite material, and any combination thereof.

4. The tremolo cover surround system of claim 3, wherein the material of the spring dampening system prevents any musical string in a musical instrument from making reverberation sounds within a chamber that is picked up by a musical instruments electronic system.

5. The tremolo cover surround system of claim 1, wherein the cover further comprises a molded Allen wrench compartment to secure the tremolo cover surround to a musical instrument.

6. The tremolo cover surround system of claim 1, wherein the tremolo cover surround system further comprises six chambers on an outer edge of the surround system to secure to a musical instrument.

7. The tremolo cover surround system of claim 1, wherein the surround system forms a compartment to house a variety of components for use with a musical instrument selected from the group consisting of: Batteries, power sources, AC/DC power, electronic circuit boards, computer chips, smart phones, microprocessors, and computer interface jacks, USB, Fire wire, and any other present or future computer interface hardware or software.

8. The tremolo cover surround system of claim 1, wherein the tremolo cover surround system is custom designed in an array of geometric designs, formats, depth and contour.

9. The tremolo cover surround system of claim 1, wherein when the cover is opened, and a user is able to access a plurality of tremolo strings and musical strings to make adjustments to an instrument and bridge system.

10. The tremolo cover surround system of claim 1, wherein the hinged cover is removeably attached to the tremolo cover surround.

* * * * *